US005732940A

United States Patent [19]

Kobayashi et al.

[11] Patent Number: 5,732,940

[45] Date of Patent: Mar. 31, 1998

[54] METHOD OF AND APPARATUS FOR POST-TREATING SHEETS WITH IMAGES RECORDED THEREON

[75] Inventors: Misao Kobayashi; Kimihiko Furuya; Hideki Mimura; Satoru Matsuki; Takehiko Saitou; Toshihiko Fujita, all of Yamanasi-Ken, Japan

[73] Assignee: Nisca Corporation, Yamanashi-ken, Japan

[21] Appl. No.: 559,165

[22] Filed: Nov. 13, 1995

[30] Foreign Application Priority Data

| | | | |
|---|---|---|---|
| Nov. 10, 1994 | [JP] | Japan | 6-302754 |
| Jul. 3, 1995 | [JP] | Japan | 7-189804 |
| Jul. 3, 1995 | [JP] | Japan | 7-189811 |

[51] Int. Cl.[6] ..... B65H 39/02

[52] U.S. Cl. ..... 270/58.01; 270/58.14

[58] Field of Search ..... 270/58.01, 58.14, 270/58.18, 58.19

[56] References Cited

U.S. PATENT DOCUMENTS

| | | | |
|---|---|---|---|
| 5,099,292 | 3/1992 | Hirose | 270/58.14 |
| 5,133,539 | 7/1992 | Ishiguro et al. | 270/58.14 |
| 5,141,215 | 8/1992 | Ishiguro et al. | 270/58.14 |
| 5,203,550 | 4/1993 | Kawano et al. | 270/58.14 |
| 5,236,185 | 8/1993 | Taneda et al. | 270/58.14 |
| 5,362,200 | 11/1994 | Ushirogato | 270/58.14 |
| 5,465,947 | 11/1995 | Okumura et al. | 270/58.18 |

*Primary Examiner*—John T. Kwon

*Attorney, Agent, or Firm*—Kane,Dalsimer,Sullivan, Kurucz, Levy, Eisele and Richard, LLP

[57] ABSTRACT

Printed sheets discharged from a copying machine are fed by a sheet feed mechanism through a sheet reception slot and stacked selectively onto a non-sorting tray in a non-sorting process or a tiltable sorting tray among a plurality of sorting trays which is located in a sheet receiving position in a sorting process or a grouping process. The sorting tray in the sheet receiving tray is in a first posture in which it is inclined to a horizontal surface by an acute angle. The posture of the sorting tray is changed from the first posture to a second posture in which it is substantially horizontal when it is moved from the sheet receiving position to a sheet removal position. A pile of printed sheets stacked on the tiltable sorting tray in the sheet removal position is gripped by a gripper mechanism. The gripped pile of printed sheets is placed over a vertically movable inclined stacking tray, and then released onto the stacking tray.

82 Claims, 35 Drawing Sheets

METHOD OF AND APPARATUS FOR POST-TREATING SHEETS WITH IMAGES RECORDED THEREON

BACKGROUND OF THE INVENTION

1. Field of the Invention

The present invention relates to a method of and an apparatus for post-treating sheets with images recorded thereon which have been discharged from an image forming system such as an electrophotographic copying machine, a printer connected to various pieces of office-automation equipment, a printing machine, or the like, and more particularly to a method of and an apparatus for post-treating sets or piles of image-recorded sheets which have been successively stacked on a plurality of respective sorting trays.

2. Description of the Related Art

There have been known systems comprising an image forming apparatus for producing hard copies in the form of sheets with images recorded thereon and a sheet post-treating apparatus connected the discharge end of the image forming apparatus. In these known systems, the sheet post-treating apparatus is primarily designed to sort image-recorded sheets discharged from the image forming apparatus. Generally, such systems are required to be as compact as possible.

Recent sheet post-treating apparatus available in the market operate to stack image-recorded sheets discharged from an image forming apparatus successively on a plurality of respective sorting trays until a desired number of sheets are piled on each of the sorting trays, and thereafter either staple each set of sheets or jog the sheets of each pile and discharge them as grouped onto a stacking tray. There is a growing demand for a reduction of the size of such sheet post-treating apparatus.

Specifically, existing systems composed of a sheet post-treating apparatus and a copying machine or the like have suffered various disadvantages. For example, if a stacker is positioned behind sorting trays in with respect to the direction in which sheets are fed in a sheet post-treating apparatus, then the stacker and the sorting trays are located side by side in the direction in which sheets are introduced into the sorting trays. As a result, the sheet post-treating apparatus and a copying machine or the like combined therewith are necessarily large in size, requiring a large installation space for the entire system. Another problem is that after the operator has entered copying commands through the control panel of a copying machine or the like combined with a sheet post-treating apparatus, the operator needs to move to the outlet of a stacker in order to remove piles of copied sheets on a stacking tray because the stacking tray is spaced from the control panel. Such a system, therefore, cannot be operated on efficiently.

Attempts to make sheet post-treating apparatus and hence systems incorporating them smaller in size have heretofore posed various limitations on sheet post-treating operation of the post-treating apparatus, making it impossible to post-treat copied sheets efficiently and preventing the operator from working with the post-treating apparatus efficiently.

On the other hand, placing greater emphasis on better efficiency for sheet post-treating operation tends to result in greater difficulty making the post-treating apparatus more compact.

SUMMARY OF THE INVENTION

It is therefore a main object of the present invention to provide a method of and an apparatus for post-treating sheets with images recorded thereon efficiently through a compact arrangement.

To attain the above-mentioned object, according to a first aspect of the present invention, there is provided a method of post-treating sheets with images recorded thereon which are discharged from an image forming apparatus, comprising steps of: (a) stacking sheets onto a sorting tray which is positioned in a sheet receiving position and a posture of which is brought to a first posture; (b) changing the posture of at least a sorting tray in a sheet removal position to a second posture different from said first posture; and (c) pulling the pile of sheets stacked on said sorting tray in said sheet removal position therefrom.

According to a second aspect of the present invention, there is provided a method of post-treating sheets, comprising steps of: (a) bringing a posture of at least a sorting tray which is positioned in a sheet receiving position into a first posture; (b) stacking sheets with images recorded thereon, which are discharged from an image forming apparatus, onto said sorting tray in the sheet receiving position; (c) changing the posture of at least a sorting tray which is positioned in a sheet removal position to a second posture different from said first posture, after a completion of said step (b); and (d) pulling the pile of sheets stacked on said sorting tray in said sheet removal position therefrom.

According to a third aspect of the present invention, there is provided an apparatus for post-treating sheets with images recorded thereon which are discharged from an image forming apparatus, comprising: a plurality of sorting trays for stacking sheets successively thereon in a vertical direction, said sorting trays being arranged in said vertical direction and supported for movement in said vertical direction; tray actuating means for moving said sorting trays successively to a sheet receiving position in the vertical direction; posture changing means for changing a posture of the sorting tray; gripper means for gripping a pile of sheets stacked on one of said sorting trays which is positioned in a sheet removal position; and gripper actuating means for moving said gripper means in both a sheet removing direction and an upward direction on a downstream side of the sorting trays with respect to said sheet removing direction to pull the pile of sheets gripped by said gripper means from said sorting trays in said sheet removal position, and wherein said posture changing means changes the posture of the sorting tray in said sheet receiving position to a first posture, while changes that in said sheet removal position to a second posture different from said first posture.

According to 4th aspect of the present invention, there is provided an apparatus for post-treating sheets with images recorded thereon which are discharged from an image forming apparatus, comprising: a plurality of sorting trays for stacking sheets successively thereon in a vertical direction, said sorting trays being arranged in said vertical direction and supported for movement in said vertical direction; tray actuating means for moving said sorting trays successively to a sheet introducing position in the vertical direction; posture changing means for changing a posture of the sorting tray; gripper means for gripping a pile of sheets stacked on one of said sorting trays which is positioned in a sheet removal position; and gripper actuating means for moving said gripper means in both a sheet removing direction and an upward direction on a downstream side of the sorting trays with respect to said sheet removing direction to pull the pile of sheets gripped by said gripper means from said sorting trays in said sheet removal position, and wherein said posture changing means changes the posture of the sorting tray to a first posture when the sheets are introduced onto the sorting tray in said sheet receiving position, while changes the posture of the sorting tray to a second posture when the pile of sheets are taken out from said sorting tray in said sheet removal position.

According to a 5th aspect of the present invention, there is provided a method of post-treating sheets with images recorded thereon which are discharged from an image forming apparatus, comprising steps of: (a) stacking sheets onto a sorting tray which is positioned in a sheet receiving position; (b) moving the sorting tray in a sheet removal position so as to oppose to a sheet removal port; (c) gripping a pile of sheets stacked on the sorting tray in said sheet removal position by gripper means; and (d) pulling said gripper means with being gripping the pile of sheets in a sheet removing direction.

According to a 6th aspect of the present invention, there is provided a method of post-treating sheets, comprising steps of; (a) bringing a posture of a sorting tray into a first posture; (b) moving the sorting tray to a sheet receiving position in which the sheets with images recorded thereon which are discharged from an image forming apparatus; (c) stacking the sheets onto the sorting tray in said sheet receiving position; (d) changing the posture of the sorting tray from the first posture to a second posture different from said first posture after a completion of said step (c); (e) moving the sorting tray to a sheet removal position so as to oppose to a sheet removal port which is formed to correspond to said second posture; (f) gripping a pile of sheets stacked on the sorting tray in said sheet removal position by gripper means; and (g) pulling said gripper means with being gripping the pile of sheets in a sheet removing direction.

According to a 7th aspect of the present invention, there is provided an apparatus for post-treating sheets with images recorded thereon which are discharged from an image forming apparatus, comprising: a plurality of sorting trays for stacking sheets successively thereon in a vertical direction, said sorting trays being arranged in said vertical direction and supported for movement in said vertical direction; tray actuating means for vertically moving said sorting trays successively to a sheet receiving position to which the sheets are introduced and to a sheet removal position from which a pile of sheets is taken out in a sheet removing direction; a closure plate arranged on the downstream side of the sorting trays with respect to said sheet removing direction; a sheet removal port formed to said closure plate, corresponding to the sorting tray in the sheet removal position; gripper means for gripping the pile of sheets stacked on the sorting tray in the sheet removal position through said sheet removal port; and gripper actuating means for moving said gripper means in said sheet removing direction.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 31E is a side elevational view of the sheet pile presser mechanism with the stacking tray lowered until a sensor is turned on;

DETAILED DESCRIPTION OF THE PREFERRED EMBODIMENTS

Sheet Post-Treating Apparatus 10

Figure 1:
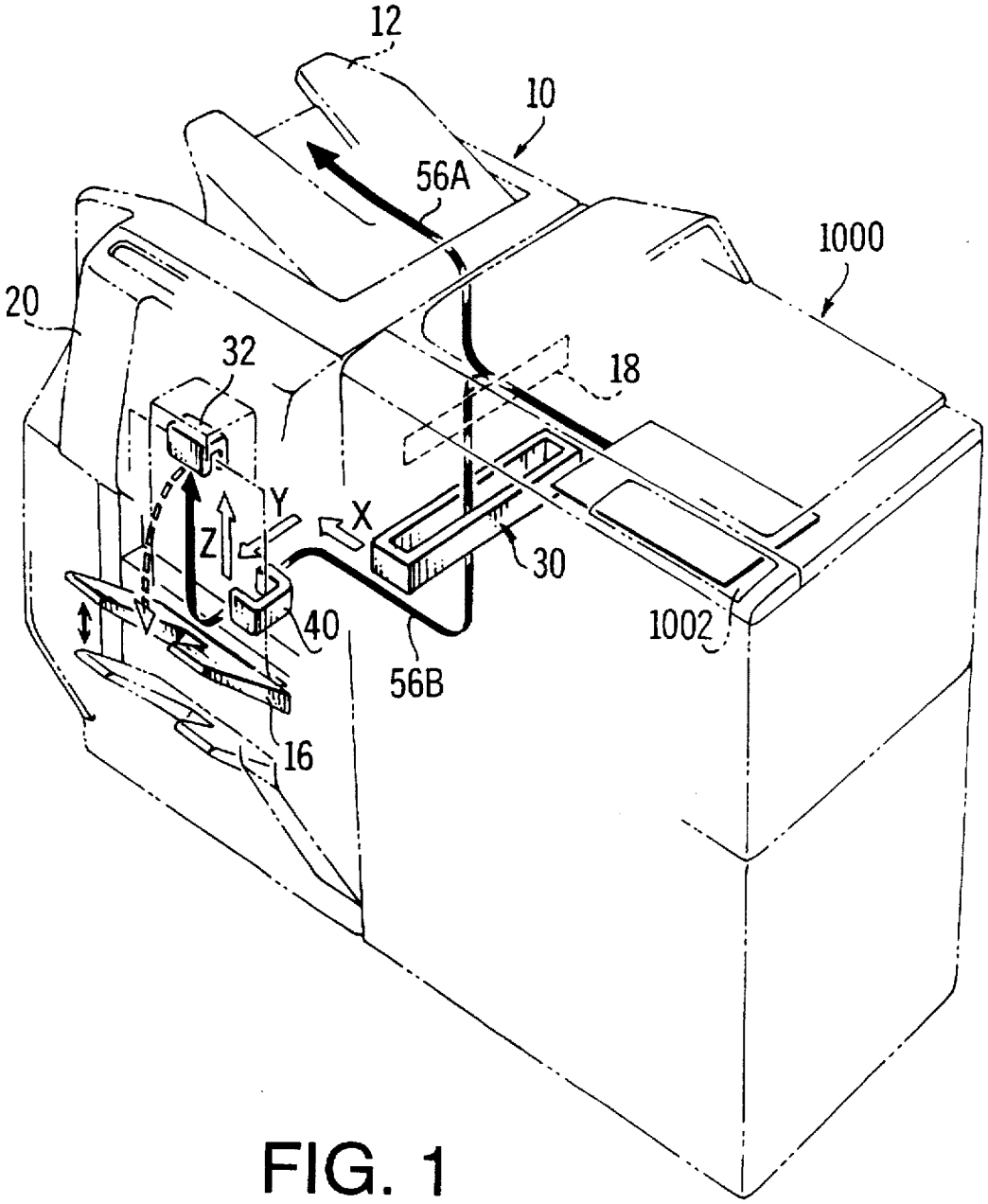
FIG. 1 is a schematic perspective view of a sheet post-treating apparatus according to the present invention, which is combined with a copying apparatus.

As schematically shown in FIG. 1, a sheet post-treating apparatus 10 according to the present invention is connected to an image forming apparatus 1000, typically an electrophotographic copying apparatus, for post-treating a copied sheet S, i.e., a sheet S with an image recorded thereon, discharged from a discharge slot (not shown) defined in a discharge region of the electrophotographic copying apparatus 1000.

The sheet post-treating apparatus 10 can process supplied sheets S in a range of various different post-treating processes. The post-treating processes include a non-sorting process for successively stacking all sheets S on a non-sorting tray 12 so as to collect the stacked sheets S altogether, a sorting process for stacking piles, each composed of a succession of all pages, of aligned sheets S on as many sorting trays 14 (see FIG. 3) among a plurality of sorting trays 14 as the number of desired sets of copies, when the sheet-post-treating apparatus 10 is in a sorting mode, a grouping process for stacking piles, each composed of a group of identical pages, of aligned sheets S on as many sorting trays 14 as the number of desired sets of copies when the sheet-post-treating apparatus 10 is in a grouping mode, a dual punching process for forming a pair of punched binding holes in edges of sheets S before the sheets S are processed in the sorting process or the grouping process, i.e., before the sheets S are stacked on the sorting trays 14, a stacking process for successively discharging piles P (see FIG. 8) of sheets S stacked on a plurality of sorting trays 14 from a sheet removal position onto a stacking tray 16, a stapling process for stapling the piles P of sheets S being discharged in the stacking mode, and a jogging process for stacking the piles P of sheets S as they are successively discharged in the stacking mode in alternately staggered relationship on the stacking tray 16.

The electrophotographic copying apparatus 1000 has an automatic document feeder (not shown) for automatically feeding documents to be copied into the copying mechanism of the electrophotographic copying apparatus 1000. The electrophotographic copying apparatus 1000 operates under the control of a given program to produce as many copied sheets S as desired which are duplicates of each of a plurality of documents to be copied while the documents are successively fed into the copying mechanism by the automatic document feeder, and to discharge the copied sheets S successively from the discharge slot. The sheets S that are discharged from the discharge slot are oriented such that the shorter sides of the sheet S, i.e., the sides lying parallel to the longitudinal direction of the sheet S, extend perpendicularly to the direction (sheet sorting direction) X in which the sheet S is discharged.

Components of the Sheet Post-Treating Apparatus 10

Figure 2:
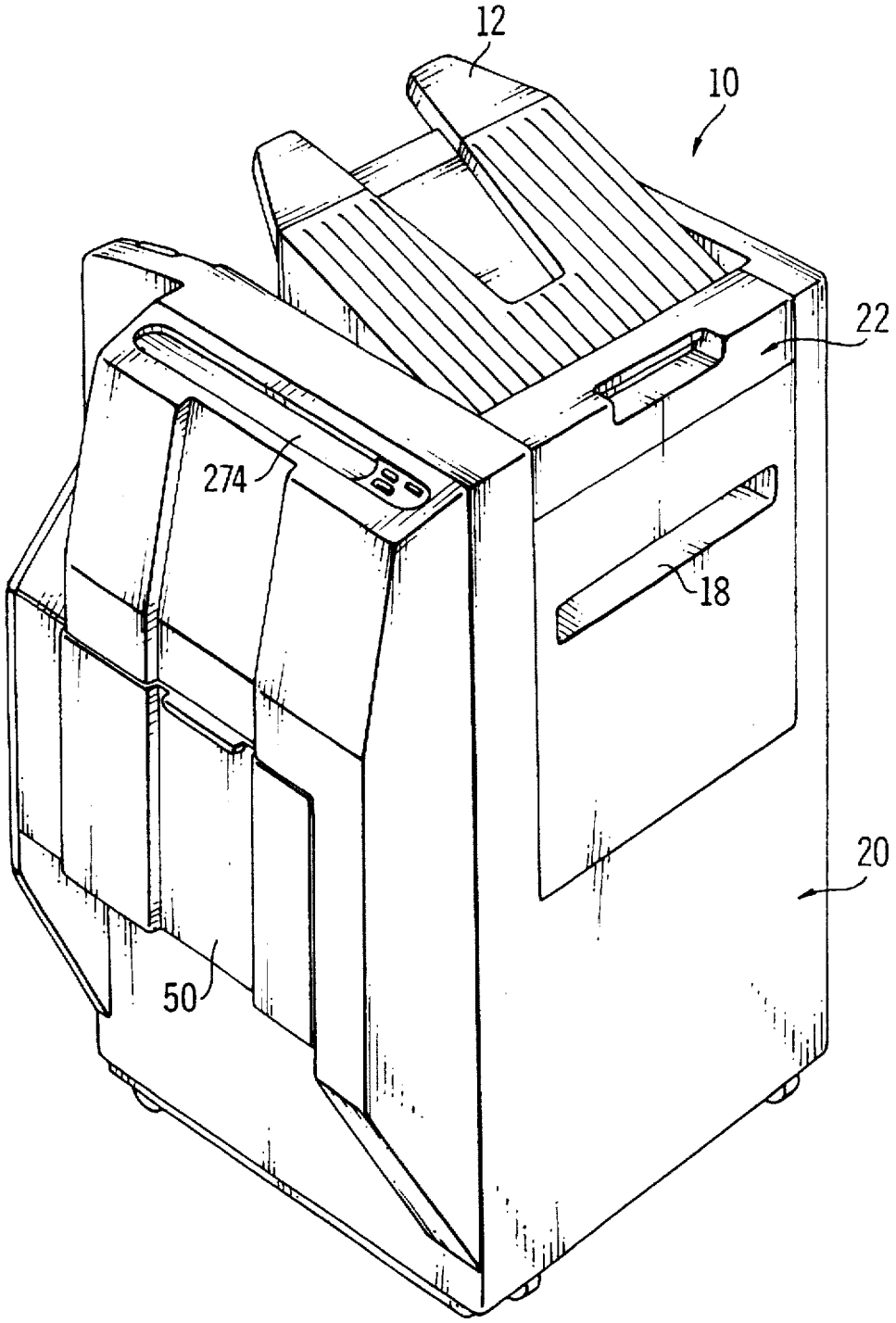
FIG. 2 is a perspective view of the sheet post-treating apparatus shown in FIG. 1, detached from the copying apparatus with a front cover closed.
Figure 3:
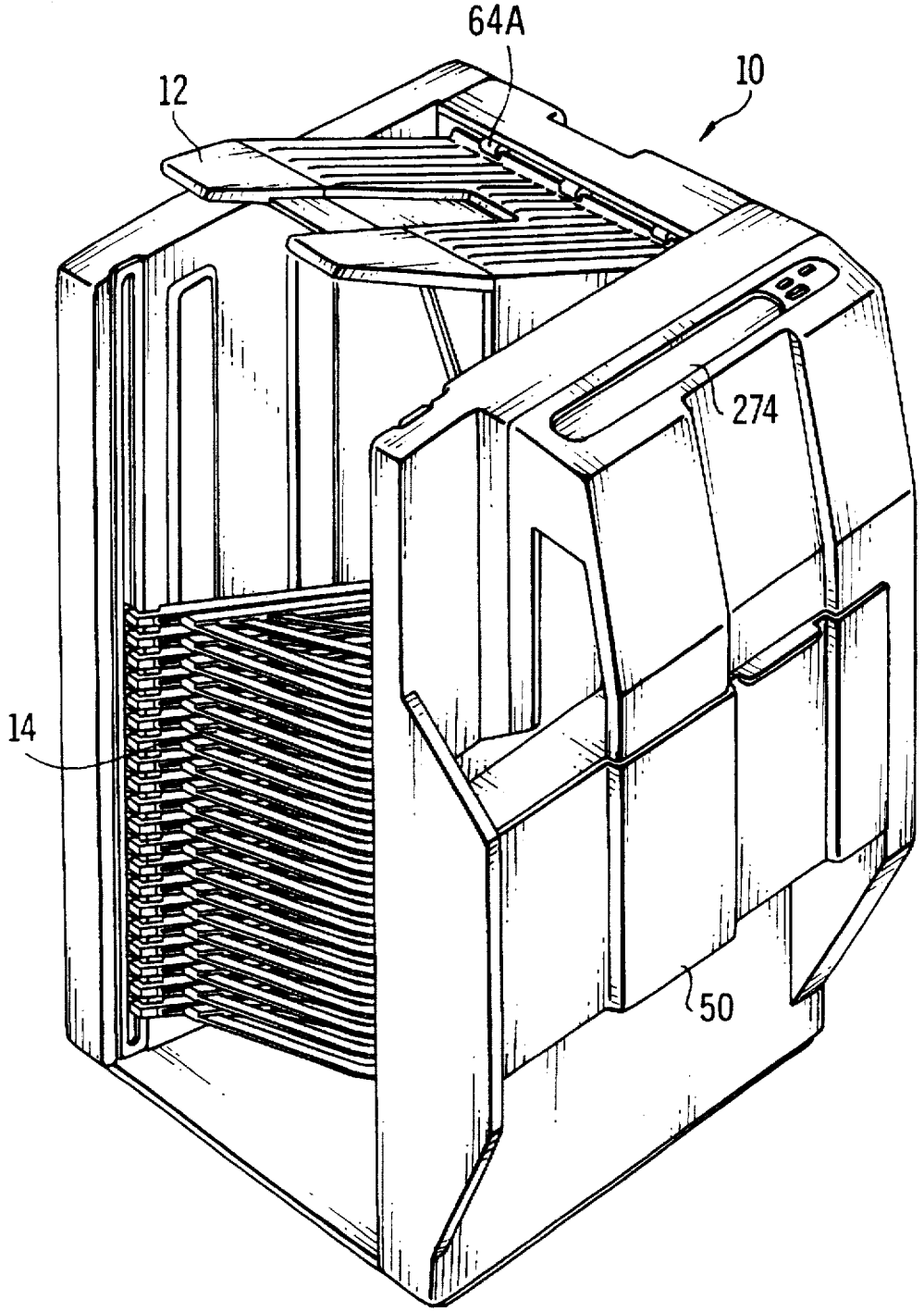
FIG. 3 is a perspective view of the sheet post-treating apparatus shown in FIG. 1, as viewed in a direction different from FIG. 2.

As shown in FIGS. 1 through 3, the sheet post-treating apparatus 10 comprises:

(A) an apparatus housing 20 having a sheet reception slot 18 (shown in FIG. 2) for receiving therein a sheet S discharged from the electrophotographic copying apparatus 1000;

(B) a sheet feed mechanism 22 (see FIG. 5) for feeding a sheet S that has been brought to the sheet reception slot 18 selectively to the non-sorting tray 12 or a sorting tray 14 that has been brought to a sheet introducing position or a sheet receiving position;

(C) a non-sorting tray 12 fixed to an upper portion of the apparatus housing 20 and having a fully exposed upper surface;

(D) a plurality of (20 in the illustrated embodiment) of sorting trays 14 (which may be referred to as sorting trays 14A through 14T if they should be described individually) vertically movably mounted in the apparatus housing 20 below the non-sorting tray 12;

(E) a sorting tray actuating mechanism 24 (see FIG. 11) for successively moving the sorting trays 14 to the sheet introducing position or a sheet removal position;

(F) an attitude changing mechanism 26 for changing the attitude of the sorting trays 14;

(G) an aligning mechanism 28 (see FIG. 7) for aligning the piles P of sheets S stacked on the sorting trays 14 in the direction (sheet sorting direction) X in which the sheets S are sorted and the direction (sheet removing direction) Y in which the sheets S are removed;

(H) a dual punch mechanism 30 (see FIG. 1) for performing the dual punching mode described above;

(I) a gripper mechanism 32 (see FIG. 1) for gripping a pile P of sheets S altogether on the sorting tray 30 which has been moved to the sheet removal position;

(J) a jogging mechanism 34 (see FIG. 19) for performing the jogging mode by moving the gripper mechanism 32 as it grips the pile P of sheets S altogether along the sheet sorting direction X in which the pile P of sheets S is placed onto a sorting tray 14' in the sheet introducing position;

(K) a gripper actuating mechanism 36 (see FIG. 19) for pulling the gripper mechanism 32 as it grips the pile P of sheets S altogether along the sheet removing direction Y across, i.e., substantially perpendicularly to, to the sheet sorting direction X toward a front side of the electrophotographic copying apparatus 1000 where a control panel 1002 is located and the operator stands to operate the electrophotographic copying apparatus 1000, and also moving the gripper mechanism 32 in an upward direction Z to remove the gripped pile P of sheets S from a sorting tray 14" in the sheet removal position and pull the gripped pile P of sheets S up to an upper lifted position in the front side of the electrophotographic copying apparatus 1000;

(L) a stacking tray 16 (see FIG. 1) disposed directly below the pile P of sheets S that has been pulled up to the lifted position by the gripper actuating mechanism 36;

(M) a stacking tray lifting and lowering mechanism 38 (see FIG. 20) for lowering the stacking tray 16 depending on the thickness of the stacked sheets on the stacking tray 16, i.e., the height of the upper surface of the pile P of sheets S stacked on the stacking tray 16;

(N) a stapling mechanism 40 (see FIG. 20) for stapling the pile P of sheets S which is being pulled up by the gripper actuating mechanism 36;

(O) a stapling mechanism moving mechanism 42 (see FIG. 20) for moving the stapling mechanism 40 between a stapling position in which the stapling mechanism 40 can staple the pile P of sheets S gripped altogether by the gripper mechanism 32 and a retracted position in which the stapling mechanism 40 is displaced out of the path of the gripper mechanism 32; and (P) a control mechanism 44 (see FIG. 32) for controlling the sheet post-treating apparatus 10 with respect to its overall operation.

The above various components of the sheet post-treating apparatus 10 will successively be described below.

(A) Apparatus Housing 20

Figure 4:
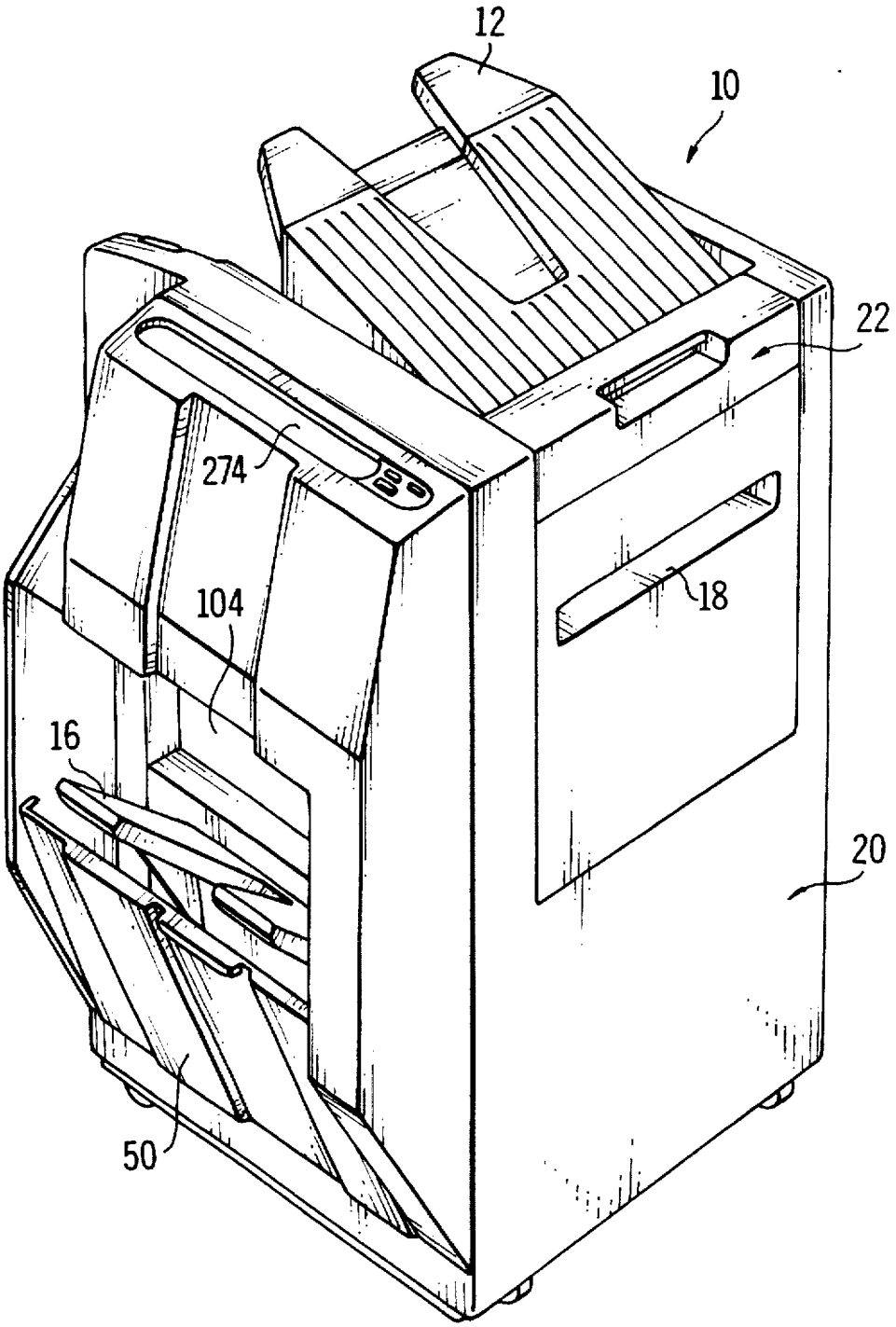
FIG. 4 is a perspective view of the sheet post-treating apparatus shown in FIG. 2, detached from the copying apparatus with the front cover closed.

The apparatus housing 20 supports the stacking tray 16 on its front wall. When not in use, the stacking tray 16 is concealed by a front cover panel 50 as shown in FIGS. 2 and 3. The front cover panel 50 is vertically movable and resiliently biased into an upper position in which it fully closes the stacking tray 16. When the front cover panel 50 is lowered against the resilient forces, its lower end is progressively displaced toward the front wall of the apparatus housing 20 until it fully opens the stacking tray 16 as shown in FIG. 4 for allowing a pile P of sheets S stacked on the stacking tray 16 to be removed therefrom.

As shown in FIG. 3, the apparatus housing 20 has an inner space in which the 20 sorting trays 14 are disposed for vertical movement. The apparatus housing 20 has a vertical opening defined in its left-hand side wall and an opening defined in its upper wall. The inner space in the apparatus housing 20 is open laterally through the vertical opening defined in the left-hand side wall and upwardly through the opening defined in the upper wall. When the sorting trays 14 are actuated by the sorting tray actuating mechanism 24, they can project upwardly from the inner space through the opening defined in the upper wall. The non-sorting tray 12 is fixed to the upper end of the apparatus housing 20 in an inclined position as shown. When the sorting trays 14 project a maximum extent upwardly from the inner space, there is a certain gap maintained between the non-sorting tray 12 and the uppermost sorting tray 14A.

(B) Sheet Feed Mechanism 22

Figure 5:
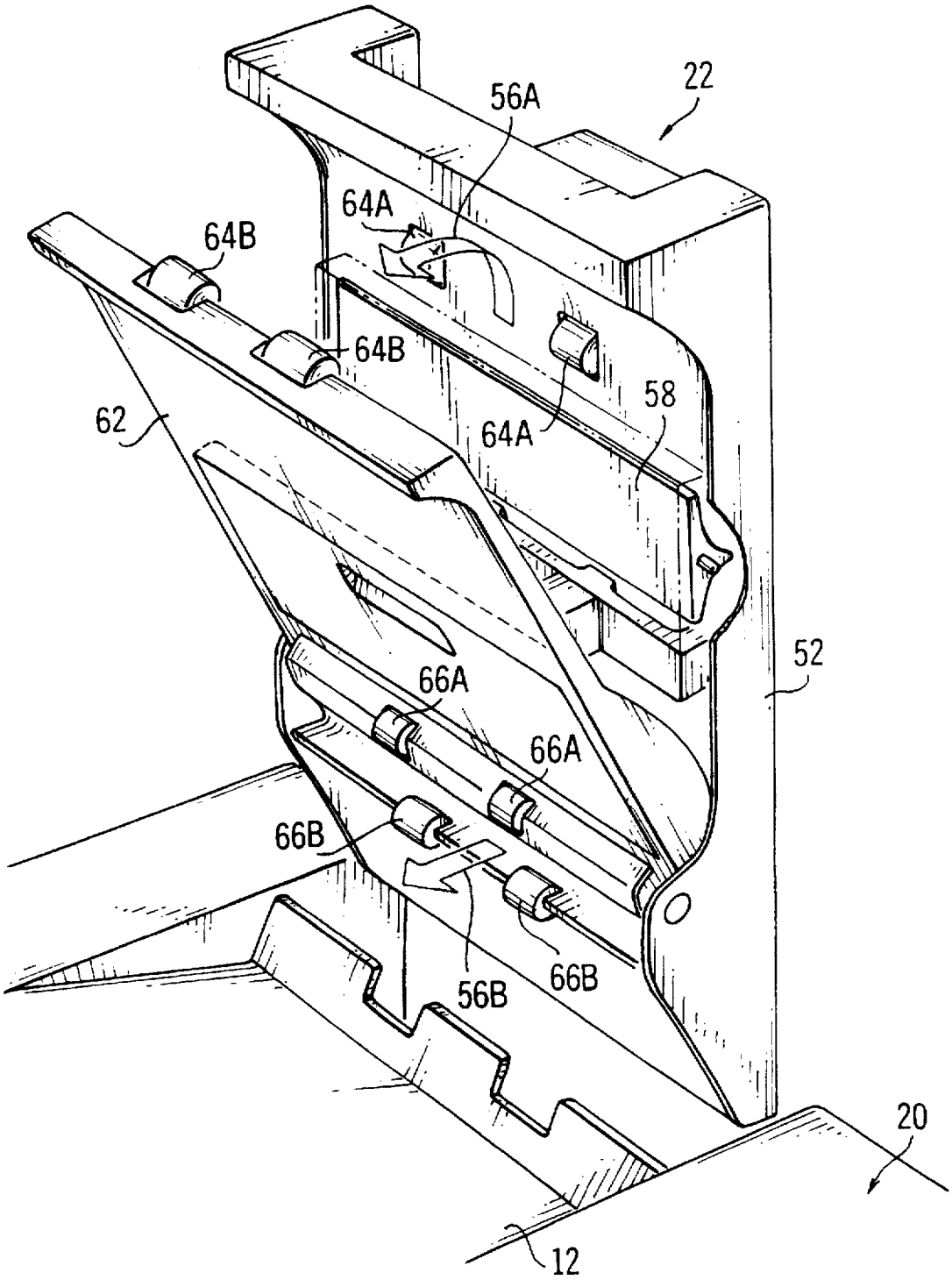
FIG. 5 is a fragmentary perspective view of a sheet feed mechanism removed upwardly from the sheet post-treating apparatus, with a support plate turned away from a main body of the sheet feed mechanism.

The sheet feed mechanism 22 is detachably mounted as a unit on an upper portion of the right-hand side wall of the apparatus housing 20, as shown in FIG. 2. As shown in FIG. 5, the sheet feed mechanism 22 can be detached from the apparatus housing 20 when it is pulled upwardly from the apparatus housing 20.

Figure 6:
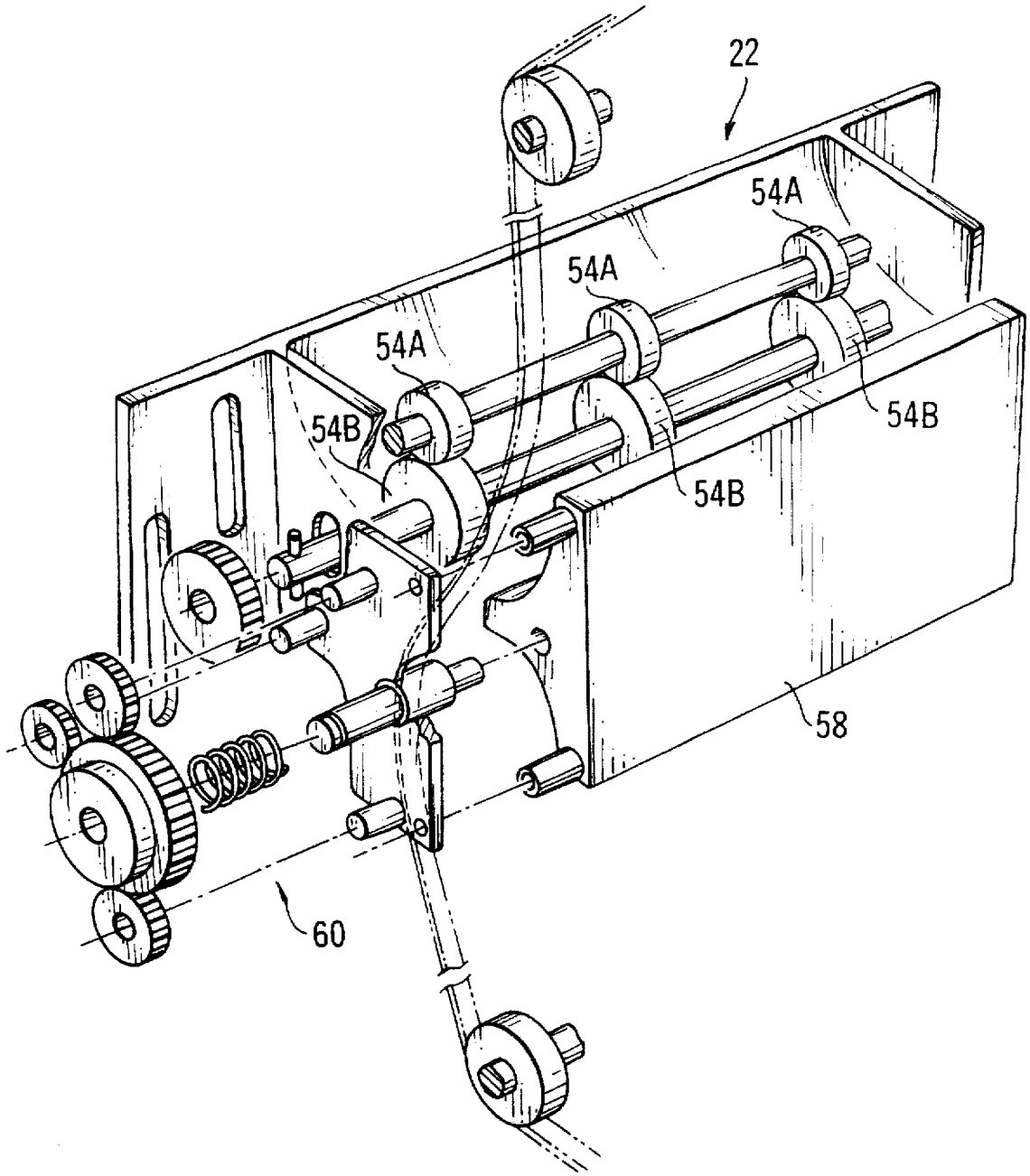
FIG. 6 is a fragmentary perspective view of a flapper swinging mechanism and related parts of the sheet feed mechanism shown in FIG. 5.

As shown in FIGS. 5 and 6, the sheet feed mechanism 22 generally comprises a unit casing 52 with the sheet reception slot 18 defined substantially centrally therein, a pair of upper and lower sets of inlet rollers 54A, 54B disposed in the unit casing 52 immediately inwardly of the sheet reception slot 18, a flapper 58 disposed swingably in the unit casing 52 immediately inwardly of the inlet rollers 54A, 54B for changing the feed path of a sheet S which has been introduced into the unit casing 52 upon rotation of the inlet rollers 54A, 54B, selectively to a non-sorting feed path 56A directed toward the upper non-sorting tray 12 or a sorting feed path 56B directed toward the sorting tray 14' in the sheet introducing position, a flapper swinging mechanism 60 for swinging the flapper 58 selectively to a non-sorting switching position to change the feed path to the non-sorting feed path 56A or a sorting switching position to change the feed path to the sorting feed path 56B, and a feed support plate 62 positioned inwardly of the unit casing 52 and supported for swinging movement about its own lower end to define the non-sorting feed path 56A and the sorting feed path 56B between itself and the unit casing 52.

The flapper swinging mechanism 60 has a drive motor (not shown) which, when energized to rotate in one direction, turns the flapper 58 counterclockwise in FIG. 6 to direct a sheet S toward the upper non-sorting feed path 56A, and, when energized to rotate in the opposite direction, turns the flapper 58 clockwise in FIG. 6 to direct a sheet S toward the lower sorting feed path 56B.

If a sheet S is jammed in the sheet feed mechanism 22, then the operator manually pulls the sheet feed mechanism 22 upwardly and turns the feed support plate 62 away from the unit casing 52, as shown in FIG. 5, thus opening the feed path to allow the operator to easily remove the jammed sheet S from the sheet feed mechanism 22. Since the sheet feed mechanism 22 is detachably mounted as a unit on the apparatus housing 20, it allows the operator to remove jammed sheets S easily and quickly from the sheet feed mechanism 22.

The detachable unitized sheet feed mechanism 22 offers other advantages. If the sheet post-treating apparatus 10 is to be used in combination with a copying apparatus having a different sheet discharge slot position, then a sheet feed mechanism 22 with its sheet reception slot 18 having a height corresponding to the sheet discharge slot position is selected from a group of sheet feed mechanisms 22 with their sheet reception slots 18 having different heights, and the selected sheet feed mechanism 22 is mounted on the sheet post-treating apparatus 10. Therefore, the replaceable sheet feed mechanism 22 makes the sheet post-treating apparatus 10 adaptable to a variety of copying apparatus. The sheet post-treating apparatus 10 can thus be manufactured for increased productivity and at reduced costs.

Figure 7:
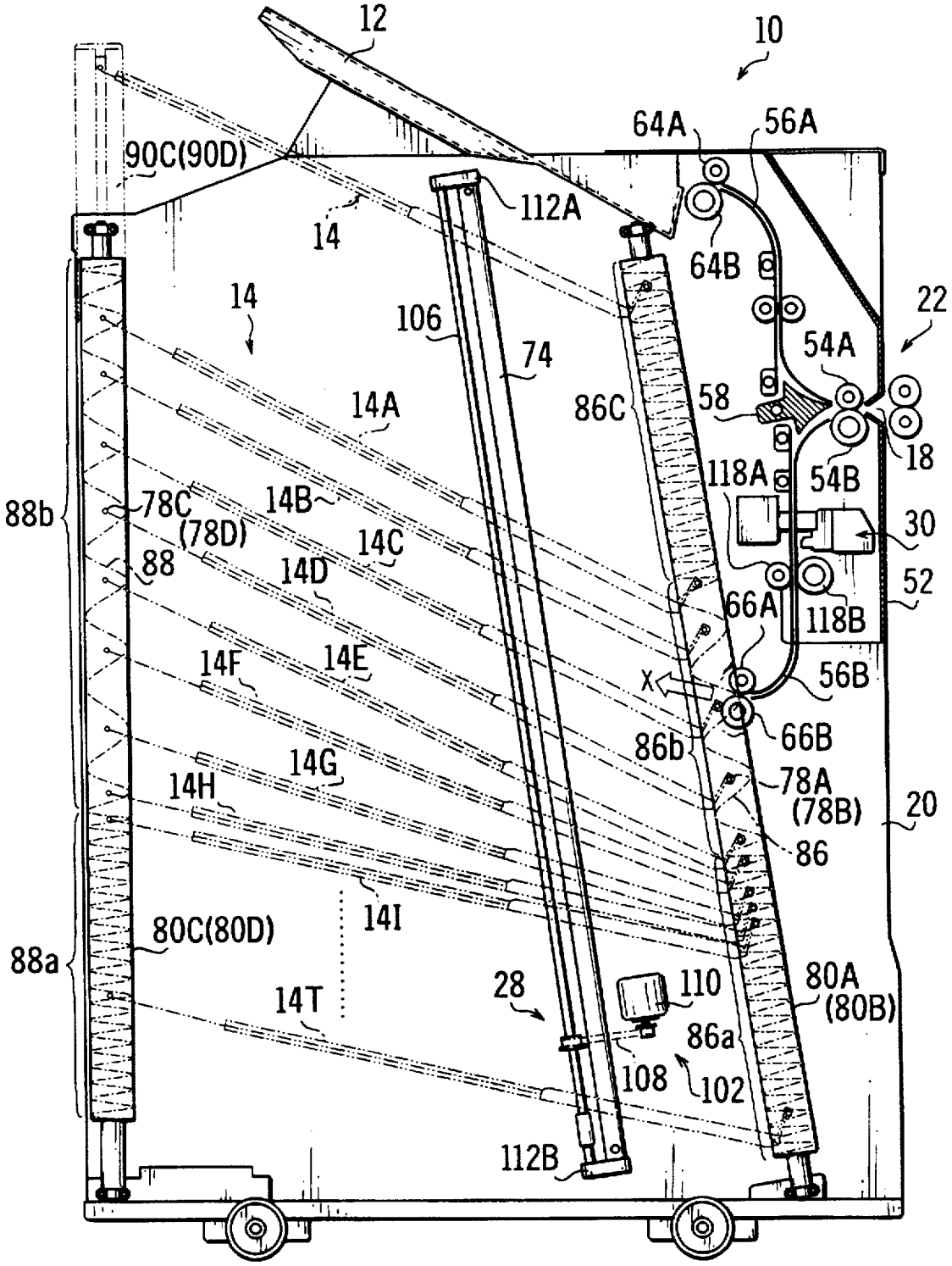
FIG. 7 is a schematic front elevational view of an inner structure of the sheet post-treating apparatus, with sorting trays in an inclined position.

As shown in FIG. 7, the dual punch mechanism 30 is positioned near the sorting feed path 56B directly below the flapper 58 for punching two holes in a sheet S that is fed along the sorting feed path 56B. Details of the dual punch mechanism 30 will be described later on.

As shown in FIGS. 5 and 7, a first pair of upper and lower sets of inlet rollers 64A, 64B held in rolling contact with each other is positioned at a terminal end of the non-sorting feed path 56A for delivering a sheet S that has been fed along the non-sorting feed path 56A onto the non-sorting tray 12 in the sheet sorting direction X, and a second pair of upper and lower sets of inlet rollers 66A, 66B held in rolling contact with each other is positioned at a terminal end of the sorting feed path 56B for delivering a sheet S that has been fed along the sorting feed path 56B onto the sorting tray 14' in the sheet introducing position in a sheet introducing direction, i.e., the sheet sorting direction X.

(C) Non-Sorting Tray 12

As described above, the non-sorting tray 12 is fixed to the upper end of the apparatus housing 20. Specifically, the non-sorting tray 12 is obliquely fixed to the upper end of the apparatus housing 20 at the outlet of the non-sorting tray 46A. The non-sorting tray 12 has a free distal end which is spaced upwardly a certain distance or height from the fixed proximal end thereof. The non-sorting tray 12 is inclined at an angle which is substantially the same as the angle at which a sorting tray 14 is inclined in the sheet introducing position, as described later on. The non-sorting tray 12 is arranged not to be subject to aligning operation of the aligning mechanism 28 (described later). Therefore, a sheet S placed onto the non-sorting tray 12 slides thereon due to gravity toward the fixed proximal end of the non-sorting tray 12 until it abuts against a rising wall on the proximal end of the non-sorting tray 12, so that the sheet S is aligned only in the sheet sorting direction X.

(D) Sorting Trays 14

Figure 8:
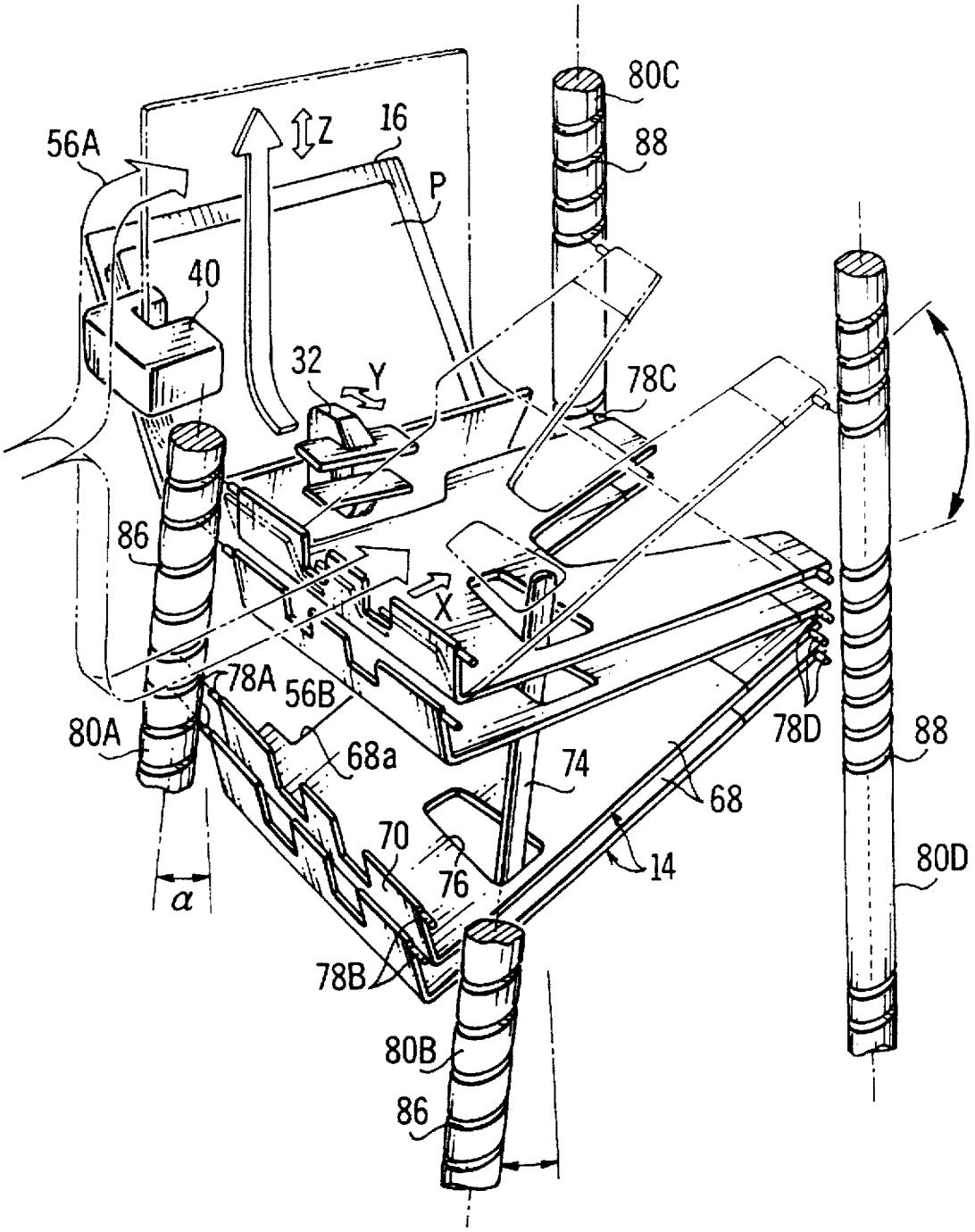
FIG. 8 is a fragmentary perspective view of the inner structure shown in FIG. 7.
Figure 9:
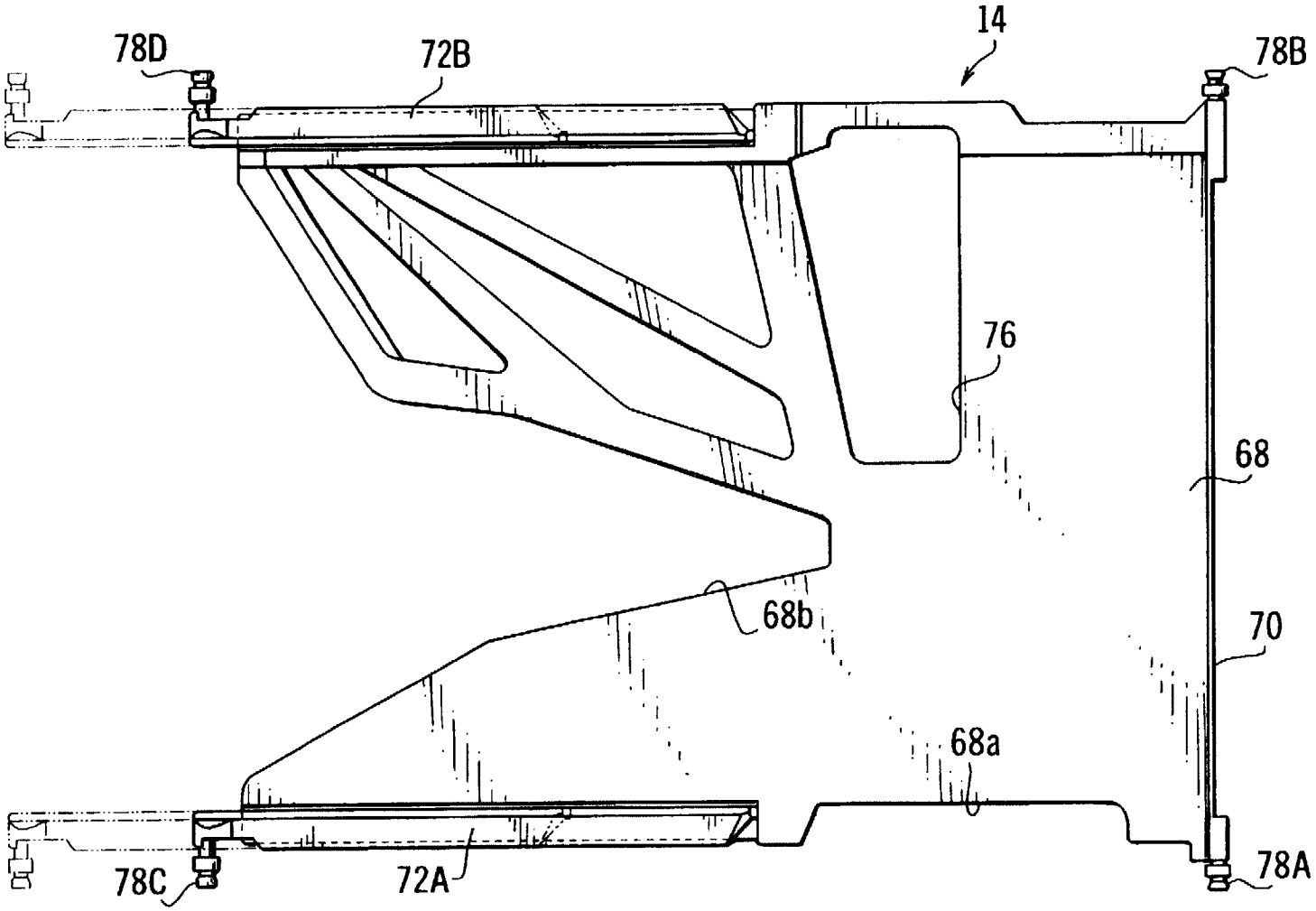
FIG. 9 is a plan of a sorting tray.
Figure 10:
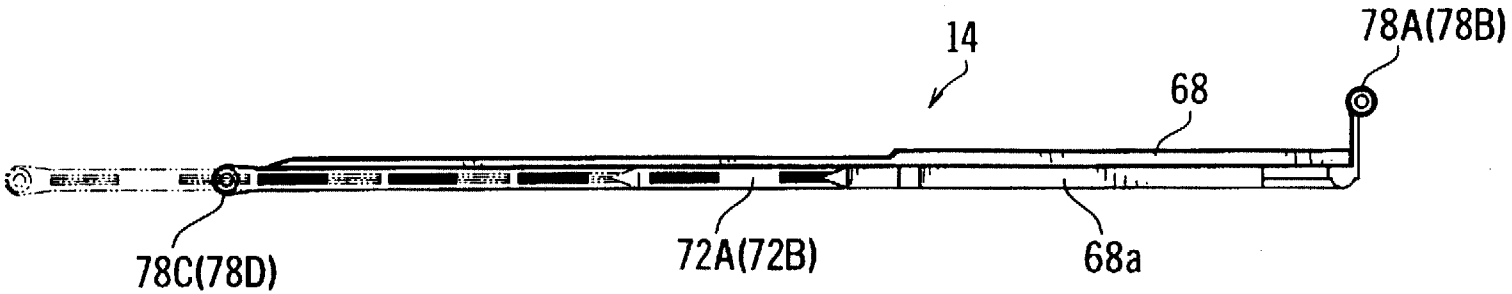
FIG. 10 is a front elevational view of the sorting tray.

As shown in FIGS. 8 through 10, each of the sorting trays 14 comprises a flat support plate 68 for stacking sheets S delivered thereonto, a rising wall 70 extending from an edge of the support plate 68 at its proximal end, i.e., from an upstream edge of the support plate 68 with respect to the sheet sorting direction X, a pair of retainers 72A, 72B attached respectively to opposite side edges of the support plate 68 near a distal end thereof, i.e., to opposite side edges of the support plate 68 in a downstream portion thereof with respect to the sheet sorting direction X, the retainers 72A, 72B being movable in the sheet sorting direction X, an opening 76 defined in the support plate 68 at a position spaced from the rising wall 70 a given distance for insertion therein of an aligning rod 74 of the aligning mechanism 28 (described later), a pair of engaging pins 78A, 78B fixed respectively to upper portions of the opposite ends of the rising wall 70 and extending outwardly in the sheet removing direction Y, and a pair of engaging pins 78C, 78D fixed respectively to distal ends of the retainers 72A, 72B and extending outwardly in the sheet removing direction Y.

As shown in FIG. 9, the support plate 68 has a first recess **68*a* defined in a downstream one of the side edges thereof with respect to the sheet removing direction Y and located at an upstream position with respect to the sheet sorting direction X, and a second recess 68*b* defined in a downstream edge of the support plate 68 with respect to the sheet sorting direction X and extending widely in a substantially central position with respect to the sheet removing direction Y. The first recess 68*a* is provided to allow the gripper mechanism 32 (described later) to grip an overhanging edge or projecting edge of a pile P of sheets S stacked on the support plate 68**.

The first recess **68*a* extends in the sheet sorting direction X to an extent which will not obstruct jogging operation of the jogging mechanism 32 (described later). The second recess 68*b* is provided to allow the operator to easily grip a pile P of sheets on the sorting tray 14 when the operator takes the pile P of sheets directly from the sorting tray 14, rather than a pile P of sheets stacked on the sorting tray 14 after it has been discharged onto the stacking tray 16**.

In terms of the functions of the sorting tray 14, the sorting tray 14 has a main body which is composed of the support plate 68 and the pair of retainers 72A, 72B. The main body of the sorting tray 14 is divided into two regions, i.e., upstream and downstream regions, with respect to the sheet sorting direction X, and is extensible and contractible in the sheet sorting direction X. Stated otherwise, the distance between the upstream pair of engaging pins 78A, 78B with respect to the sheet sorting direction X and the downstream pair of engaging pins 78C, 78D with respect to the sheet sorting direction X is variable.

All the 20 sorting trays 14 are identical in shape to each other. Therefore, the sorting trays 14 can be manufactured for increased productivity and at reduced costs. Each of the sorting trays 14 is angularly movable about the upstream pair of engaging pins 78A, 78B with respect to the sheet sorting direction X, so that the attitude or tilted state of the sorting tray 14 can be varied.

(E) Sorting Tray Actuating Mechanism 24

The sorting tray actuating mechanism 24 for successively moving the 20 sorting trays 14 to the sheet introducing position or the sheet removal position will be described below with reference to FIGS. 7 and 11 through 16.

Figure 11:
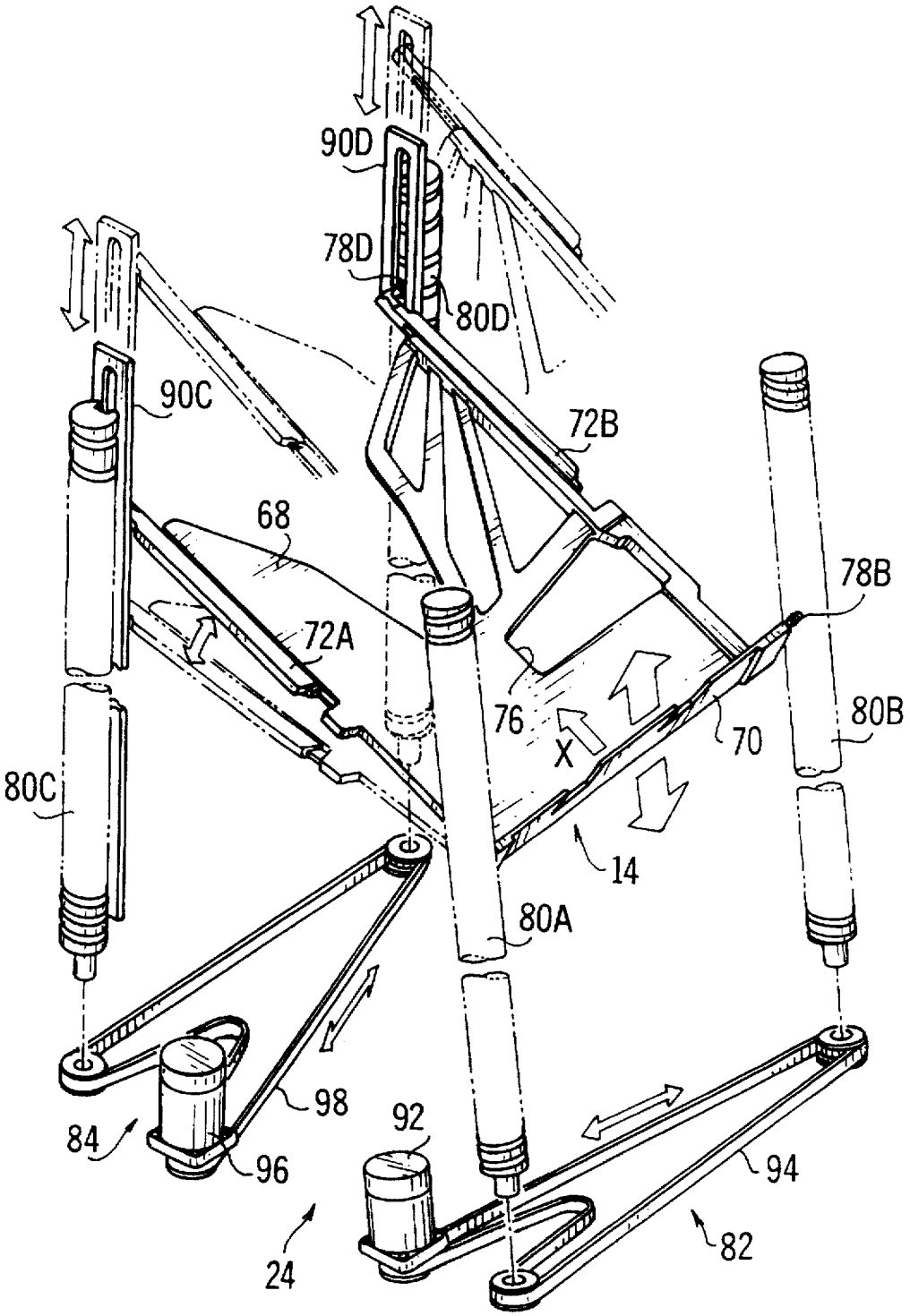
FIG. 11 is a perspective view of lead screw rods, actuator mechanisms for rotating the lead screw rods, and engaging pin guides attached respectively to two of the lead screw rods which are positioned downstream in a sheet sorting direction.
Figure 12:
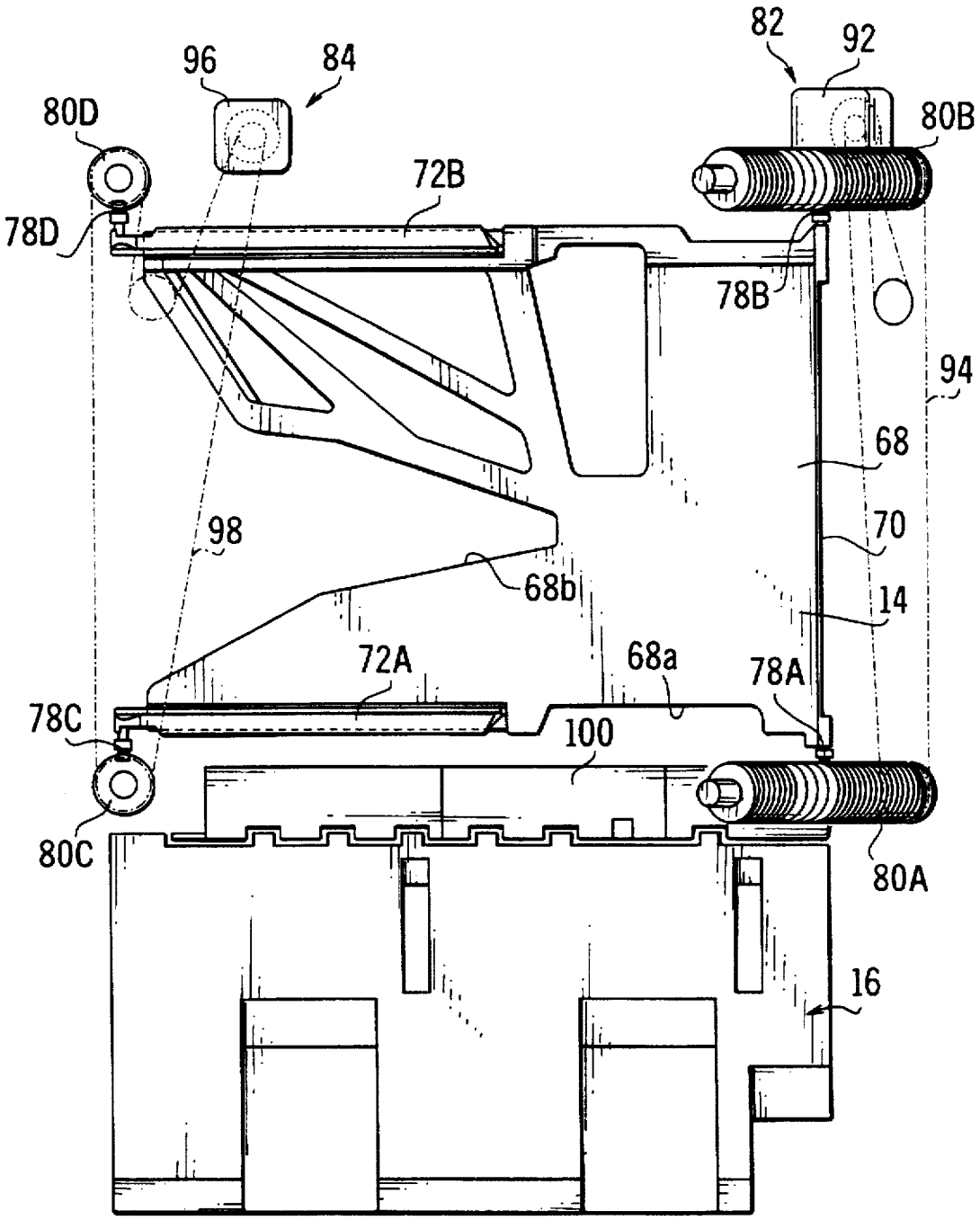
FIG. 12 is a plan view of the inner structure of the sheet post-treating apparatus.

E-1) Lead Screw Rods:

As schematically shown in FIGS. 11 and 12, the sorting tray actuating mechanism 24 has four lead screw rods 80A, 80B, 80C, 80D positioned respectively at the four corners of the sorting trays 14, a first rotating mechanism 82 for rotating the two upstream lead screw rods 80A, 80B with respect to the sheet sorting direction X in synchronism with each other, and a second rotating mechanism 84 for rotating the two downstream lead screw rods 80C, 80D with respect to the sheet sorting direction X in synchronism with each other.

The four lead screw rods 80A, 80B, 80C, 80D have respective upper ends that are positioned at substantially the same height, making it possible to reduce the height of the apparatus housing 20 which accomodates the 20 sorting trays 14 as compared with the conventional apparatus, to the extent that the height of the apparatus housing 20 is substantially the same as the height of the electrophotographic copying apparatus 1000, as shown in FIG. 1. Thus, the sheet post-treating apparatus 10 can be relatively compact in its overall arrangement, and can have its upper surface lying flush with the upper surface of the electrophotographic copying apparatus 1000 for a better appearance and layout design.

The two upstream lead screw rods 80A, 80B with respect to the sheet sorting direction X are inclined at an angle of about 9° with respect to the vertical, and the two downstream lead screw rods 80C, 80D with respect to the sheet sorting direction X extend substantially in the vertical direction. The advantages offered by the inclined lead screw rods 80A, 80B will be described later on.

E-2) Lead Grooves 86, 88

The two upstream lead screw rods 80A, 80B with respect to the sheet sorting direction X have respective lead grooves 86 defined helically in their outer circumferential surfaces and receiving the respective engaging pins 78A, 78B, and the two downstream lead screw rods 80C, 80D with respect to the sheet sorting direction X have respective lead grooves 88 defined helically in their outer circumferential surfaces and receiving the respective engaging pins 78C, 78D. The lead grooves 88 of the lead screw rods 80C, 80D are open upwardly at their upper ends such that the engaging pins 78C, 78D engaging in these lead grooves 88 can move out of the lead groves 88 through open upper ends thereof, and can be lifted upwardly.

E-3) Engaging Pin Guides 90A through 90D

Engaging pin guides 90A, 90B, 90C, 90D are disposed respectively inwardly of the lead screw rods 80A, 80B, 80C, 80D for guiding the respective engaging pins 78A, 78B, 78C, 78D to move in the longitudinal direction of the respective lead screw rods 80A, 80B, 80C, 80D. The engaging pin guides 90A, 90B, 90C, 90D have respective elongate slots defined longitudinally therein. The engaging pins 78A, 78B, 78C, 78D engage in the respective lead grooves 86, 88 of the lead screw rods 80A, 80B, 80C, 80D through the respective slots of the lead screw rods 80A, 80B, 80C, 80D.

The engaging pin guides 90A, 90B which are positioned upstream with respect to the sheet sorting direction X are omitted from illustration in FIG. 11 for the sake of brevity, but only the engaging pin guides 90C, 90D which are positioned downstream with respect to the sheet sorting direction X are illustrated in FIG. 11. The upstream engaging pin guides 90A, 90B are fixed in position, and the downstream engaging pins 90C, 90D are movable only in the longitudinal direction of the corresponding lead screw rods 80C, 80D.

Since the longitudinally movable engaging pins 90C, 90D are combined with the downstream lead screw rods 80C, 80D, when a sorting tray 14 that is kept in an inclined position is lifted and reaches the upper ends of the corresponding lead grooves 88, the sorting tray 14 is pushed upwardly by a next sorting tray 14 positioned immediately therebelow and held in abutment thereagainst, forcing its engaging pins 78C, 78D to move out of the lead grooves 88 and ascend further and push the engaging pin guides 90C, 90D upwardly while being constrained only in the sheet sorting direction X by the slots of the engaging pin guides 90C, 90D.

Consequently, even though the lead grooves 88 do not extend fully in the range in which the engaging pins 78C, 78D are movable, i.e., even though the upper ends of the downstream lead screw rods 80C, 80D are not higher than the upper ends of the upstream lead screw rods 80A, 80B, the uppermost sorting tray 14A can ascend to an uppermost position, i.e., a position in which the engaging pins 78A, 78B engage the upper ends of the upstream lead grooves 86, while the uppermost sorting tray 14A is maintaining its inclined position. This arrangement is effective to make the apparatus housing 20 compact.

E-4) Lead Grooves 86, 88 in Detail

As shown in FIG. 7, the lead grooves 86 of the lead screw rods 80A, 80B have different lead angles or lead pitches grouped into three regions **86*a*, 86*b*, 86*c* arranged successively from the lower ends to the upper ends thereof. The central region 86*b* is positioned near the second pair of upper and lower sets of inlet rollers 66A, 66B, and the lead angle or lead pitch of the central region 86*b* is greater than the lead angles or lead pitches of the other regions 86*a*, 86*c***.

The lead grooves 88 of the lead screw rods 80C, 80D have different lead angles or lead pitches grouped into lower and upper regions **88*a*, 88*b*. The lower region 88*a* has a loser end positioned at substantially the same height as the upper ends of the lower regions 86*a* of the lead grooves 86 of the lead screw rods 80A, 80B. The lead angle or lead pitch of the lower region 88*a* is substantially the same as the lead angle or lead pitch of the lower region 86*a*, and the lead angle or lead pitch of the upper region 88*b* is substantially the same as the lead angle or lead pitch of the central region 86*b***.

With the lead grooves 86, 88 thus arranged, the vertical distance between the sorting tray 14' in the sheet introducing position corresponding to the second pair of upper and lower sets of inlet rollers 66A, 66B and a sorting tray 14 positioned immediately above that sorting tray 14', and also the vertical distance between the sorting tray 14' in the sheet introducing position and a sorting tray 14 positioned immediately below that sorting tray 14' are greater than the vertical distances between the other sorting trays 14. The greater distances thus provided allow sheets to be distributed easily onto the sorting tray 14' in the sheet introducing position, and also allow the operator to easily take out a pile P of sheets S stacked on the sorting tray 14' in the sheet introducing position.

The vertical distance between the sorting tray 14' in the sheet introducing position and a sorting tray 14 positioned immediately below that sorting tray 14' is increased for the reason that a lower jaw of the gripper mechanism 32 can enter the spaces between the sorting trays 14A, 14B, 14C that are located in the position corresponding to the second pair of upper and lower sets of inlet rollers 66A, 66B and upper and lower positions adjacent to that position. In this embodiment, before sorting trays 14A, 14B, 14C that are located in the sheet introducing position and the positions above and below the sheet introducing position are spread away from each other, the vertical distance between the sorting tray 14C and a sorting tray 14D positioned immediately below the sorting tray 14C is increased to permit the sorting tray 14D to follow the tray spreading operation smoothly.

E-5) Inclination of Upstream Lead Screw Rods 80A, 80B

Figure 13:
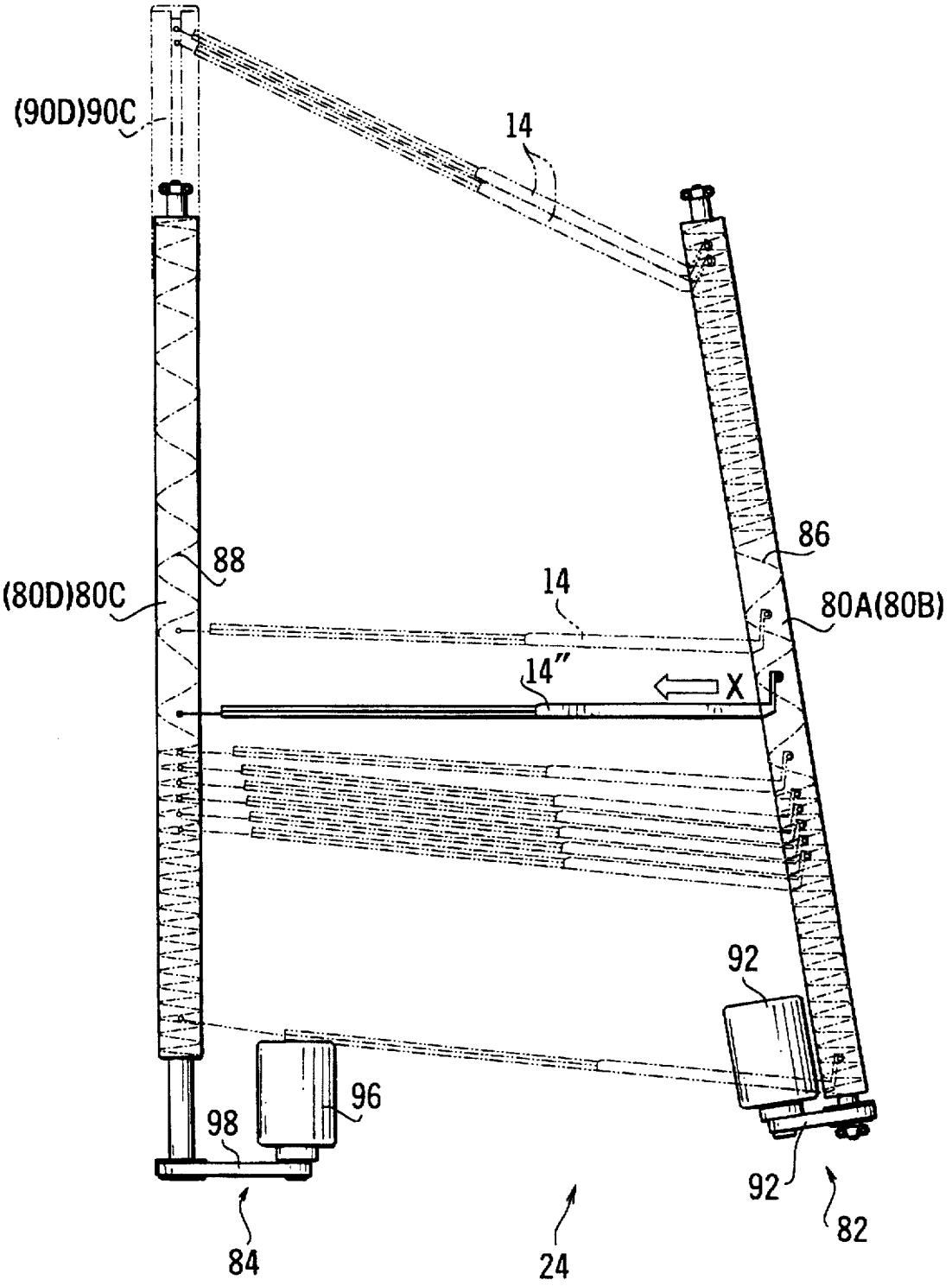
FIG. 13 is a front elevational view of the lead screw rods.
Figure 14:
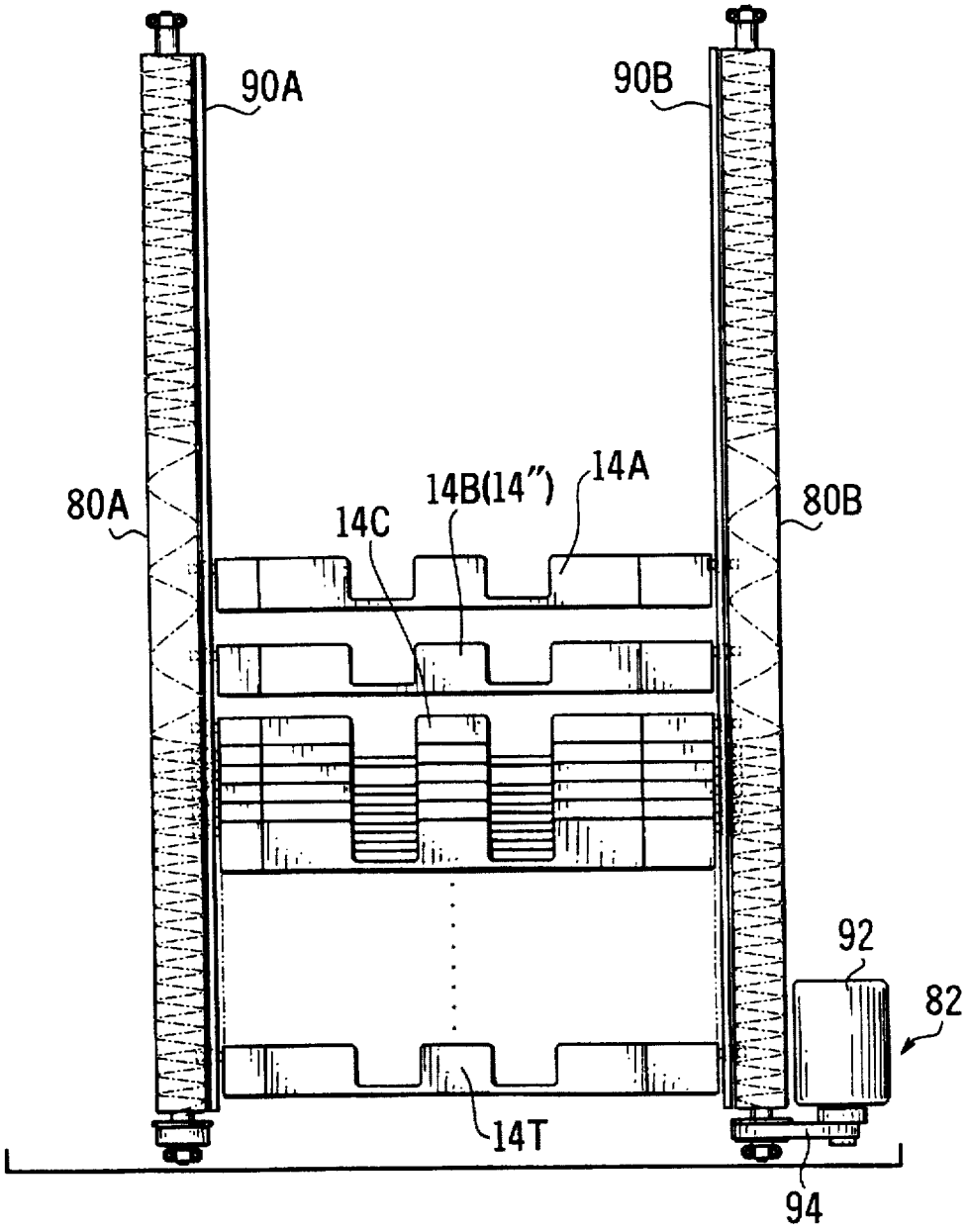
FIG. 14 is a right-hand side elevational view of the lead screw rods.

In order to avoid a bulky stacked condition of the sorting trays 14, the lead screw rods 80A, 80B that are positioned upstream with respect to the sheet sorting direction X have their longitudinal axes inclined toward the downstream lead screw rods 80C, 80D by an angle $\alpha$ (see FIG. 8) of about 9° from the vertical, as shown in FIGS. 12 and 13. When viewed in side elevation as shown in FIG. 14, the lead screw rods 80A, 80B extend vertically parallel to each other.

The engaging pins 78A, 78B, 78C, 78D of the sorting trays 14 engage in the respective lead grooves 86, 88. Therefore, those of the sorting trays 14 which are positioned higher on the upstream lead screw rods 80A, 80B have their free distal ends displaced greater in the sheet sorting direction X toward the downstream lead screw rods 80C, 80D.

However, the displacement of those sorting trays 14 is easily taken up by their ability to extend and contract by themselves, and will not adversely affect their vertical movement.

Inasmuch as the upstream lead screw rods 80A, 80B are inclined about 9° downstream from the vertical in the sheet sorting direction X, the sorting trays 14 are placed in such a compact stack that an upper sorting tray is positioned inwardly of a lower sorting tray, making the apparatus occupy a small vertical space. Specifically, of two vertically adjacent sorting trays 14, the rising wall 70 of the upper sorting tray 14 is positioned obliquely in front of the rising wall 70 of the lower sorting tray 14. Therefore, the vertical distance between the support plates 68 of these vertically adjacent sorting trays 14 can be made very small.

If the upstream lead screw rods 80A, 80B extended vertically, then the rising walls 70 of two vertically adjacent sorting trays 14 would conflict with each other because the sorting trays 14 would be lifted and lowered while changing their angles. According to the present invention, however, since the path of movement of the sorting trays 14 is inclined about 9° from the vertical, the above problem is solved. Specifically, the angle $\alpha$ of about 9° of the upstream lead screw rods 80A, 80B is selected such that the vertical surfaces of the rising walls 70 of two vertically adjacent sorting trays 14 will not be brought into contact with each other when the angle $\theta$ of the sorting trays 14 changes, and also that the apparatus is compact in its entirety.

E-6) First and Second Rotating Mechanisms 82, 84

The first rotating mechanism 82 comprises a first reversible drive motor 92 and a first endless transmission belt 94 for transmitting drive forces of the first reversible drive motor 92 simultaneously to the upstream lead screw rods 80A, 80B. The second rotating mechanism 84 comprises a second reversible drive motor 96 and a second endless transmission belt 98 for transmitting drive forces of the second reversible drive motor 96 simultaneously to the downstream lead screw rods 80C, 80D. The first and second drive motors 92, 96 are independently controlled by the control mechanism 44 which will be described later on.

E-7) Actuation of the Sorting Trays 14

The actuation of the sorting trays 14 by the sorting tray actuating mechanism 24 will be described below.

When the first and second rotating mechanisms 82, 84 are simultaneously operated, all the four lead screw rods 80A, 80B, 80C, 80D are rotated about their own axes. Upon rotation of the lead screw rods 80A, 80B, 80C, 80D, the portions of the lead grooves 86, 88 in which the engaging pins **78*a*, 78B, 87C, 78D of the sorting trays 14 are progressively varied in height, so that all the sorting trays 14 are simultaneously moved vertically while keeping their attitude. For example, those sorting trays 14 which are indicated by 14B, 14C, 14D in FIG. 7 are lifted up to the positions indicated by 14A, 14B, 14C, respectively, upon one revolution of the lead screw rods 80A, 80B, 80C, 80D in the direction indicated by the arrow A (counterclockwise), and lowered upon one revolution of the lead screw rods 80A, 80B, 80C, 80D** in the direction (clockwise) opposite to the direction indicated by the arrow A.

When only the first rotating mechanism 82 is operated, only the upstream lead screw rods 80A, 80B are rotated about their own axes to lift or lower only the proximal ends of the sorting trays 14. Conversely, when only the second rotating mechanism 84 is operated, only the downstream lead screw rods 80C, 80D are rotated about their own axes to lift or lower only the distal ends of the sorting trays 14.

(F) Attitude Changing Mechanism 26

As described above with respect to the sorting tray actuating mechanism 24, the upstream pair of lead screw rods 80A, 80B and the downstream pair of lead screw rods 80C, 80D can be rotated independently of each other for varying the relative height or vertical positions of the proximal ends of the sorting trays 14, i.e., the upstream ends of the sorting trays 14 with respect to the sheet sorting direction X, and the relative height or vertical positions of the distal ends of the sorting trays 14, i.e., the downstream ends of the sorting trays 14 with respect to the sheet sorting direction X. As a result, the attitude of the sorting trays 14 can be changed as desired. The attitude changing mechanism 26 is composed of a structure by which the upstream pair of lead screw rods 80A, 80B and the downstream pair of lead screw rods 80C, 80D are independently rotated.

The control mechanism 44 serves to control the operation to change the attitude of the sorting trays 14. For changing the inclined attitude of the sorting trays 14 to the horizontal attitude, the control mechanism 44 independently actuates the first and second rotating mechanisms 82, 84 in order to lower the distal ends of the sorting trays 14 relatively to the proximal ends of the sorting trays 14. At this time, the control mechanism 44 may inactivate the first rotating mechanism 82 and actuate the second rotating mechanism 84 to rotate the corresponding lead screw rods 80C, 80D to lower the distal ends of the sorting trays 14, or the control mechanism 44 may actuate both the first and second rotating mechanisms 82, 84 such that the distal ends of the sorting trays 14 will be lowered a distance greater than the distance by which the proximal ends of the sorting trays 14 are lowered.

For changing the attitude of the sorting trays 14 from the inclined attitude shown in FIG. 7 to the horizontal attitude shown in FIG. 13 in this embodiment, the control mechanism 44 actuates the first rotating mechanism 82 to rotate the upstream lead screw rods 80A, 80B a half (0.5) revolution in a direction to lower the proximal ends of the sorting trays 14, and also actuates the second rotating mechanism 84 to rotate the downstream lead screw rods 80C, 80D five and a half (5.5) revolutions in a direction to lower the distal ends of the sorting trays 14.

For changing the attitude of the sorting trays 14 from the horizontal attitude to the inclined attitude in which the distal ends of the sorting trays 14 are spaced upwardly from the proximal ends thereof, the control mechanism 44 controls the first and second rotating mechanisms 82, 84 in a reversed manner opposite to the ranging of the attitude from the inclined attitude to the horizontal attitude.

When the sheet post-treating apparatus 10 is in a sheet introducing mode for introducing sheets S fed by the sheet feed mechanism 22 onto sorting trays 14, those sorting trays 14 which include the sorting tray 14' in the sheet introducing position and sorting trays 14 positioned higher than the sorting tray 14' are brought into an inclined attitude at a given angle of about 30 degrees as indicated by the broken lines in FIG. 7. When the sheet post-treating apparatus 10 is in a sheet removing mode for removing a pile P of sheets S from a sorting tray 14, at least the sorting tray 14" located in the sheet removal position is changed to a substantially horizontal attitude as indicated by the solid lines in FIG. 13.

(G) Aligning Mechanism 28

For aligning sheets S in a predetermined position on the sorting trays 14, the aligning mechanism 28 includes a first aligning mechanism 28A for aligning sheets S in the sheet sorting direction X on the sorting trays 14, and a second aligning mechanism 28B for aligning sheets S in the sheet removing direction Y which is perpendicular to the sheet sorting direction X.

G-1) First Aligning Mechanism 28A

The upper region **88*b*, whose lead angle or lead pitch of the lead groove 88 of each of the downstream lead screw rods 80C, 80D is larger than the lower region 88*a*, has an upper end positioned higher than the upper end of the central region 86*b***, whose lead angle or lead pitch of the lead groove 86 of each of the upstream lead screw rods 80A, 80B is larger than the other regions 86*a*, 86*c*. Therefore, those sorting trays 14 which are positioned higher than at least the sheet introducing position are inclined such that their distal ends, i.e., their downstream ends with respect to the sheet sorting direction X, are higher than their proximal ends, i.e., their upstream ends with respect to the sheet sorting direction X.

Consequently, a sheet S fed through the second pair of upper and lower sets of inlet rollers 66A, 66B is delivered onto the inclined sorting tray 14 in the sheet introducing position. The sorting tray 14 is inclined at the angle θ of 30° in the illustrated embodiment. However, the sorting tray 14 may be inclined at an angle which allows a sheet S placed thereon to slide due to gravity. For example, the sorting tray 14 may be inclined at an angle ranging from 20° to 45°.

Upon rotation of the second pair of upper and lower sets of inlet rollers 66A, 66B, a sheet S is fed onto the inclined sorting tray 14 in the sheet introducing position in the sheet sorting direction X. When the sheet S drops onto the sorting tray 14' in the sheet introducing position, the trailing end of the sheet S, i.e., the upstream end of the sheet S with respect to the sheet sorting direction X, is displaced downstream off the rising wall 70 in the sheet sorting direction X because of the inertia of the sheet S. After the sheet S has been placed on the sorting tray 14' in the sheet introducing position, the sheet S slides back in a direction opposite to the sheet sorting direction X due to the inclination of the sorting tray 14 until it stops in abutment against the rising wall 70. Accordingly, the sheet S is aligned by the rising wall 70 when the trailing end of the sheet S abuts against the rising wall 70. The inner surface of the rising wall 70 of the sorting tray 14 thus functions as an aligning surface for aligning the sheet S in the sheet sorting direction X.

Therefore, the inclined state of the sorting tray 14 and the rising wall 70 thereof make up the first sheet aligning mechanism 28A for aligning sheets S in the sheet sorting direction X. The rising wall 70 also functions to prevent sheets S on the sorting tray 14 from sliding off the sorting tray 14.

G-2) Second Aligning Mechanism 28B

The second aligning mechanism 28B comprises an aligning rod 74 vertically extending through the openings 76 defined in the respective support plates 68 of the sorting trays 14, a front shield plate 100 (see FIGS. 15 and 16) disposed vertically at a front side or downstream side of the sorting trays 14 in the sheet removing direction Y, and an aligning rod actuating mechanism 102 for moving the aligning rod 74 in one reciprocating cycle in the sheet removing direction Y perpendicular to the sheet sorting direction X. The second aligning mechanism 28B operates by swinging the aligning rod 74 forwardly in the sheet removing direction Y to press sheets S or piles P of sheets S on the sorting tray 14 against the front shield plate 100. The piles P of sheets S on the sorting tray 14 are now aligned in the sheet removing direction Y by the front shield plate 100 against which the front or downstream ends of the piles P of sheets S with respect to the sheet removing direction Y are held in abutment. In this embodiment, the front shield plate 100 functions as an aligning surface for aligning a pile P of sheets S in the sheet removing direction Y.

The aligning rod actuating mechanism 102 of the aligning mechanism 28 is controlled by the control mechanism 44. The control mechanism 44 is arranged to operate the aligning rod actuating mechanism 102 only when sheets S are introduced onto a sorting tray 14, and arranged not to operate the aligning rod actuating mechanism 102 when sheets S are removed from a sorting tray 14. Stated otherwise, only when a sorting tray 14 is inclined, the control mechanism 44 operates the aligning rod actuating mechanism 102 to align a pile P of sheets S on the sorting tray 14 in the sheet removing direction Y. When a sorting tray 14 is horizontal, the control mechanism 44 does not operate the aligning rod actuating mechanism 102, keeping a pile P of sheets S on the sorting tray 14.

As described above, a pile P of sheets S on a sorting tray 14 is not aligned when the sorting tray 14 is horizontal. When a sorting tray 14 has already been inclined, a pile P of sheets S on the sorting tray 14 has been aligned in both the sheet sorting direction X and the sheet removing direction Y. As the sheet post-treating apparatus 10 changes its mode from the sheet introducing mode to the sheet removing mode, the attitude of a sorting tray 14 is changed from inclined attitude to the horizontal attitude by the attitude changing mechanism 26. The pile P of sheets S on the sorting tray 14 that has been brought into the horizontal attitude remains aligned on the horizontal sorting tray 14.

G-3) Removal Opening 104

As described above, the front shield plate 100 is disposed vertically at the front side or downstream side of the sorting trays 14 in the sheet removing direction Y. To allow a pile P of sheets S to be removed from the sorting tray 14" in the sheet removal position, the front shield plate 100 has a removal opening 104 (FIGS. 15 and 16) defined therein and extending substantially horizontally in substantial alignment with the sorting tray 14" in the removing position. The removal opening 104 permits the gripper mechanism 32 to grip the pile P of sheets S stacked on the sorting tray 14" in the sheet removal position, and also permits the gripper mechanism 32 that has gripped the pile P of sheets S altogether to move in the sheet removing direction Y.

Figure 16:
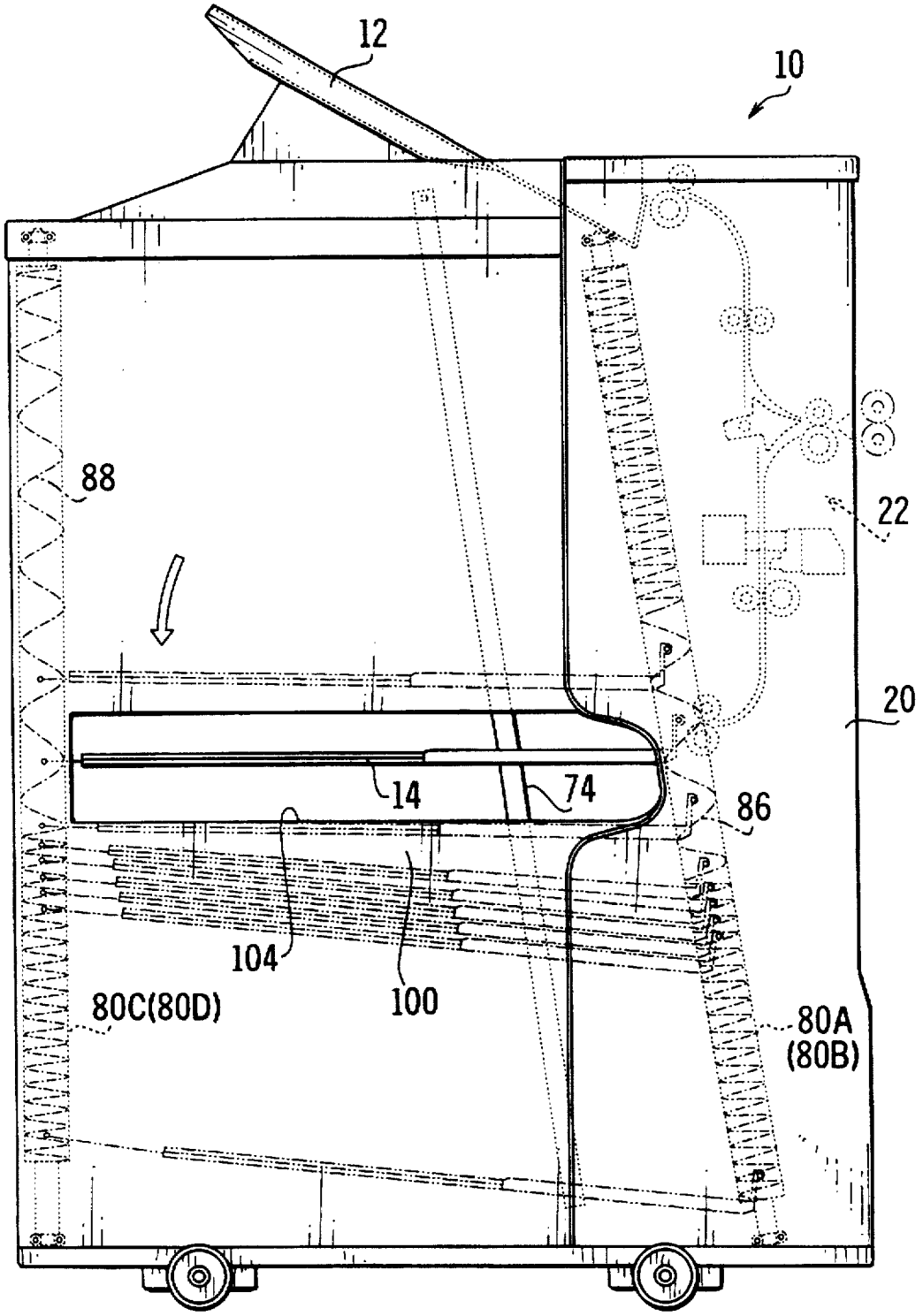
FIG. 16 is a front elevational view showing one of the sorting trays which is angularly displaced to a horizontal position.

The removal opening 104 has a size selected such that, as shown in FIG. 16, its width in the sheet sorting direction X extends substantially the full length of a sorting tray 14 in the sheet sorting direction X, exposing the sorting tray 14, and its height in the upward direction Z is defined between an upper edge thereof that is positioned directly below a sorting tray 14 immediately above the sorting tray 14" in the sheet removal position and a lower edge thereof that is positioned directly above a sorting tray 14 immediately below the sorting tray 14" in the sheet removal position. The pile P of sheets S on the sorting tray 14" in the sheet removal position is removed from the sorting tray 14" in the sheet removing direction Y through the removal opening 104 by the gripper mechanism 32. At this time, piles P of sheets S are prevented from dropping through the removal opening 104 from the upper and lower sorting trays 14 that are positioned adjacent to the sorting tray 14" in the sheet removal position.

Figure 15:
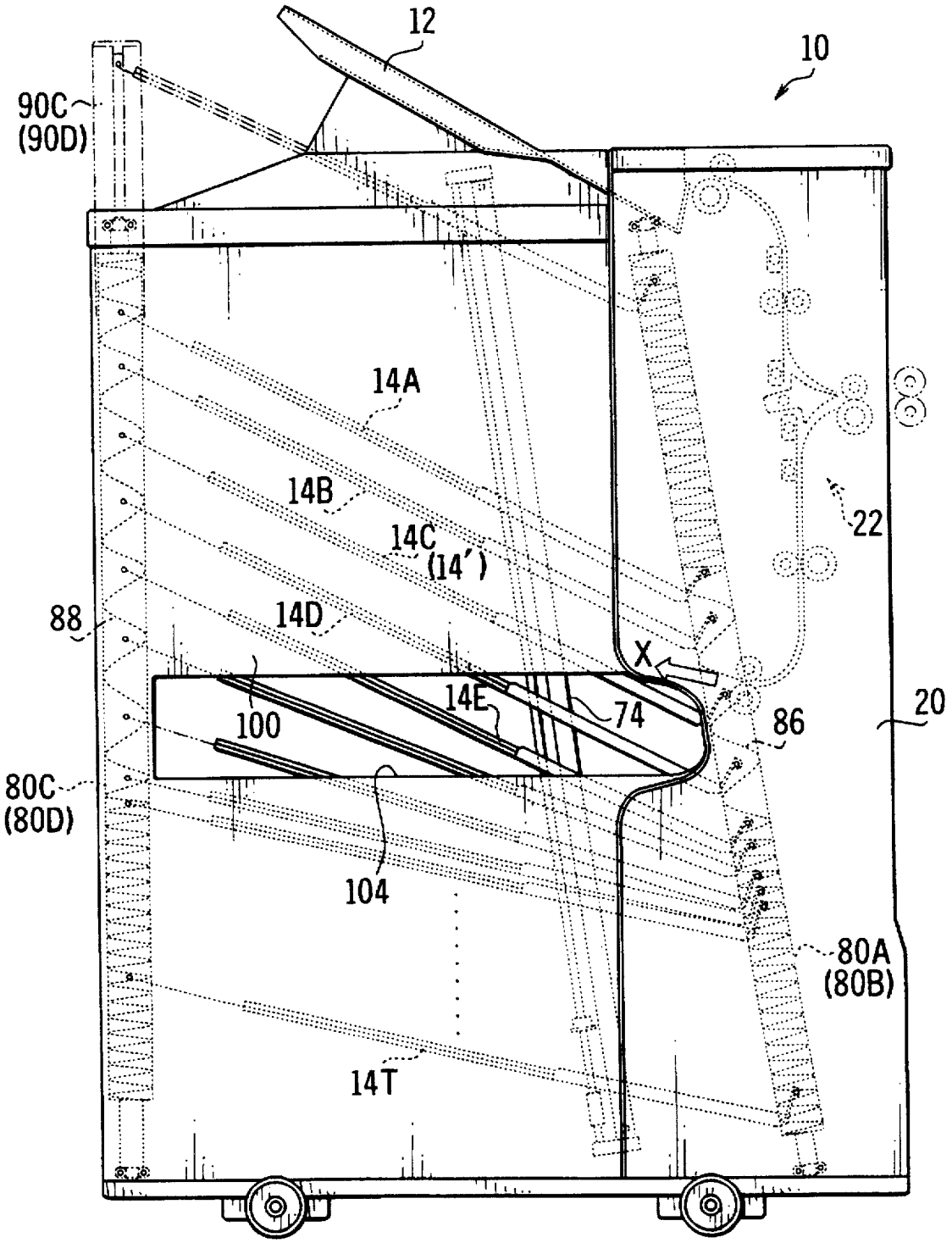
FIG. 15 is a front elevational view showing the relationship between the sorting trays in an inclined position and an outlet opening.

The removal opening 104 is also sized such that piles P of sheets on sorting trays which are inclined across the removal opening 104 will be aligned in the sheet removing direction Y. Specifically, as shown in FIG. 15, the removal opening 104 is of such a size that when sheets S or piles P of sheets S of minimum size are received or stacked on sorting trays 14 extending obliquely across the removal opening 104, upstream and downstream ends of the sheets S of minimum size with respect to the sheet sorting direction X remain in a position capable of abutment against the front shield plate 100 at peripheral edges defining the removal opening 104.

Since the removal opening 104 is thus positioned and sized, the front shield plate 100 with the removal opening 104 defined therein reliably provides an aligning surface for aligning piles P of sheets S on all the sorting trays 14. Stated otherwise, the aligning mechanism does not require any aligning shutter mechanism which would otherwise be necessary to openably close the removal opening, and hence is simplified in structure, is controlled in a simplified manner, and is manufactured at reduced costs.

G-4) Aligning Rod Actuating Mechanism 102

The aligning rod actuating mechanism 102 comprises a rotatable shaft 106 extending vertically parallel to the aligning rod 74, a swinging motor 110 for reversibly rotating the aligning rod 74 about its own axis through an endless belt 108, and a pair of upper and lower connecting arms 112A, 112B of given length which connect the upper and lower ends of the rotatable shaft 106 and the aligning rod 74. The aligning rod 74 is in its standby position when it is swung to a position spaced the greatest distance from the front shield plate 100 by the aligning rod actuating mechanism 102. The standby position for the aligning rod 74 is selected such that when sheets S of maximum size that can be used in the sheet post-treating apparatus 10 are received on the sorting trays 14, the aligning rod 74 in the standby position is positioned upstream with respect to the sheet removing direction Y of upstream edges of the sheets S of maximum size. A standby position sensor 116 (see FIG. 32) is connected to the control mechanism 44 for detecting when the aligning rod 74 is swung to the standby position.

When controlled by the control mechanism 4, the aligning rod actuating mechanism 102 swings the aligning rod 74 from the standby position to a position that is spaced upstream from the front shield plate 100 with respect to the sheet removing direction Y by a distance corresponding in the sheet removing direction Y to the length of the sheets S on the sorting trays 14 which the aligning rod 74 is about to align. The size information of the sheets S is contained in various pieces of control information transmitted from a control mechanism (not shown) in the electrophotographic copying apparatus 1000 to the control mechanism 44. Based on the transmitted information, the control mechanism 44 calculates a distance by which the aligning rod actuating mechanism 102 swings the aligning rod 74.

Conventional sheet aligning mechanisms have needed two mechanisms for swinging upper and lower aligning rods in a horizontal plane to align sheets in their longitudinal direction, i.e., the sheet sorting direction X and in their transverse direction, i.e., the sheet removing direction Y. According to this embodiment, an aligning rod for aligning sheets in their longitudinal direction and a mechanism for swinging such an aligning rod are not required, and hence each of the sorting trays 14 is not required to have an opening or recess for insertion therethrough of an aligning rod for aligning sheets in their longitudinal direction. Therefore, the first aligning mechanism 28A composed of the inclined state of the sorting trays 14 and the rising walls 70 thereof is much simpler in structure and lower in cost than the conventional arrangement which has two aligning rods for aligning sheets S in their longitudinal and transverse directions. In the first aligning mechanism 28A, the entire surface of each of the sorting trays 14 may not be inclined, but only a portion thereof may be bent to cause a sheet S to slide toward the rising wall 70.

(H) Dual Punch Mechanism 30

As shown in FIGS. 1 and 7, a sheet S discharged from the electrophotographic copying apparatus 1000 is led into the sheet feed mechanism 22 by the inlet rollers 54A, 54B. If the flapper 58 is turned to the sorting switching position, then the feed path is changed to the sorting feed path 56B by the flapper 58. While the sheet S is being fed through the sorting feed path 56B (which has a length L), it is punched by the dual punch mechanism 30, and then delivered onto a sorting tray 14 in the sheet sorting direction X.

Between the dual punch mechanism 30 and the inlet rollers 66A, 66B, there is disposed a pair of feed rollers 118A, 118B held in rolling contact with each other across the sorting feed path 56B. The feed rollers 118A, 118B double as resistance rollers. Specifically, when the leading end of a sheet S is engaged by the contacting portions of the feed rollers 118A, 118B which are not rotating but in a standby condition, the sheet S is corrected in its orientation. While the feed rollers 118A, 118B are in the standby condition, the sheet S is punched by the dual punch mechanism 30. The time required to feed the sheet S along the sorting feed path 56B is not substantially increased in order for the dual punch mechanism 30 to effect its punching operation.

Figure 17:
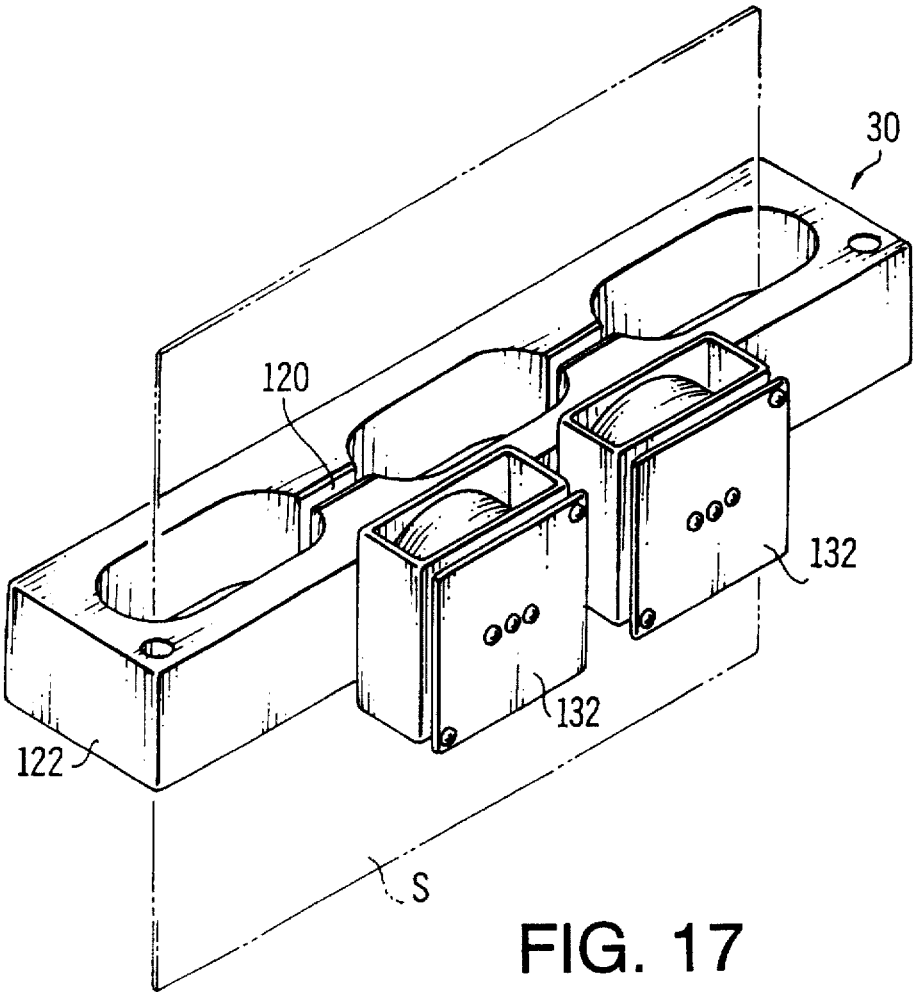
FIG. 17 is a perspective view of a dual punch mechanism.
Figure 18:
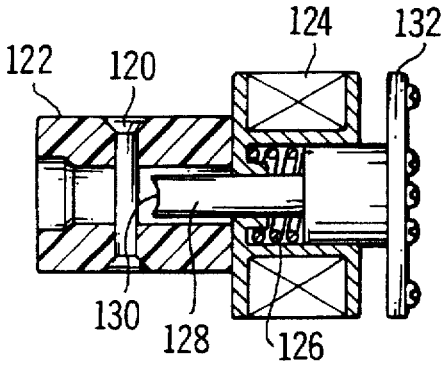
FIG. 18 is a cross-sectional view of an actuator of the dual punch mechanism.

As shown in FIGS. 17 and 18, the dual punch mechanism 30 comprises a closed-loop frame 122 having a passage 120 defined therein for passage of a sheet S therethrough, and two actuators 132 mounted on the frame 122 and each having an electromagnet 124 and an iron piece 128 magnetically movable by the electromagnet 124 against the bias of a return spring 126, the iron piece 128 having a punch 130 on its distal end for movement across the passage 120. If the two electromagnets 124 were simultaneously energized, then a large rush current would flow. To avoid such a large rush current, the two electromagnets 124 are energized at slightly different times for thereby reducing a load which is imposed on the power supply. Holes that are punched in sheets S by the dual punch mechanism 30 are elongate across the direction in which the sheets S are fed, so as to absorb certain positional displacements of the sheets S in their transverse direction. However, circular holes of large diameter may be punched in sheets S by the dual punch mechanism 30.

As shown in FIG. 7, a sheet S with two holes punched by the dual punch mechanism 30 is delivered onto the sorting tray 14' in the sheet introducing position in response to rotation of the second pair of upper and lower sets of inlet rollers 66A, 66B.

The dual punch mechanism 30 is selectively installed as an optional component. The sheet post-processing apparatus 10 with no such dual punch mechanism operates in the same manner as the sheet post-processing apparatus 10 with the dual punch mechanism 30 except that sheets S are not punched.

(I) Gripper Mechanism 32

Figure 19:
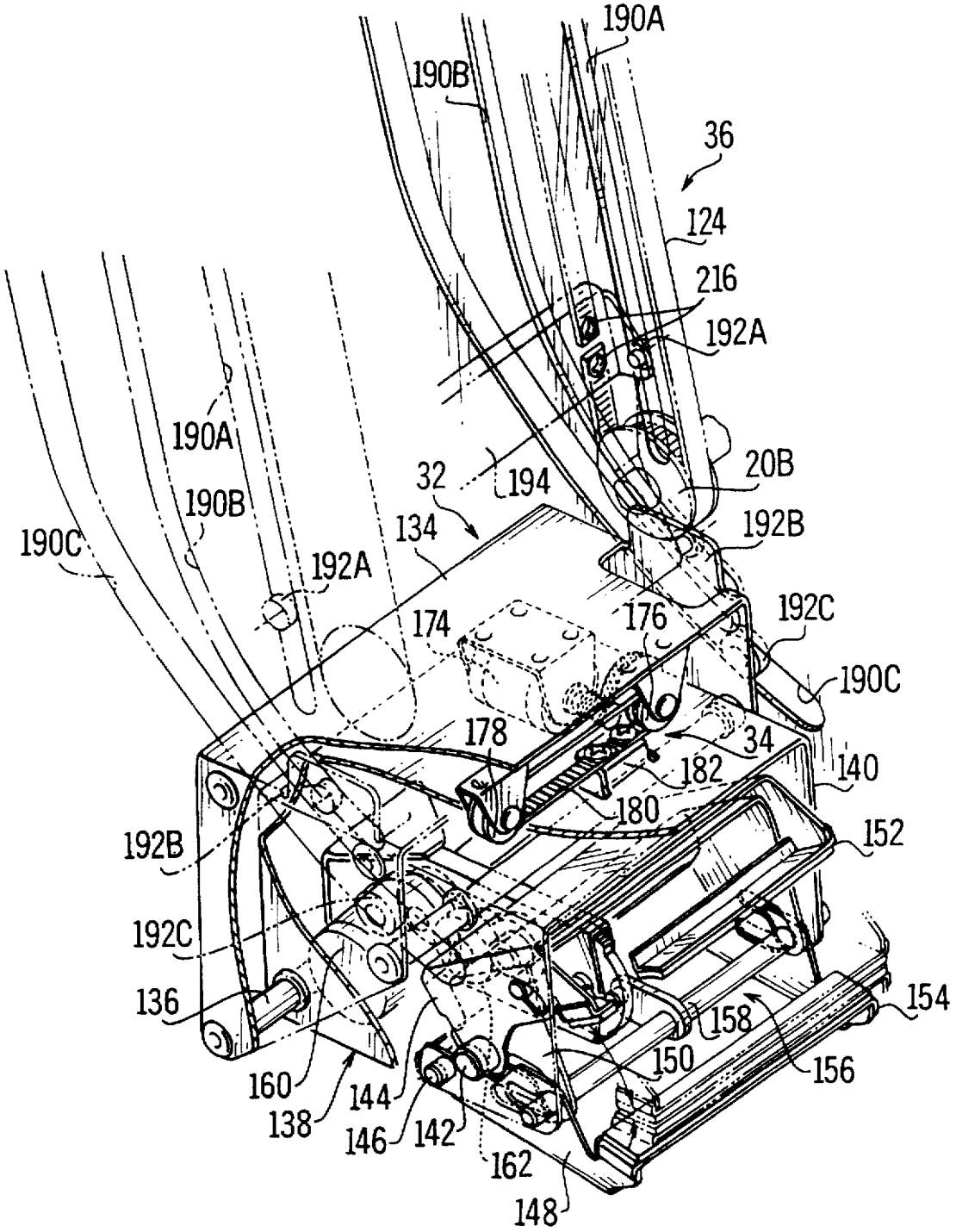
FIG. 19 is a fragmentary perspective view of a gripper mechanism and a gripper actuating mechanism.
Figure 20:
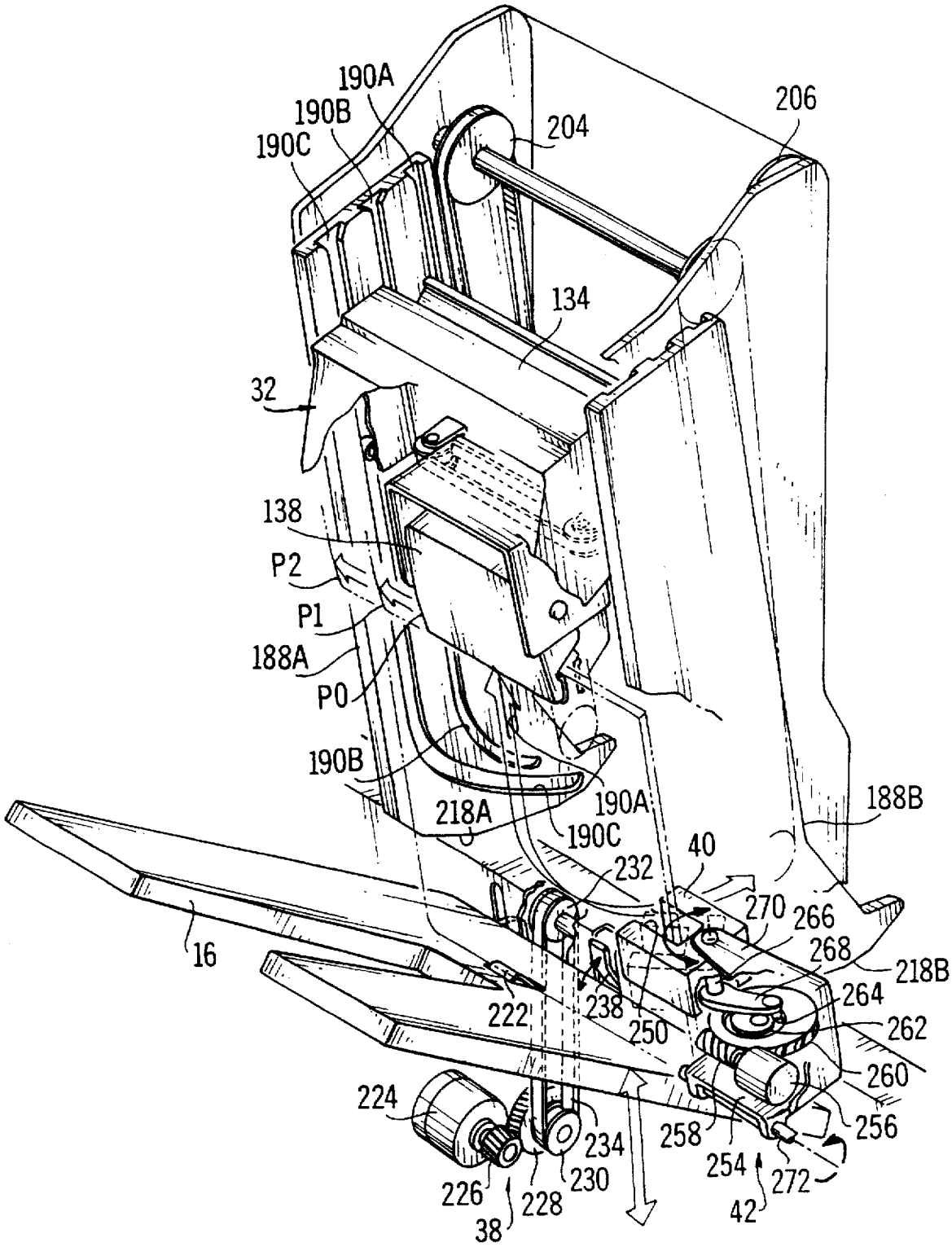
FIG. 20 is a perspective view of a mechanism for removing a pile of sheets from a sorting tray and discharging the pile of sheets onto a stacking tray.

As described above, the gripper mechanism 32 is provided to grip a pile P of sheets S altogether on the sorting tray 14" in the sheet removal position. The gripper mechanism 32 with the jogging mechanism 34 incorporated therein is constructed as shown in FIG. 19. As shown in FIG. 20, the gripper mechanism 32 is reciprocally movable along a predetermined curved path by the gripper actuating mechanism 36 between a gripping position in which the gripper mechanism 32 grips a pile P of sheets S altogether on the sorting tray 14" in the sheet removal position and a standby position (upper-limit position) which is displaced downstream from the gripping position with respect to the sheet removing direction Y and also displaced a given distance in the upward direction Z.

Under the control of the control mechanism 44, the gripper actuating mechanism 36 can stop the gripper mechanism 32 anywhere along its curved path and keep the gripper mechanism 32 in the stopped position, as will be described in detail later on.

I-1) Structure of Gripper Mechanism 32

The structure of the gripper mechanism 32 will be described below with reference to FIGS. 19 through 23.

As shown in FIG. 19, the gripper mechanism 32 has a gripper housing 134 which can be moved along a predetermined path by the gripper actuating mechanism 36. When the gripper housing 134 is in the illustrated position in which it grips a pile P of sheets S in a substantially horizontal position, the gripper housing 134 has its lower and front sides open, the front side facing the sorting trays 14, i.e., being position upstream with respect to the sheet removing direction Y.

The gripper mechanism 32 also comprises a slide guide shaft 136 mounted in the gripper housing 134 and extending in the sheet sorting direction X, and a gripper unit 138 mounted in the gripper housing 134 and supported on the slide guide shaft 136 for sliding movement in the sheet sorting direction X along the slide guide shaft 136. The gripper unit 138 can be slidably moved in the sheet sorting direction X along the slide guide shaft 136 by the jogging mechanism 34.

The gripper unit 138 comprises a slide case 140 supported on the slide guide shaft 136 for sliding movement in the sheet sorting direction X, an upper jaw 144 housed in the slide case 140 and swingably supported on opposite side walls of the slide case 140 by an upper support shaft 142, a lower jaw 148 housed in the slide case 140 and swingably supported on the opposite side walls of the slide case 140 by a lower support shaft 146, an intermediate member 150 swingably mounted on the upper support shaft 142, an upper gripper 152 attached to a distal end of the upper jaw 144, a lower gripper 154 attached to a distal end of the lower jaw 148, and a swinging mechanism 156 for swinging the upper and lower grippers 152, 154 toward and away from each other.

The swinging mechanism 156 comprises a drive rod 158 extending in the sheet sorting direction X and supported for reciprocating movement in the sheet removing direction Y, a reversible swinging drive motor 160, a drive force transmitting mechanism 162 for transmitting rotational drive forces from the swinging drive motor 160 as converted into drive forces along the sheet removing direction Y to the drive rod 158. When the swinging drive motor 160 is energized to rotate in one direction, the drive force transmitting mechanism 162 transmits rotational drive forces from the swinging drive motor 160 to push the drive rod 158 in the sheet removing direction Y. When the swinging drive motor 160 is energized to rotate in the opposite direction, the drive force transmitting mechanism 162 transmits rotational drive forces from the swinging drive motor 160 to pull push the drive rod 158 in a direction opposite to the sheet removing direction Y.

As shown in FIGS. 21A through 21D, the upper jaw 144 has a pair of arcuate slots 164 defined in respective opposite side walls thereof, and an intermediate rod 166 mounted on and extending between opposite side walls of the intermediate member 150 has opposite ends slidably fitted in the respective arcuate slots 164. The intermediate member 150 has a pair of first angular drive slots 168 defined in respective opposite side walls thereof. The lower jaw 148 has a pair of second angular drive slots 170 defined in respective opposite side walls thereof, the second angular drive slots 170 being of a shape which is a vertical reversal of the first angular drive slots 168. The drive rod 158 has opposite ends fitted in the first and second angular drive slots 168, 170.

The intermediate member 150 is normally biased to turn counterclockwise about the upper support shaft 142 with respect to the upper jaw 144 by a spring 172 (see FIG. 21C), so that the intermediate member 150 is resiliently held in position with the intermediate rod 166 engaging counterclockwise ends of the arcuate slots 164.

I-2) Gripping Operation of Gripper Mechanism 32

Figure 21A:
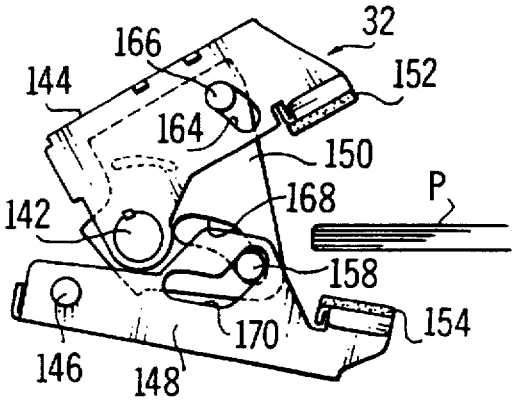
FIG. 21A is a side elevational view of the gripper mechanism as it is about to grip a pile of sheets.

When the swinging drive motor 160 is energized to rotate in one direction under the control of the control mechanism 44, the drive rod 158 is pushed in the direction opposite to the sheet removing direction Y toward distal ends of the first and second angular drive slots 168, 170 as shown in FIG. 21A. As a result, the upper jaw 144 is turned counterclockwise about the upper support shaft 142, and the lower jaw 148 is turned clockwise about the lower support shaft 146. Therefore, the upper and lower grippers 152, 154 are angularly moved away from each other, and hence are widely opened. The upper and lower grippers 152, 154 are now capable of gripping a pile P of sheets S therebetween. At this time, the gripper mechanism 32 is in its standby position.

When a process of introducing sheets S onto the sorting tray 14' in the sheet introducing position is finished and a process of removing the sheets from the sorting tray 14' is started with the gripper mechanism 32 in its standby position, the control mechanism 44 operates the attitude changing mechanism 26 to rotate the upstream lead screw rods 80A, 80B by a half (0.5) revolution and also rotate the downstream lead screw rods 80C, 80D by five and a half (5.5) revolutions. As a result, the sorting trays 14 change their attitude from the inclined position shown in FIG. 15 to the horizontal position shown in FIG. 22.

At this time, the control mechanism 44 operates the first and second rotating mechanisms 82, 84 in synchronism with each other to rotate the lead screw rods 80A, 80B, 80C, 80D simultaneously by a half (0.5) revolution, i.e., 180 degrees, for lowering the sorting trays 14. If, however, the control mechanism 44 rotated only the downstream lead screw rods 80C, 80D by five (5) revolutions without rotating the upstream lead screw rods 80A, 80B, then the sorting trays 14 in the inclined position shown in FIG. 15 would be brought into the horizontal position shown in FIG. 16. In the horizontal position shown in FIG. 16, the sorting tray 14 positioned in the removal opening 104 would be spaced a small distance from the upper edge of the removal opening 104, but spaced a large distance from the lower edge of the removal opening 104.

Figure 22:
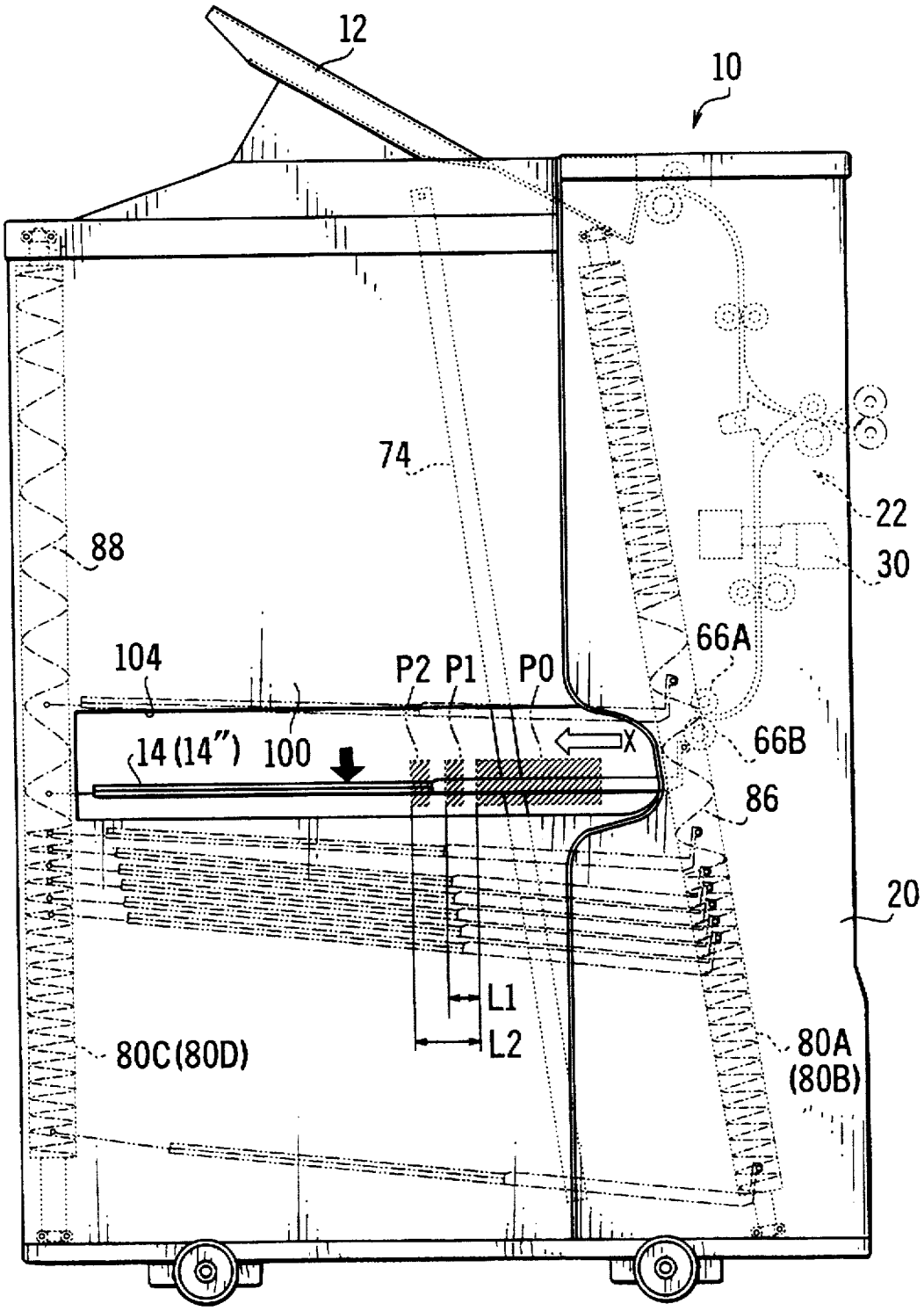
FIG. 22 is a front elevational view showing the horizontal sorting tray which is lowered a half lead pitch into a normal sheet removal position.

However, when the control mechanism 44 synchronously operates the first and second rotating mechanisms 82, 84 to rotate the lead screw rods 80A, 80B, 80C, 80D simultaneously by a half (0.5) revolution for lowering the sorting trays 14, the sorting tray 14 (14") positioned in the removal opening 104 is lowered a half lead pitch while staying at the removal position 104 as shown in FIG. 22. Thus, the sorting tray 14" positioned in the removal opening 104 is widely spaced from the upper edge of the removal opening 104. As a consequence, the upper jaw 144 that has been swung upwardly can find its way easily and reliably into the removal opening 104 above the sorting tray 14". The descent of the sorting trays 14 by a half lead pitch reduces the distance between the sorting tray 14" positioned in the removal opening 104 and the lower upper edge of the removal opening 104. This causes no problem because the lower jaw 148 swings a smaller angular interval than the upper jaw 144 as shown in FIG. 21A.

Figure 23:
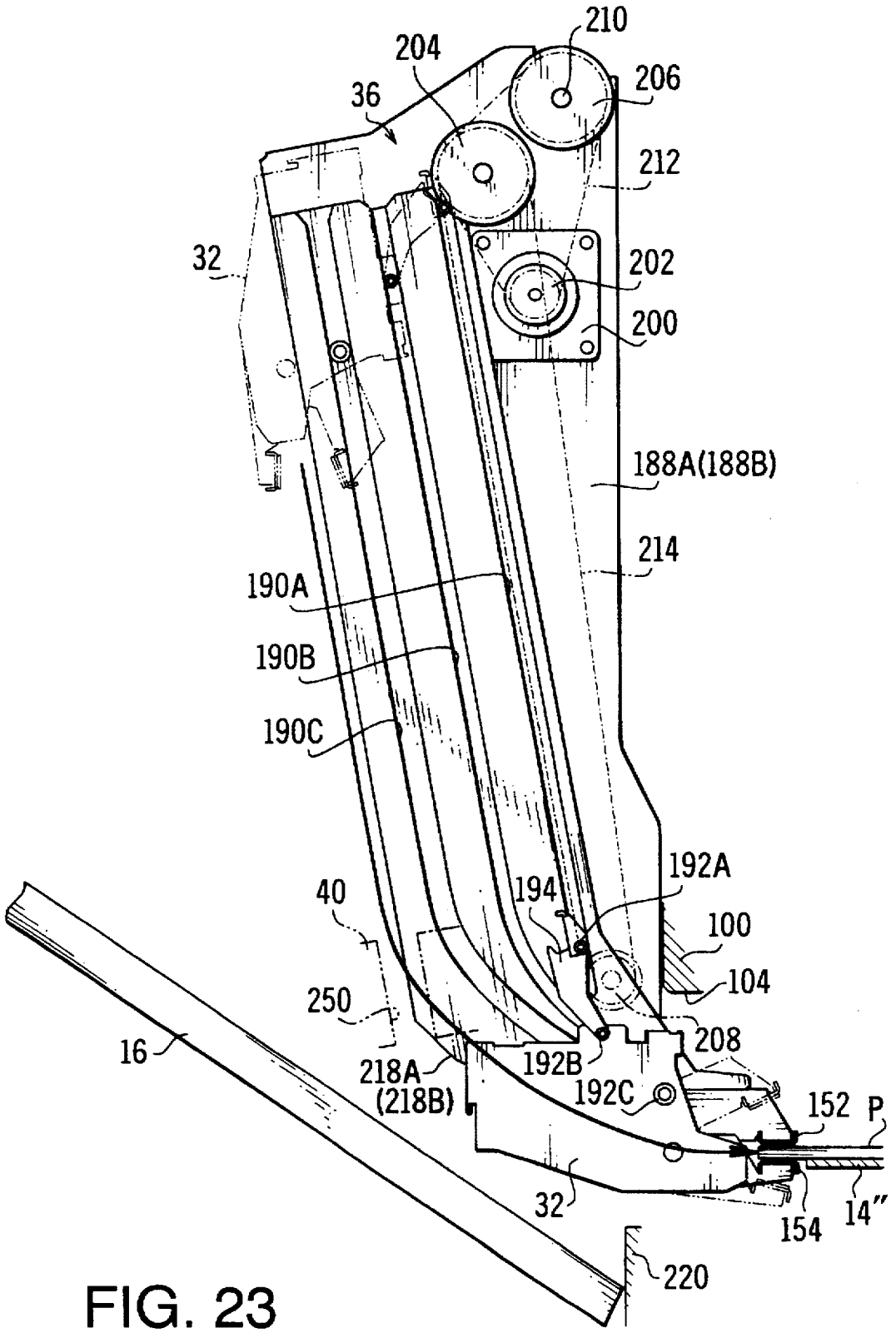
FIG. 23 is a side elevational view showing the manner in which the gripper mechanism grips a pile of sheets on the sorting tray in the sheet removal position.

The gripper mechanism 32 is actuated by the gripper actuating mechanism 36 to move from an upper lifted position indicated by the two-dot-and-dash lines in FIG. 23 toward a gripping position indicated by the solid lines in FIG. 23 in which the gripper mechanism 32 can grip a pile P of sheets S on the sorting tray 14" in the sheet removal position. When the gripper mechanism 32 is lowered into the gripping position, the upper gripper 152 is widely spaced upwardly from the upper surface of the area of the pile P of sheets S over the first recess 68*a* in the support plate 68 of the sorting tray 14" in the sheet removal position, as indicated by the two-dot-and-dash lines in FIG. 23. The spacing between the upper gripper 152 and the upper surface of the pile P of sheets S varies depending o the thickness of the pile P of sheets S. At the same time, the lower gripper 154 is slightly spaced from the lower surface of the area of the pile P of sheets S over the first recess 68*a* in the support plate 68 of the sorting tray 14" in the sheet removal position, as indicated by the two-dot-and-dash lines in FIG. 23.

When the swinging drive motor 160 is energized to rotate in the opposite direction while the gripper mechanism 32 is in the standby position, the drive rod 158 is retracted in the sheet removing direction Y along the first and second angular drive slots 168, 170. As the intermediate member 150 turns clockwise about the upper support shaft 142, the upper jaw 144 turns clockwise about the upper support shaft 142 and the lower jaw 148 turns counterclockwise about the lower support shaft 146. The upper and lower grippers 152, 154 are now angularly moved toward each other, and hence are progressively closed.

Figure 21B:
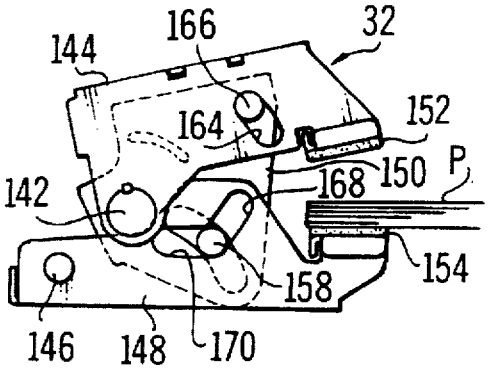
FIG. 21B is a side elevational view of the gripper mechanism as its lower gripping jaw is in a sheet removal position.

As shown in FIG. 21B, after the lower jaw 148 abuts against the lower surface of the pile P of sheets S on the sorting tray 14" in the sheet removal position, the lower jaw 148 remains in abutment against the lower surface of the pile P of sheets S regardless of continued retraction of the drive rod 158 along the second arcuate drive slot 170, and only the upper jaw 144 is continuously turned clockwise. The upper gripper 152 is now angularly moved toward the lower gripper 154, so that they are gradually closed.

Figure 21C:
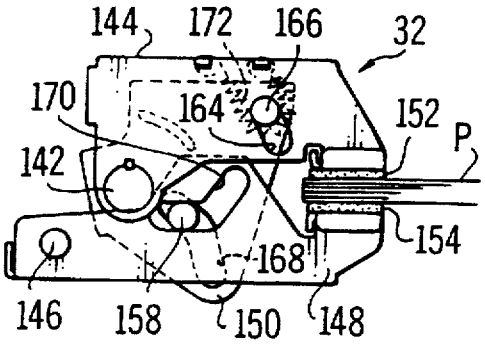
FIG. 21C is a side elevational view of the gripper mechanism as its upper and lower gripping jaws are in the sheet removal position.

When the upper and lower grippers 152, 154 are finally held in abutment against the respective upper and lower surfaces of the pile P of sheets S as shown in FIGS. 21C and 23, the drive rod 158 is positioned slightly forward of respective rear ends of the first and second arcuate drive slots 168, 170 as shown in FIG. 21C.

Figure 21D:
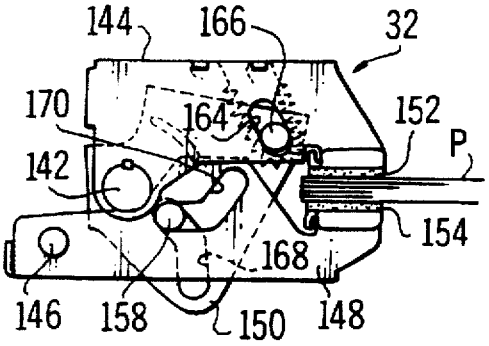
FIG. 21D is a side elevational view of the gripper mechanism as its upper and lower gripping jaws forcibly grip the pile of sheets in the sheet removal position.

Continued rotation of the swinging drive motor 160 in the opposite direction further retracts the drive rod 158 in the sheet removing direction Y until finally the drive rod 158 reaches the respective rear ends of the first and second arcuate drive slots 168, 170, as shown in FIG. 21D. Upon the displacement of the drive rod 158 from the position shown in FIG. 21C to the position shown in FIG. 21D, the intermediate member 150 is turned clockwise about the upper support shaft 142 along the shape of the first arcuate drive slot 168 against the bias of the spring 172. The intermediate rod 166 is angularly moved clockwise in the arcuate slot 164 until finally it abuts against and strongly pushes a clockwise end of the arcuate slot 164. The lower jaw 148 is moved along the shape of the second arcuate drive slot 170, and hence remains in the position shown in FIG. 21C without being angularly moved at all.

In the gripping position shown in FIG. 21D, the upper gripper 152 is strongly pressed toward the lower gripper 154, thereby firmly gripping the pile P of sheets therebetween.

The upper jaw 144 and the lower jaw 148 are angularly moved through respective large and small angular intervals for gripping the pile P of sheets S, as described above. Specifically, the angular interval through which the lower jaw 148 is angularly moved to grip the pile P of sheets S is smaller than the angular interval through which the upper jaw 144 is angularly moved to grip the pile P of sheets S. The angular interval through which the lower jaw 148 is angularly moved to grip the pile P of sheets S is selected such that when the angular movement of the lower jaw 148 is finished, the upper surface of the lower gripper 154 lies substantially flush with the upper surface of the support plate 68 of the sorting tray 14" in the sheet removal position.

When the upper and lower grippers 152, 154 of the gripper mechanism 32 are positioned closely to the pile P of sheets S on the sorting tray 14" in the sheet removal position at the time they start the process of gripping the pile P of sheets S as shown in FIG. 21A, the upper and lower grippers 152, 154 are spaced respective gaps or intervals upwardly and downwardly from the upper and lower surfaces of the pile P of sheets S, without impairing the stacked condition of the pile P of sheets S. When the pile P of sheets S on the sorting tray 14" in the sheet removal position is gripped by the gripper mechanism 32, the gripped area of the pile P of sheets S is not substantially vertically displaced in position by the gripper mechanism 32.

(J) Jogging Mechanism 34

J-1) Structure of Jogging Mechanism 34

As described above, the gripper unit 138 with the upper and lower jaws 144, 148 housed in the slide case 140 is supported on the slide guide shaft 136 for reciprocating movement therealong in the sheet sorting direction X. The jogging mechanism 34, which serves as a mechanism for reciprocally moving the gripper unit 138, comprises, as shown in FIG. 19, a reversible jogging drive motor 174, a drive pulley 176 rotatable by the jogging drive motor 174 about an axis extending in the sheet removing direction Y, a driven pulley 178 spaced downstream of the drive pulley 176 in the sheet sorting direction X and supported for rotation about an axis extending in the sheet removing direction Y, an endless timing belt 180 trained around the drive pulley 176 and the driven pulley 178, and a fastener 182 by which a portion of the timing belt 180 is fixed to the slide case 140.

J-2) Jogging Operation of Jogging Mechanism 34

When the jogging drive motor 174 is energized, the gripper unit 138 is reciprocally moved in the sheet sorting direction X. When the jogging drive motor 174 is de-energized, the gripper unit 138 is stopped at a desired position.

In the illustrated embodiment, as shown in FIG. 22, the gripper unit 38 is moved to and stopped in either a home position (gripping position) P0 for the gripper unit 38 to grip the pile P of sheets S on the horizontal sorting tray 14" in the sheet removal position, a sheet removal position (or a first jogging position) P1 which is spaced a first distance L1 downstream with respect to the sheet sorting direction X from the home position P0, or a jogging position (or a second jogging position) which is spaced a second distance L2, greater than the first distance L1, downstream with respect to the sheet sorting direction X from the home position P0.

The home position P0 serves as a standby position for the gripper unit 138. When the gripper mechanism 32 is held in the lifted or standby position, indicated by the two-dot-and-dash lines in FIG. 23, by the gripper actuating mechanism 36, the gripper unit 138 is located in a position corresponding to the home position P0. While the gripper mechanism 32 is being lowered from the lifted or standby position toward the gripping position, indicated by the solid lines in FIG. 23, by the gripper actuating mechanism 36, the gripper unit 138 is also located in a position corresponding to the home position P0.

The sheet removal position P1 is defined as a common sheet removal position at the time no jogging process is carried out, and also as a first jogging position when a jogging process is carried out. Even when no jogging process is carried out, the jogging mechanism 34 is actuated to move the gripper mechanism 32 the first distance L1 in the sheet sorting direction X from the home position P0 to the sheet removal position P1. The reasons for this operation are as follows: Since the apparatus housing 20 is relatively compact according to the present invention, the lead screw rod 80A which is located downstream of the lead screw rod 80B in the sheet removing direction Y lies in a range in which the pile P of sheets is removed, tending to obstruct the removal of the pile P of sheets from the sorting tray 14" in the sheet removal position. The gripper mechanism 32 is displaced the first distance L1 from the home position P0 to the sheet removal position P1 so that the pile P of sheets S can be removed clear of the lead screw rod 80A.

When a jogging process is carried out, the gripper mechanism 32 is moved to the first jogging position P1, and then removes and discharges a pile P of sheets S onto the stacking tray 16. Then, the gripper mechanism 32 is moved to the second jogging position P2, and then removes and discharges another pile P of sheets S onto the previous pile P of sheets that has already been discharged onto the stacking tray 16. The presently discharged pile P of sheets S is therefore stacked on the previously discharged pile P of sheets S while being displaced a distance equal to (L2–L1) in the sheet sorting direction X.

Figure 32:
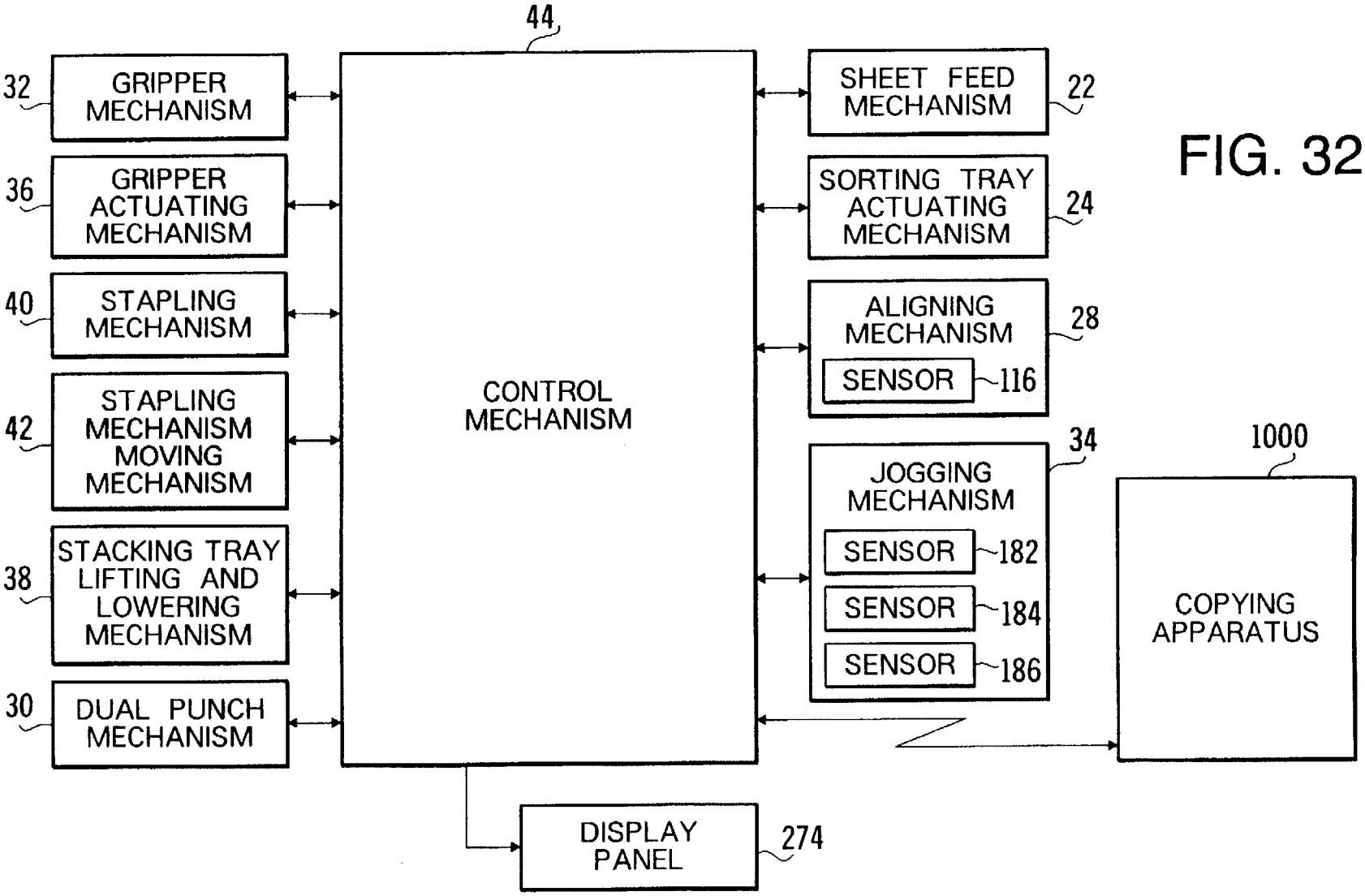
FIG. 32 is a block diagram of a control system of the sheet post-treating apparatus.

As shown in FIG. 32, the jogging mechanism 34 has a home position sensor 182, a first stop position sensor 184, and a second stop position sensor 186 which are connected to the control mechanism 44. The home position sensor 182 is positioned such that it is turned on when the gripper unit 138 is in the home position P0. The first stop position sensor 184 is positioned such that it is turned on when the gripper unit 138 is in the sheet removal position or first jogging position P1. The second stop position sensor 186 is positioned such that it is turned on when the gripper unit 138 is in the jogging position or second jogging position P2.

(K) Gripper Actuating Mechanism 36

The gripper actuating mechanism 36 for reciprocally moving the gripper mechanism 32 between the upper lifted or standby position indicated by the two-dot-and-dash lines in FIG. 23 and the gripping position indicated by the solid lines in FIG. 23 will be described below with reference to FIGS. 19, 20, and 23 through 29.

K-1) Path of Movement of Gripper Actuating Mechanism 36

As shown in FIG. 23, the gripper mechanism 32 can be actuated by the gripper actuating mechanism 36 to be pulled substantially horizontally from the gripping position in which it can grip a pile P of sheets on the sorting tray 14" in the sheet removal position toward the operator of the sheet post-treating apparatus 10 and the electrophotographic copying apparatus 1000, then lifted gradually obliquely upwardly immediately after being pulled from the gripping position, and thereafter lifted straight obliquely upwardly to the upper lifted or standby position, and also to be lowered from the upper lifted or standby position to the gripping position back along the same path. Stated otherwise, the gripper mechanism 32 moves first along a curved path from the gripping position and then along a substantially straight path that is inclined gradually away from the front shield plate 100, i.e., the sorting trays 14, in the upward direction, specifically inclined at an angle of about 9 degrees to the vertical, up to the upper standby position. The upper standby position is thus spaced a predetermined distance downstream from the lower gripping position with respect to the sheet removing direction Y, and also spaced a predetermined distance upwardly from the lower gripping position with respect to the upward direction Z.

The gripper actuating mechanism 36 is arranged to orient the gripper mechanism 32 such that when the gripper mechanism 32 is in the lower gripping position, the pile P of sheets S gripped by the gripper mechanism 32 is directed horizontally, and when the gripper mechanism 32 is in the upper standby position, the pile P of sheets S gripped by the gripper mechanism 32 is directed substantially vertically when the gripper mechanism 32 is in the upper standby position, and also such that as the gripper mechanism 32 moves from the gripping position to the standby position, the pile P of sheets S gripped by the gripper mechanism 32 changes its attitude gradually from the horizontal attitude toward the substantially vertical attitude, and as the gripper mechanism 32 moves from the standby position to the gripping position, the pile P of sheets S gripped by the gripper mechanism 32 changes its attitude gradually from the substantially vertical attitude toward the horizontal attitude.

K-2) Structure of Gripper Actuating Mechanism 36

The gripper actuating mechanism 36 for moving the gripper mechanism 32 while changing its attitude along the path described above comprises a pair of side plates 188A, 188B (see FIG. 20) disposed one on each side of the path of the gripper mechanism 32 and extending along the sheet removing direction Y, three guide grooves 190A, 190B, 190C (see FIG. 20) defined in the inner surface of each of the side plates 188A, 188B, and three guide pins 192A, 192B, 192C (see FIG. 19) slidingly fitted in the respective guide grooves 190A, 190B, 190C, for defining the path and attitude of the gripper mechanism 32.

Each of the guide grooves 190A, which is positioned on the rightmost of all the guide grooves 190A, 190B, 190C in FIG. 23, i.e., closest to the front shield plate 100 or remotest from the operator, extends straight parallel to and along the full length of the inclined straight path of the gripper mechanism 32. The guide pins 192A fitted in the respective guide grooves 190A are mounted on opposite sides of a bracket 194 that is angularly movably mounted on upper portions of opposite side walls of the gripper housing 134.

Each of the middle guide grooves 190B and each of the guide grooves 190C, which is positioned on the leftmost of all the guide grooves 190A, 190B, 190C in FIG. 23, i.e., closest to the operator, have curved lower portions which approach the sorting tray 14" in the sheet removal position in the downward direction. The guide pins 192B fitted in the middle guide grooves 190B and the guide pins 192C fitted in the guide grooves 190C are mounted in spaced relationship on the opposite side walls of the gripper housing 134 as shown in FIG. 19.

When the gripper mechanism 32 is vertically moved along its path, the guide pins 192A, 192B, 192C slide in and along the respective guide grooves 190A, 190B, 190C for thereby securely defining the path along which the gripper mechanism 32 moves and varying the attitude of the gripper mechanism 32 depending on its vertical position along the path.

As shown in FIG. 23, the gripper actuating mechanism 36 comprises a reversible actuating drive motor 200 for moving the gripper mechanism 32, a motor pulley 202 fixed coaxially to the output shaft of the actuating drive motor 200, a drive pulley 204 rotatably mounted on the side plate 188A at a position slightly higher than the upper standby position for the gripper mechanism 32, a biasing pulley 206 rotatably mounted on the side plate 188A near the drive pulley 204 and the motor pulley 202, and a driven pulley 208 rotatably mounted on the side plate 188A at a position slightly higher than the lower gripping position for the gripper mechanism 32. These pulleys 202, 204, 206, 208 are rotatable about respective axes parallel to the sorting direction X. The biasing pulley 206 is rotatably supported on a support shaft 210 mounted on the side plate 188A, and a helical coil spring (not shown) which is disposed around the support shaft 210 has an end engaging the support shaft 210 and the other end engaging the biasing pulley 206 for normally biasing the biasing pulley 206 in a direction to pull the gripper mechanism 32 upwardly.

A first endless transmitting belt 212 is trained around the motor pulley 202, the drive pulley 204, and the biasing pulley 206, and a second endless transmitting belt 214 is trained around the drive pulley 204 and the driven pulley 208. The second endless transmitting belt 214 has a portion fastened to the bracket 194 by fasteners 216 (see FIG. 19).

When the drive motor 200 is energized, the gripper mechanism 32 is reciprocally moved along its path between the lower gripping position and the upper standby position. Specifically, when the drive motor 200 is energized to rotate the motor pulley 202 in one direction, the gripper mechanism 32 is moved from the upper standby position toward the lower gripping position, and when the drive motor 200 is energized to rotate the motor pulley 202 in the opposite direction, the gripper mechanism 32 is moved from the lower gripping position toward the upper standby position.

As shown in FIG. 20, the side plates 188A, 188B have respective lower end portions curved along a feed path along which a pile P of sheets S is fed by the gripper mechanism 32. These curved lower end portions of the side plates 188A, 188B serve as guides 218A, 218B for guiding opposite side edges of a pile P of sheets S as it is fed along the feed path. Specifically, the guides 218A, 218B perform the following function: As described later on, when a stapling process is carried out, one side of a pile P of sheets S needs to be pass through a stapling passage 250 in the stapling mechanism 40. However, only a substantially central portion of the pile P of sheets S is gripped by the gripper mechanism 32, and if there were no guides 218A, 218B, then there is no assurance that one side of the pile P of sheets S will pass through a stapling passage 250. The guides 218A, 218B on the lower end portions of the side plates 188A, 188B reliably guide one side of the pile P of sheets S, which is gripped by the gripper mechanism 32, to pass through the stapling passage 250 when a stapling process is carried out.

When no stapling process is carried out, the stapling mechanism 40 is retracted out of the path of the gripper mechanism 32, i.e., the feed path of the pile P of sheets S gripped by the gripper mechanism 32, by the stapling mechanism moving mechanism 42. Consequently, one side of the pile P of sheets S being fed is not threaded through the stapling passage 250 when a stapling process is not carried out.

K-3) Operation to Remove a Pile P of Sheets S by Gripper Actuating Mechanism 36

A process of removing a pile P of sheets S from the sorting tray 14" in the sheet removal position with the gripper mechanism 32 moved by the gripper actuating mechanism 36 will be described below with reference to FIGS. 23 through 29.

When a process of removing a pile P of sheets S from the sorting tray 14" in the sheet removal position is started, the control mechanism 44 energizes the drive motor 200 of the gripper actuating mechanism 36 to rotate in one direction, moving the gripper mechanism 32 from the upper standby position indicated by the two-dot-and-dash lines in FIG. 23 along its path to the gripping position indicated by the solid lines in FIG. 23. In the gripping position, the upper and lower grippers 152, 154 are vertically turned away from each other, i.e., are open, for gripping a pile P of sheets S as indicated by the two-dot-and-dash lines in FIG. 23. Specifically, when the gripper mechanism 32 is moved to the gripping position, the upper and lower grippers 152, 154 are vertically spaced from each other respectively above and below the area of the pile P of sheets S which extends over the first opening 64*a* of the sorting tray 14" in the sheet removal position, as described above with reference to FIG. 21A.

Thereafter, as described with reference to FIGS. 21A through 21D, the gripper mechanism 32 grips an end of the pile P of sheets S on the sorting tray 14" in the sheet removal position as indicated by the solid lines in FIG. 23. After the gripper mechanism 32 has gripped the pile P of sheets S, the control mechanism 44 operates the jogging mechanism 34 to move the gripper unit 138 from the home position P0 to the sheet removal position P1 by the distance L1 in the sheet sorting direction X as shown in FIG. 22.

It is assumed the process of removing the pile P of sheets S does not involve any jogging process and stapling process. A process of removing a pile P of sheets in combination with a jogging process and stapling process will be described later on with respect to control operation of the control mechanism 44.

Subsequently, the control mechanism 44 energizes the drive motor 200 to rotate the motor pulley 202 in the opposite direction to move the gripper mechanism 32 gripping the pile P of sheets first only in the sheet removing direction Y and then upwardly along the path defined by the guide pins 192A, 192B, 192C fitted respectively in the guide grooves 190A, 190B, 190C. Stated otherwise, the gripper actuating mechanism 36 moves the gripper mechanism 32 gradually upwardly along the curved path immediately after the gripper mechanism 32 has started being pulled in the sheet removing direction Y, pulling the gripped pile P of sheets S up to the upper standby position while the pile P of sheets S is directed gradually from the horizontal orientation toward the vertical orientation.

Figure 24:
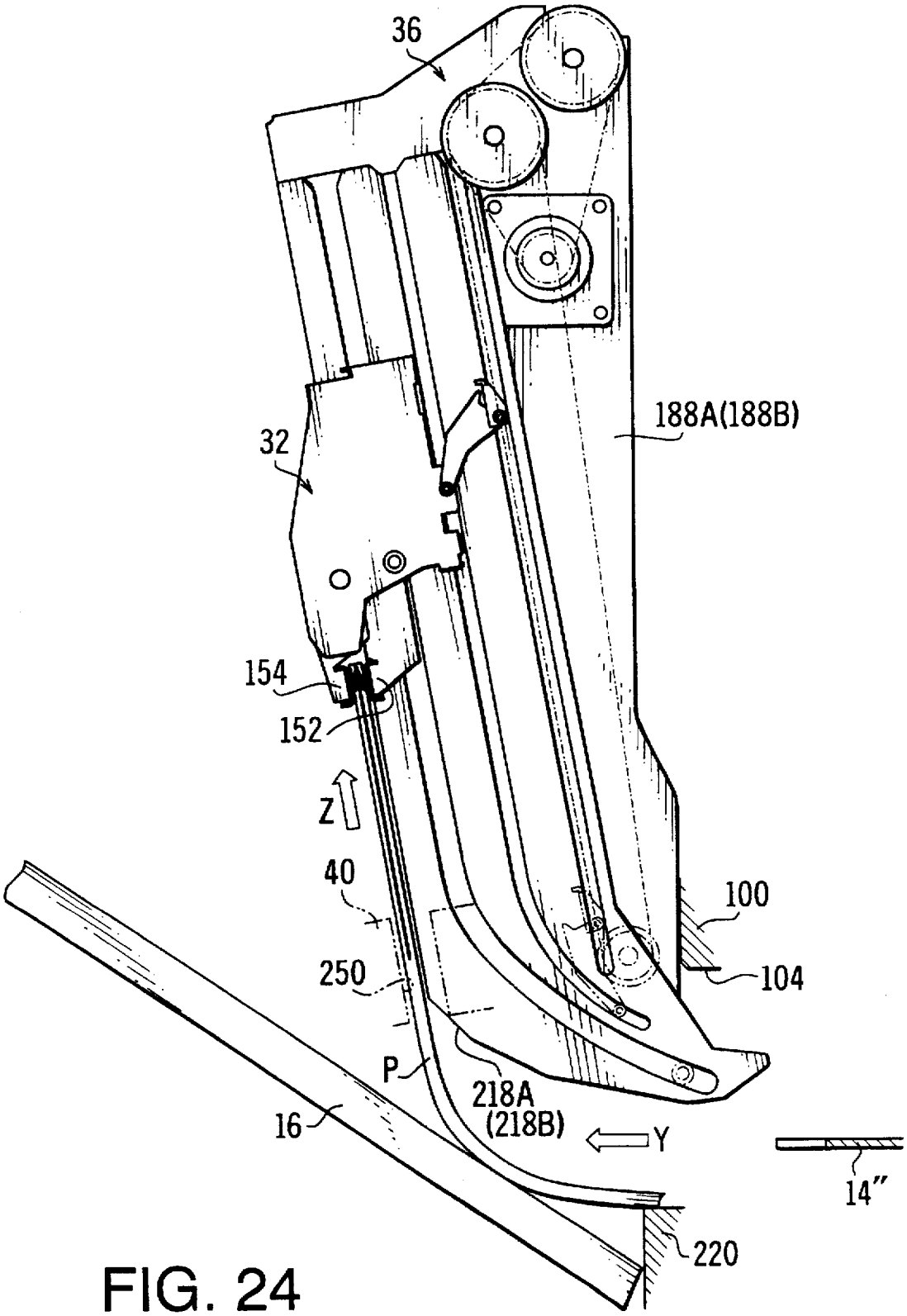
FIG. 24 is a side elevational view showing the manner in which an intermediate portion of the pile of sheets whose leading end is gripped by the gripper mechanism is flexed by being supported on a stacking tray while the gripper mechanism is moving from the gripping position toward a lifted position.

As the gripper mechanism 32 is actuated to remove the pile P of sheets S by the gripper actuating mechanism 36, the trailing end of the pile P of sheets S, i.e., the end of the pile P of sheets S which is located upstream with respect to the sheet removing direction Y, is pulled off the sorting tray 14" in the sheet removal position. As shown in FIG. 24, an intermediate portion of the pile P of sheets S has its lower surface borne by the stacking tray 16, keeping the pile P of sheets S curved while being fed along the feed path. While being fed on the stacking tray 16, more specifically, immediately after the pile P of sheets S is pulled off the sorting tray 14" in the sheet removal position, the pile P of sheets S is maintained in a curved shape similar to the path of the gripper mechanism 32. Therefore, the pile P of sheets S is prevented from being subject to undue forces, and hence can smoothly be pulled off the sorting tray 14" in the sheet removal position.

Figure 25:
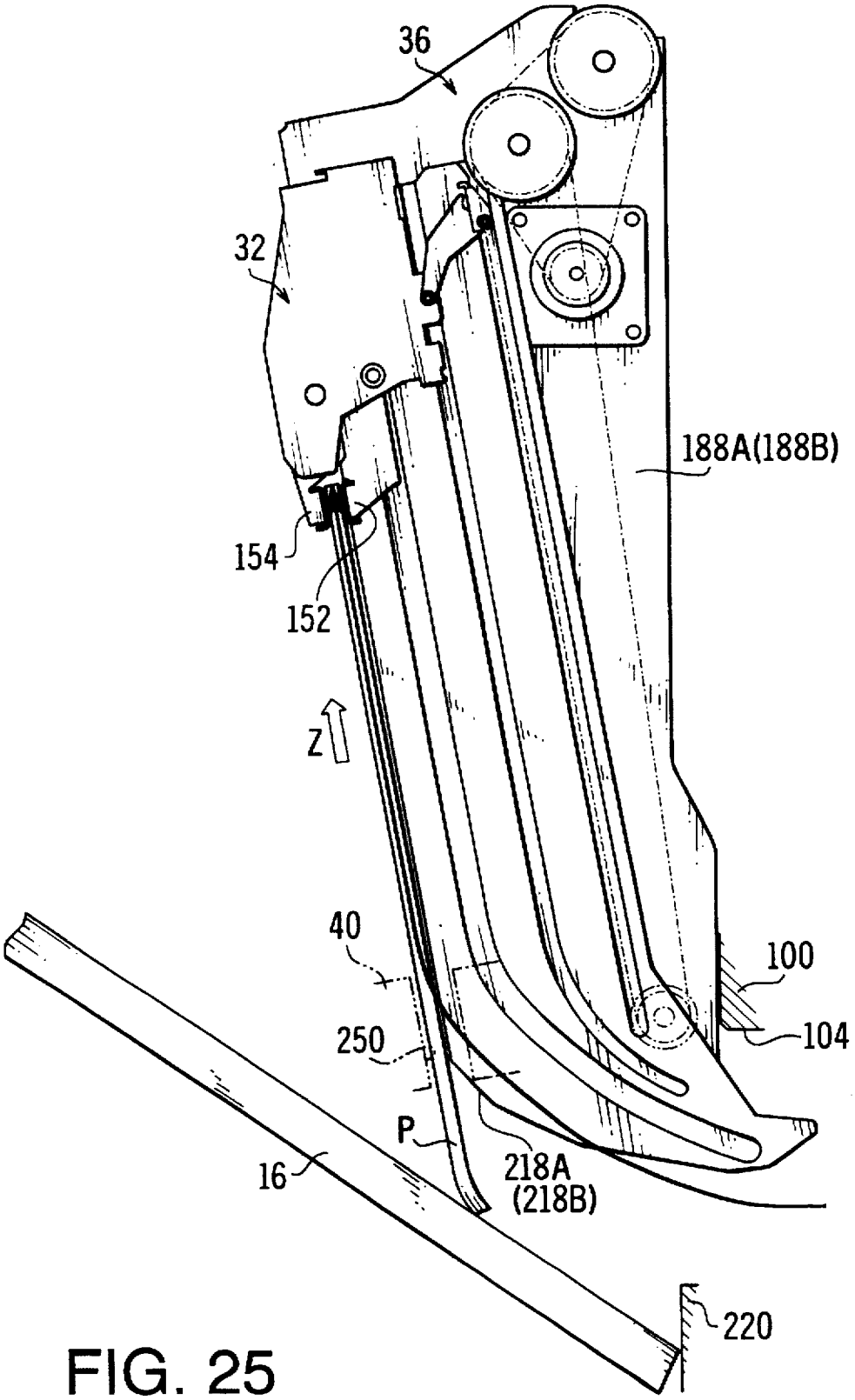
FIG. 25 is a side elevational view showing the manner in which the gripper mechanism has reached the lifted position.

Based on information of the size of the sheets S transmitted from a control system in the electrophotographic copying apparatus 1000, the control mechanism 44 detects when the gripper mechanism 32 gripping the pile P of sheets S is lifted until the trailing end of the pile P of sheets S slightly contacts the upper surface of the stacking tray 16, as shown in FIG. 25, or the upper surface of a pile P of sheets S previously stacked on the stacking tray 16, and then de-energizes the drive motor 200, stopping the upward movement of the gripper mechanism 32. The control mechanism 44 thereafter keeps the gripper mechanism 32 in the lifted position.

Figure 26:
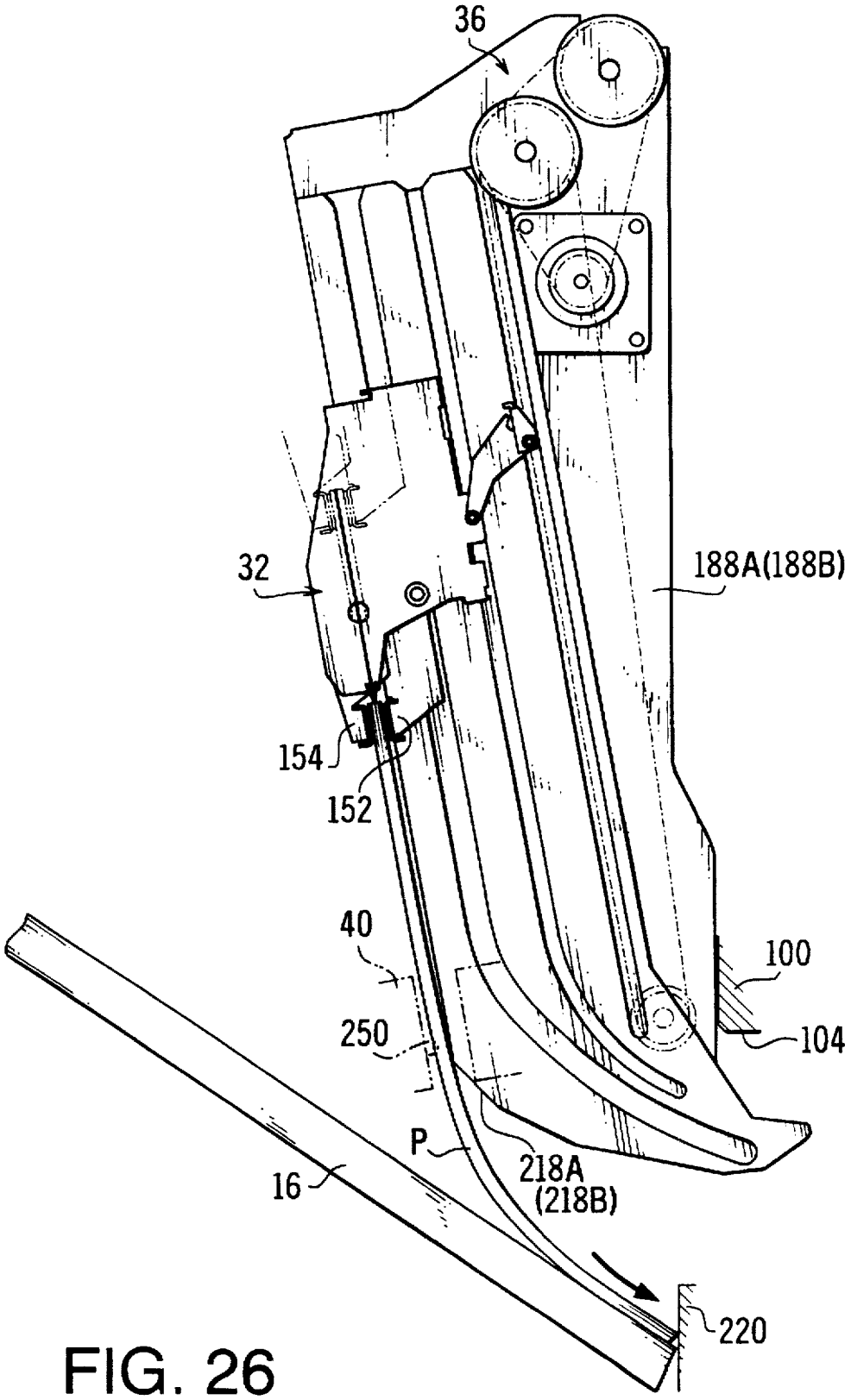
FIG. 26 is a side elevational view showing the manner in which the gripper mechanism is lowered until a trailing end of the pile of sheets gripped thereby abuts against a raised wall.

Then, the control mechanism 44 energizes the drive motor 200 to rotate the motor pulley 202 in one direction to lower the gripper mechanism 32 until the trailing end of the pile P of sheets S abuts against a vertical wall which serves as a raised wall 220 of the stacking tray 16, as shown in FIG. 26. The distance which the gripper mechanism 32 is lowered is calculated by a calculating unit (not shown) in the control mechanism 44 based on the sheet size information from the electrophotographic copying apparatus 1000, positional information about the lifted position referred to above, and one-/two-stable mode information in a stapling process.

In the position shown in FIG. 26, the control mechanism 44 energies the swinging drive motor 160 of the gripper mechanism 32 to push the drive rod 158 from the position shown in FIG. 21D to the position shown in FIG. 21A. The upper and lower grippers 152, 154 are angularly displaced away from each other, releasing the pile P of sheets S. Normally, the released pile P of sheets S drops by gravity onto the stacking tray 16. Since, however, the pile P of sheets S has strongly been gripped by the gripper mechanism 32, if the pile P of sheets S intimately adheres to the outer gripper 154, then the pile P of sheets S may remain stuck to the gripper 154, and may possibly fail to drop onto the stacking tray 16.

Figure 27:
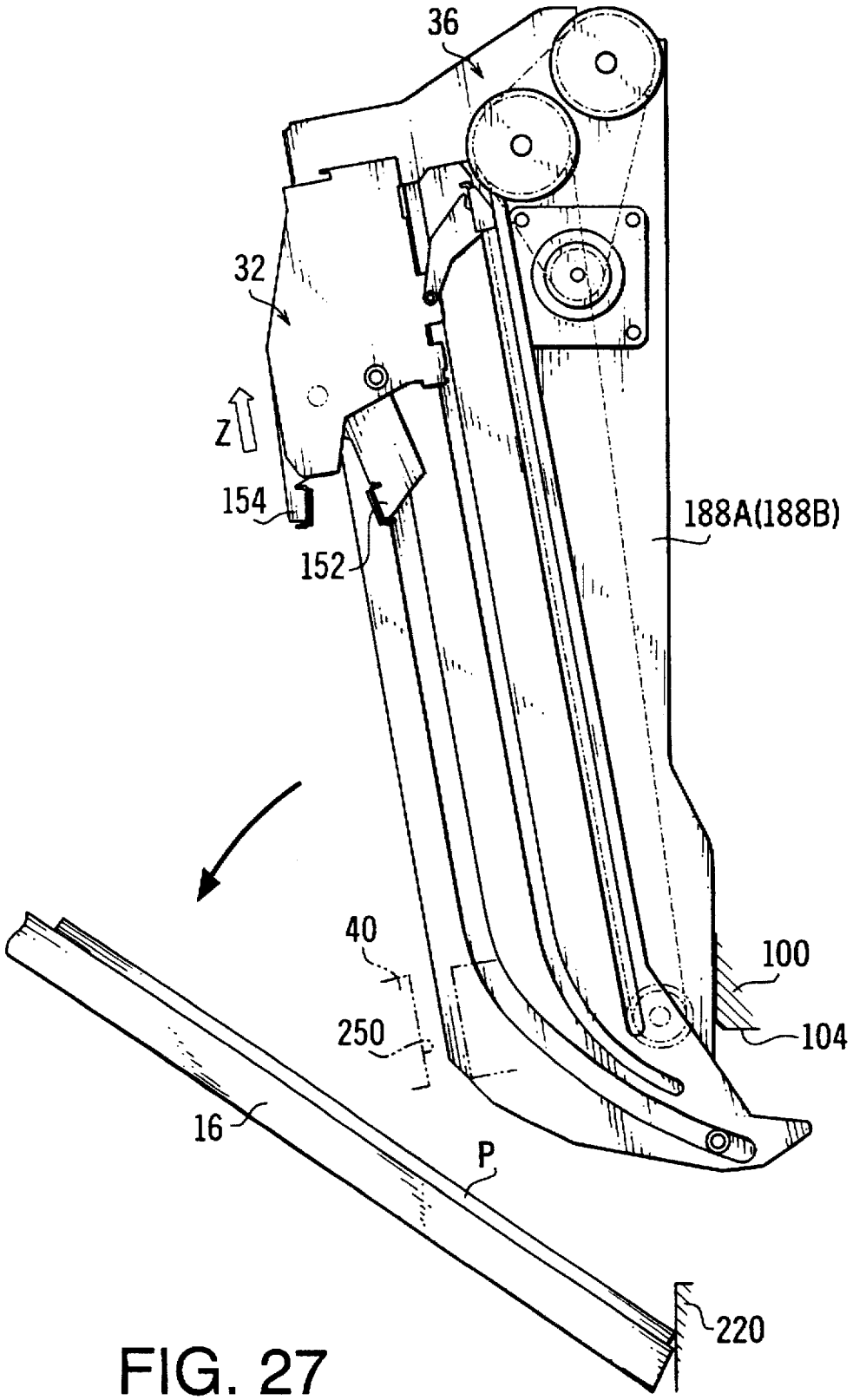
FIG. 27 is a side elevational view showing the manner in which the pile of sheets is released from the gripper mechanism and discharged onto the stacking tray upon upward movement of the gripper mechanism over a given distance.

To prevent such a failure of the pile P of sheets S to drop, when the control mechanism 44 controls the gripper mechanism 32 to release the pile P of sheets S, the control mechanism 44 energizes the drive motor 200 to rotate the motor pulley 202 in the opposite direction, elevating the gripper mechanism 32 a given distance into a retracted position as shown in FIG. 27. Now, the released pile P of sheets S no longer remains stuck to the gripper 154, and falls onto the stacking tray 16. In the illustrated embodiment, the retracted position to which the gripper mechanism 32 is elevated the given distance is the same as the upper standby position therefor referred to above.

Figure 28:
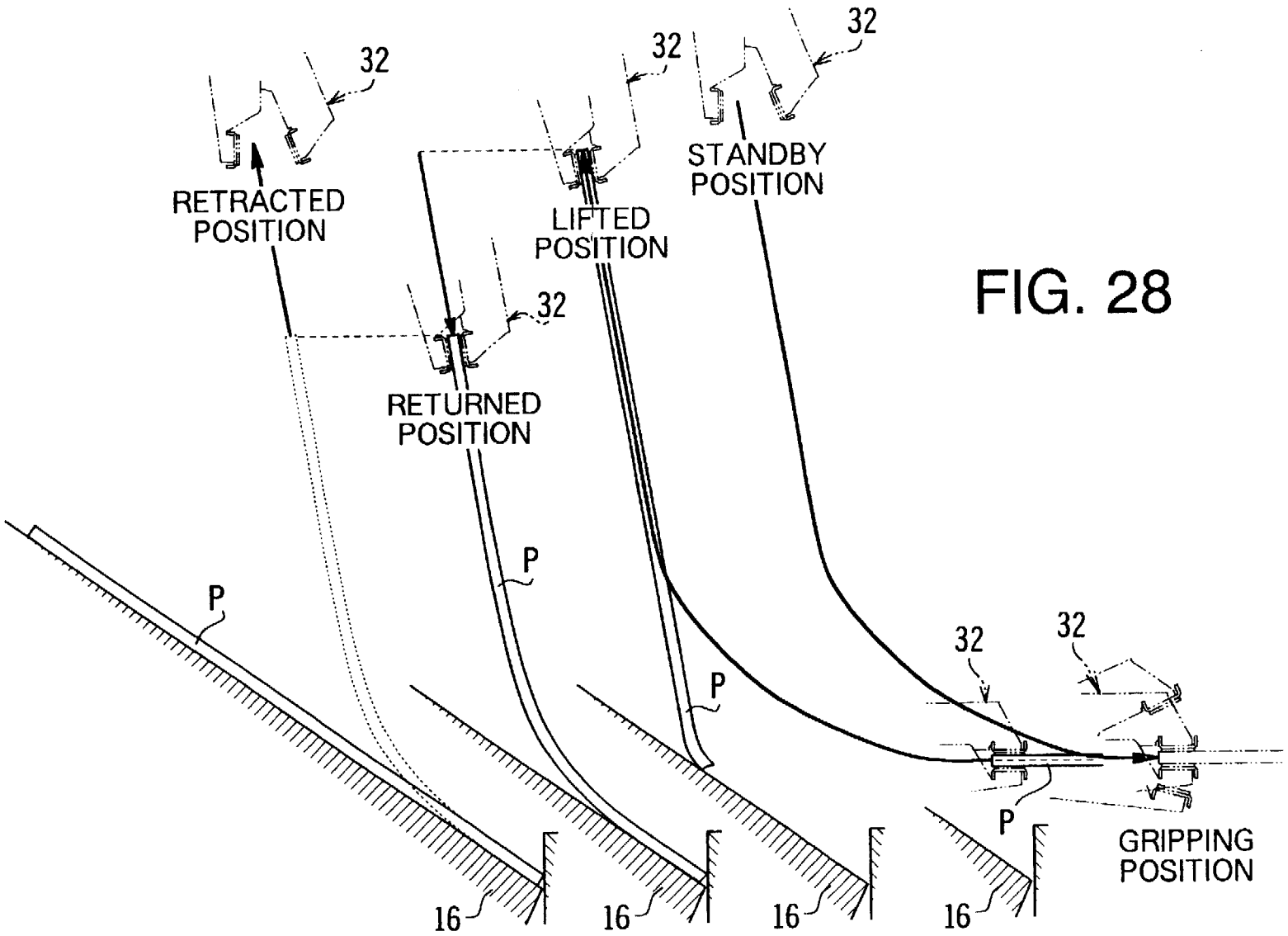
FIG. 28 is a schematic side elevational view showing successive positions to which the gripper mechanism is displaced by the gripper actuating mechanism.

To summarize the above process of removing the pile P of sheets S, as shown in FIG. 28, the gripper mechanism 32 grips the pile P of sheets S on the sorting tray 14" in the sheet removal position, pulls the pile P of sheets S along the sheet removing direction Y toward the upper standby position. After the gripper mechanism 32 is elevated to the lifted position in the upward direction Z, the gripper mechanism 32 is lowered until the trailing end of the pile P of sheets S abuts against the raised wall 220 of the sorting tray 16, then releases the pile P of sheets S, and is elevated again up to the retracted position. The pile P of sheets S on the sorting tray 14" in the sheet removal position can thus reliably discharged onto the stacking tray 16 or a previously stacked pile P of sheets S on the stacking tray 16.

K-4) Advantages Offered upon Removal of a Pile P of Sheets with Gripper Actuating Mechanism 36

The lifted position is variable depending on the size of sheets S in the sheet removing direction Y. If the lifted position shown in FIG. 25 is for sheets S of size A4 that are removed in their longitudinal direction, i.e., with their longitudinal axis along the sheet removing direction Y, then the lifted position for sheets S of size B5 that are removed in the longitudinal direction or for sheets S of size B4 that are removed in the transverse direction, i.e., with their transverse axis along the sheet removing direction Y, is automatically set to a position lower than the lifted position for sheets S of size A4 that are removed in their longitudinal direction.

Figure 29:
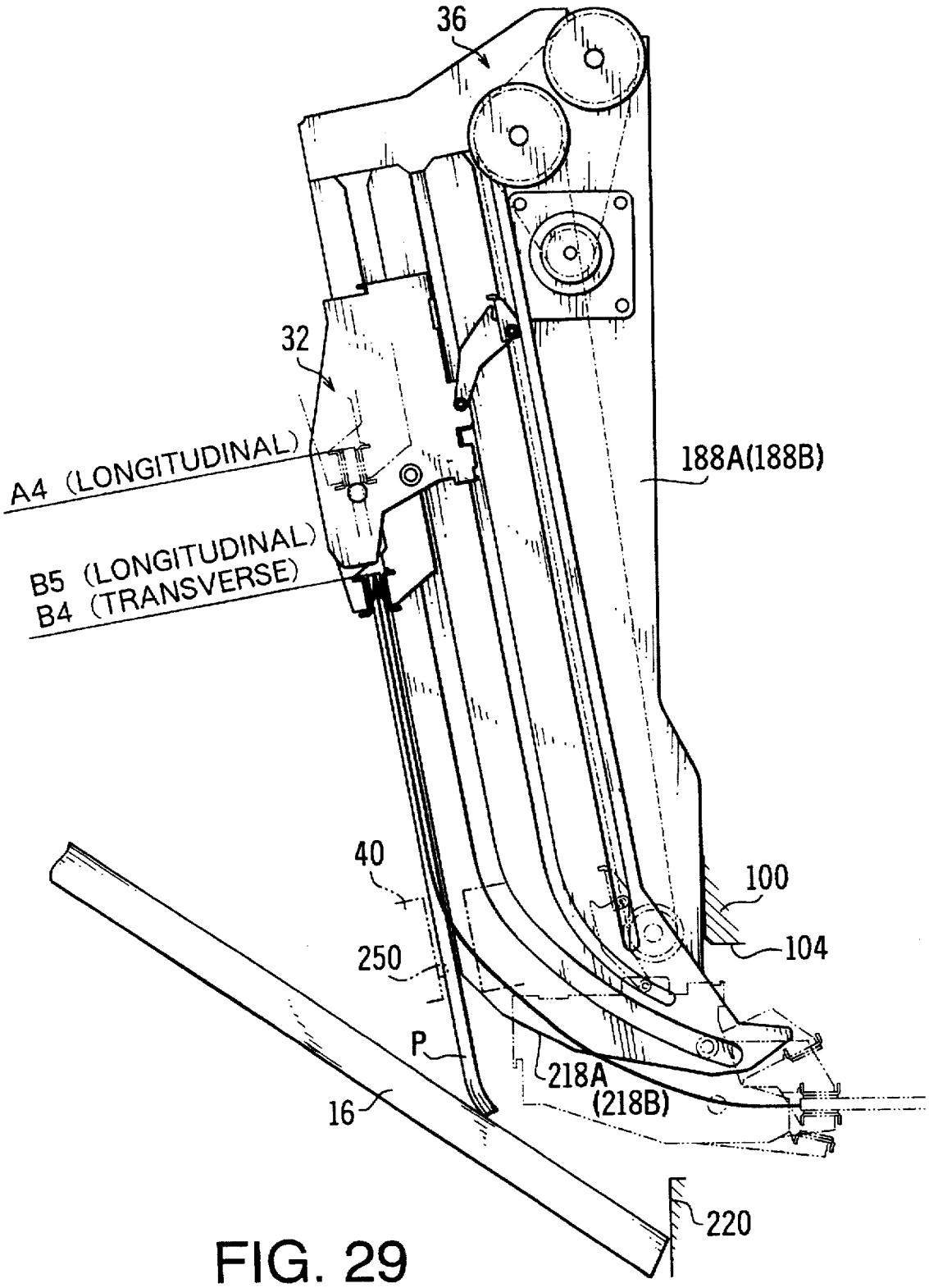
FIG. 29 is a side elevational view showing the manner in which the gripper mechanism has reached the lifted position while gripping a pile of sheets having a different size.

As described above, when the pile P of sheets S gripped by the gripper mechanism 32 is elevated to the lifted position, the trailing end of the pile P of sheets S is held in slight contact with the upper surface of the stacking tray 16 as shown in FIGS. 25 or 29. If the trailing end of the pile P of sheets S elevated to the lifted position were out of contact with the upper surface of the stacking tray 16, assuming that the sheets S are curved to displace the trailing end thereof away from the sheet post-treating apparatus 10, i.e., outwardly, due to the their given tendency to be so curved, then when the pile P of sheets S is lowered onto the stacking tray 16, the outwardly curved trailing end of the pile P of sheets S would not contact the upper surface of the stacking tray 16 in the manner shown in FIGS. 25 or 29, but would be oriented in the other direction and contact the stacking tray 16. As a result, the sheets S would be stacked in a bent condition on the stacking tray 16.

According to this embodiment, however, the trailing end of the pile P of sheets S is not lifted off the upper surface of the stacking tray 16 or the upper surface of a previously stacked pile P of sheets S on the stacking tray 16. Therefore, even when the sheets S tend to be curved outwardly, the sheets S are prevented from being stacked in a bent condition on the stacking tray 16, but are stacked in good conditions on the stacking tray 16.

As described above, after the gripper mechanism 32 is elevated to the lifted position, it is lowered until the trailing end of the pile P of sheets S abuts against the raised wall 220 of the stacking tray 16, and then releases the pile P of sheets S. If the gripper mechanism 32 released the pile P of sheets S in the position shown in FIGS. 25 or 29 before the trailing end of the pile P of sheets S abuts against the raised wall 220 of the stacking tray 16, the released pile P of sheets S would slide over the stacking tray 16 or a pile P of sheets S previously stacked on the stacking tray 16, and then stop by abutment against the raised wall 220. Due to different conditions in which the pile P of sheets is released and slides over the stacking tray 16, the pile P of sheets S would possibly be disoriented rather than sliding down straight in the direction opposite to the sheet removing direction Y. Therefore, the pile P of sheets S would be stacked on the stacking tray 16 or a previously stacked pile P of sheets S thereon in a direction across the sheet removing direction Y, so that the pile or piles P of sheets might not be neatly stacked on the stacking tray 16.

According to the illustrated embodiment, the movement of the pile P of sheets S until the trailing end thereof abuts against the raised wall 220 of the stacking tray 16 is controlled by the gripper mechanism 32 which grips the pile P of sheets S. Therefore, the pile P of sheets S can be stacked straight on the stacking tray 16 or a previously stacked pile P of sheets S in alignment therewith, and hence the pile or piles P of sheets can be neatly stacked on the stacking tray 16.

When the pile P of sheets S is moved by the gripper mechanism 32 until its trailing end is in abutment against the raised wall 220 of the stacking tray 16, the leading end portion of the pile P of sheets S is inclined at a certain angle to the vertical as shown in FIG. 26. Stated otherwise, the pile P of sheets S remains inclined with its upper leading end displaced outwardly, i.e., in the direction away from the front shield plate 100. When the pile P of sheets S is then released from the gripper mechanism 32 in the position shown in FIG. 26, the pile P of sheets S reliably falls onto the stacking tray 16, rather than toward the front shield plate 100. Consequently, the pile P of sheets S is stacked without fail on the stacking tray 16 or a previously stacked pile P of sheets S thereon.

(L) Stacking Tray 16

As shown in FIG. 1, the stacking tray 16 for stacking thereon a discharged pile P of sheets S removed from a sorting tray 14 is disposed on the front wall of the apparatus housing 20, i.e., positioned downstream of the sorting trays 14 with respect to the sheet removing direction Y, and is inclined such that its outer distal end is displaced outwardly of its lower proximal end. Stated otherwise, the stacking tray 16 is positioned directly below a pile P of sheets S that has been gripped by the gripper mechanism 21 moved to the lifted position, for stacking thereon the pile P of sheets S when it is released from the gripper mechanism 21.

Since the stacking tray 16 is inclined, the area thereof that is projected onto the floor on which the sheet post-treating apparatus 10 is installed, is relatively small, and hence the size of the apparatus housing 20 which accommodates the sheet post-treating apparatus 10 is relatively compact.

The stacking tray 16 is inclined at a constant angle, i.e., at an angle of about 45 degrees in the illustrated embodiment, and is vertically movable by the stacking tray lifting and lowering mechanism 38. When lowered into a lower position, the stacking tray 16 can hold a number of sheets S, e.g., 1000 sheets S, stacked thereon.

The raised wall 220 positioned for engagement with the trailing end of a pile P of sheets S is not integrally formed with the stacking tray 16, but is separate from the stacking tray 16 and positioned beneath the removal opening 104 in the front shield plate 100 which extends upwardly at the proximal end of the stacking tray 16, as shown in FIGS. 20 and 23 through 29.

Figure 30:
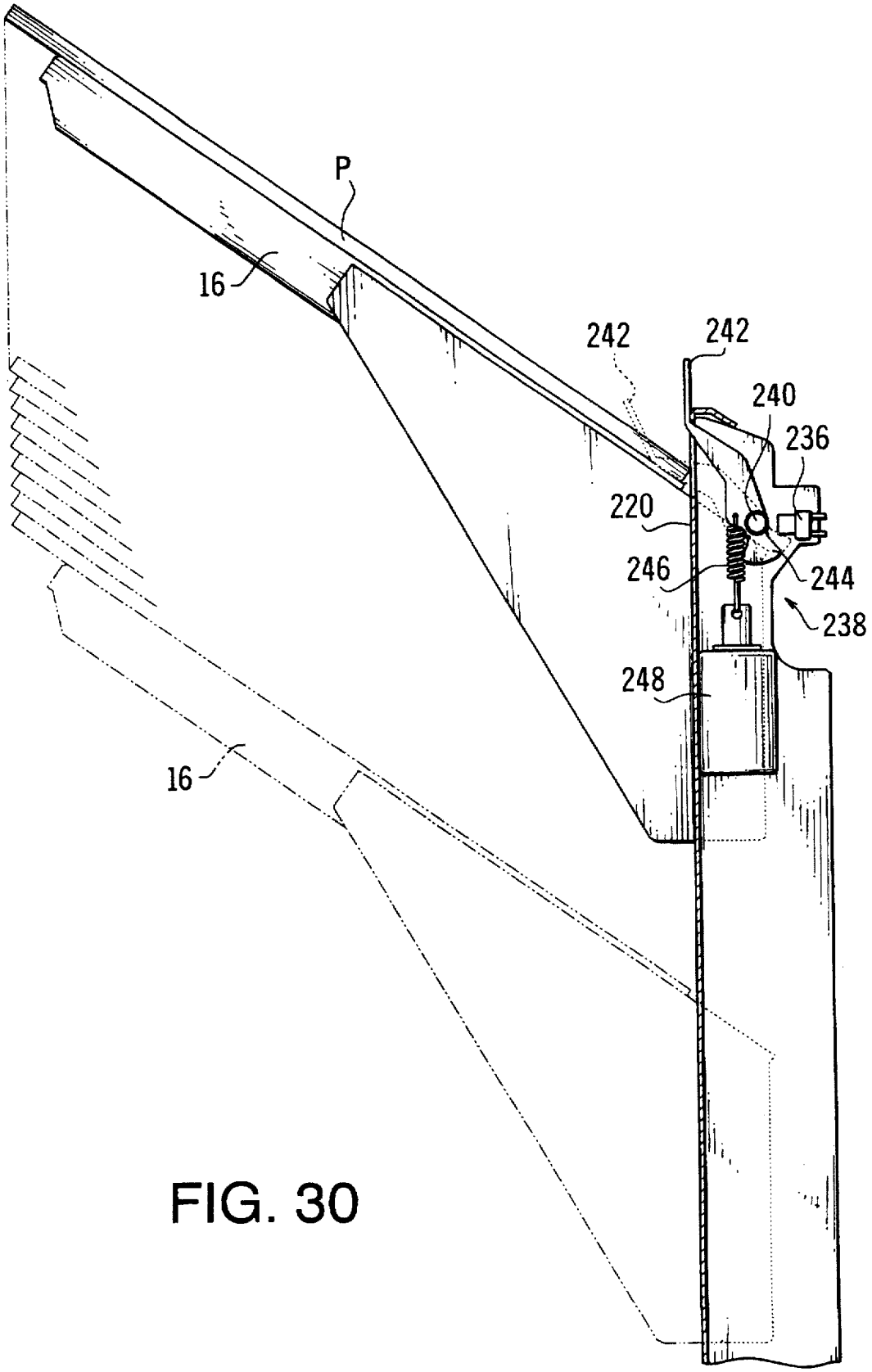
FIG. 30 is a side elevational view of a sheet pile presser mechanism for pressing a pile of sheets discharged onto the stacking tray.

As shown in FIG. 30, an empty sensor 222 for detecting when no sheet S is placed on the stacking sensor 16 is associated with the stacking tray 16. The empty sensor 222 is turned off when at least one sheet S is placed on the stacking tray 16, and turned on when no sheet S is placed on the stacking tray 16.

A space above the stacking tray 16, i.e., the path of the gripper mechanism 32, is shielded in its entirety by the front cover panel 50 when the stacking tray 16 is used, i.e., a pile or piles P of sheets S are stacked on the stacking tray 16. The gripper mechanism 32 is reciprocally moved between the gripping position and the lifted position for discharging a pile or piles P of sheets S. If the operator inadvertently stuck his hand into path of the gripper mechanism 32, the hand would possibly be injured by the gripper mechanism 32 which is being moved. According to the present invention, however, since the space above the stacking tray 16 is fully shielded by the front cover panel 50, the safety of the operator is secured.

The front cover panel 50 can be manually be opened and closed. However, the front cover panel 50 may automatically be closed by an actuator only when the gripper mechanism 32 is in operation.

(M) Stacking Tray Lifting and Lowering Mechanism 38

The stacking tray lifting and lowering mechanism 38 for vertically moving the stacking tray 16 between an upper limit position indicated by the solid lines in FIG. 30 and a lower limit position indicated by the two-dot-and-dash lines in FIG. 30, i.e., for adjusting the vertical position of the stacking tray 16, will be described below with reference to FIGS. 20, 30, and 31A through 31E.

M-1) Structure of Stacking Tray Lifting and Lowering Mechanism 38

As shown in FIG. 20, the stacking tray lifting and lowering mechanism 38 comprises a reversible drive motor 224, a drive gear 226 mounted coaxially on the output shaft of the drive motor 224, a driven gear 228 held in mesh with the drive gear 226, a drive pulley 230 coupled coaxially to the driven gear 228 and positioned slightly lower than the low limit position of the stacking tray 16, a driven pulley 232 rotatably disposed directly above the driven pulley 230 and positioned slightly higher than the upper limit position for the stacking tray 16, an endless timing belt 234 trained around the drive pulley 230 and the driven pulley 232, and a fastener (not shown) by which the proximal end of the stacking tray 16 is fixed to a portion of the timing belt 234.

The stacking tray lifting and lowering mechanism 38 also has an upper limit sensor 236 (see FIG. 30) for starting downward movement of the stacking tray 16. Based on a detected signal from the upper limit sensor 236, the control mechanism 44 energizes the drive motor 224 to lower the stacking tray 16.

The upper limit sensor 236 is provided to lower the stack tray 16 in order to keep at a constant height a stacking surface on which a pile P of sheets S is to be stacked, e.g., the upper surface of the stacking tray 16 if no pile P of sheets S is stacked thereon or the upper surface of a pile P of sheets S stacked on the stacking tray 16.

The stacking tray lifting and lowering mechanism 38 further has a lower limit sensor (not shown) which is turned on when the stacking tray 16 is lowered to the lower limit position. When the lower limit sensor is turned on, the control mechanism 44 turns off the drive motor 224 and turns on a warning lamp on a display panel 274 (see FIGS. 2 and 3) on a front area of the upper surface of the apparatus housing 20, indicating to the operator that it is no longer possible to discharge more sheets S onto the stacking tray 16.

M-2) Sheet Pile Pressing Mechanism 238

When a pile P of sheets S is removed from the sorting tray 14" in the sheet removal position as shown in FIGS. 24 and 25, if there is a previously stacked pile P of sheets S on the stacking tray 16, then the pile P of sheets which is being removed from the sorting tray 14" with its intermediate portion curved by being borne by the previously stacked pile P of sheets S on the stacking tray 16, as shown in FIG. 24, is held in frictional engagement with the previously stacked pile P of sheets S. As the pile P of sheets is removed from the sorting tray 14" by the gripper mechanism 32, the previously stacked pile P of sheets S on the stacking tray 16 is liable to be dragged in the sheet removing direction Y. Similarly, the pile P of sheets S which is being removed from the sorting tray 14" with its trailing end sliding on the upper surface of the previously stacked pile P of sheets S on the stacking tray 16 is also held in frictional engagement with the previously stacked pile P of sheets S when the pile P of sheets S is pulled upwardly by the gripper mechanism 32, as shown in FIG. 25.

If the previously stacked pile P of sheets S on the stacking tray 16 is dragged in the sheet removing direction Y due to such frictional engagement with the pile P of sheets S which is being removed from the sorting tray 14", then when the previously stacked pile P of sheets S is released out of frictional engagement with the pile P of sheets S which is being removed from the sorting tray 14", the previously stacked pile P of sheets S which is dragged in the sheet removing direction Y tends to slide back to its starting position on the stacking tray 16. However, due to different conditions in which the previously stacked pile P of sheet is released out of frictional engagement with the pile P of sheets S being removed from the sorting tray 14" and slides over the stacking tray 16, the previously stacked pile P of sheets S may possibly be disoriented rather than sliding down straight in the direction opposite to the sheet removing direction Y. Therefore, when the trailing end of the previously stacked pile P of sheets S abuts against he raised wall 220, it may be stacked on the stacking tray 16 or another previously stacked pile P of sheets S thereon in a direction across the sheet removing direction Y, so that the pile or piles P of sheets may not be neatly stacked on the stacking tray 16.

According to this embodiment, while a pile P of sheets S gripped by the gripper mechanism 32 is being removed in the sheet removing direction Y, any pile P of sheets S previously stacked on the stacking tray 16 is pressed down against the stacking tray 16 against accidental movement by a sheet pile pressing mechanism 238 (see FIG. 30).

As shown in FIG. 30, the sheet pile pressing mechanism 238 comprises a presser 242 disposed in the vicinity of the upper limit position for the stacking tray 16 and angularly movably supported on a central potion of a support shaft 240 extending in the sheet sorting direction X, the presser 242 having a distal end positioned for pressing down the trailing end of a pile P of sheets S stacked on the stacking tray 16, a mask 244 integrally formed with the other end of the presser 242 for turning on the upper limit sensor 236 upon movement across the upper limit sensor 236, a torsion spring (not shown) disposed around the support shaft 240 and having an end engaging the support shaft 240 and the opposite end engaging the presser 242 for normally urging the presser 242 to turn clockwise in FIG. 30, i.e., in a direction to turn away from the stacking tray 16, and a solenoid 248 connected through a coil spring 246 to the presser 242 for pulling the presser 242 counterclockwise about the support shaft 240 when energized.

M-3) Pressing Operation of Sheet Pile Pressing Mechanism 238

While the solenoid 248 is being de-energized by the control mechanism 44, the presser 242 is turned clockwise in FIG. 30 about the support shaft 240 away from the stacking tray 16 or a pile P of sheets S stacked thereon into a retracted position indicated by the solid lines in FIG. 30 under the bias of the torsion spring (not shown). When the solenoid 248 is energized by the control mechanism 44, the presser 242 is pulled by the solenoid 248 and turned counterclockwise in FIG. 30 about the support shaft 240 toward the stacking tray 16 against the bias of the torsion spring as indicated by the dotted lines in FIG. 30, resiliently pressing the upper surface of the stacking tray 15 if no sheets S have been previously stacked thereon or the upper surface of any pile P of sheets S previously stacked on the stacking tray 16, holding the previously stacked pile P of sheets S on the stacking tray 16.

As shown in FIG. 30, the upper limit sensor 236 is selected such that when no sheets S are discharged on the stacking tray 16 in the upper limit position, the presser 242 is resiliently pressed against the upper surface of the stacking tray 16 by energization of the solenoid 248, moving across and hence turning on the upper limit sensor 236. The upper limit sensor 236 comprises a photointerrupter composed of a light-emitting element (e.g., LED) and a photodetector (e.g., PT). The upper limit sensor 236 is turned on then the mask 244 moves across and hence interrupts a light path between the light-emitting element and the photodetector, and turned off when light path between the light-emitting element and the photodetector is not interrupted.

M-4) Vertical Movement of Stacking Tray 16 in Combination with Pressing Operation of Sheet Pile Pressing Mechanism 238

Vertical movement of the stacking tray 16 with the stacking tray lifting and lowering mechanism 38 in combination with pressing operation of the sheet pile pressing mechanism 238 to press a pile P of sheets S stacked on the stacking tray 16 will be described below with reference to FIGS. 31A through 31E.

For lifting the stacking tray 16 up to the upper limit position, the control mechanism 44 reads a detected output signal from the empty sensor 222. If the empty sensor 222 is turned on, indicating that no sheet S is present on the stacking tray 16, the control mechanism 44 energizes the solenoid 248 to turn the presser 242 counterclockwise into pressing engagement with the upper surface of the stacking tray 16. Upon such pressing operation, if the upper limit sensor 236 is turned on by the mask 244, the control mechanism 44 judges the stacking tray 16 as being already in the upper limit position, and keeps the stacking tray 16 in the upper limit position.

Figure 31A:
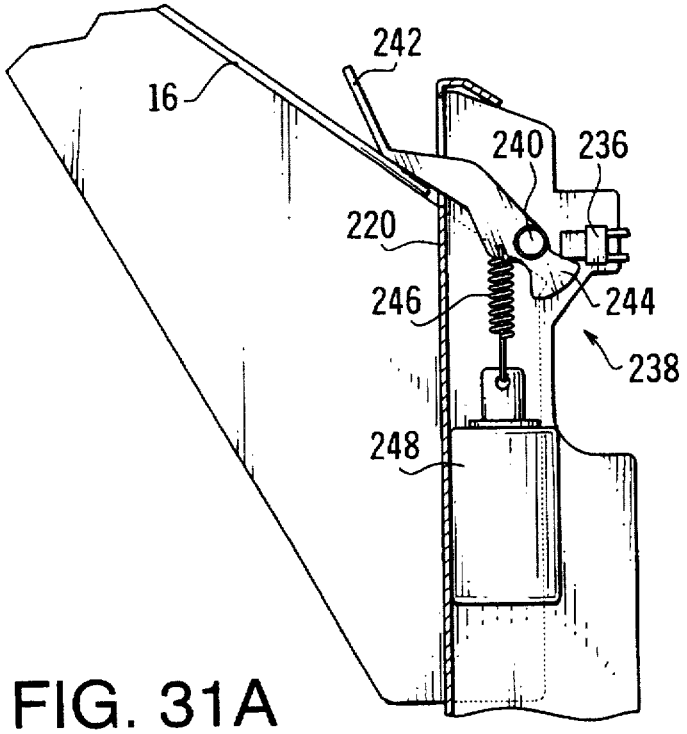
FIG. 31A is a side elevational view of the sheet pile presser mechanism with no pile of sheets placed on the stacking tray.

If the upper limit sensor 236 is turned off, the control mechanism 44 judges the stacking tray 16 as being in a position lower than the upper limit position, the control mechanism 44 energizes the drive motor 224 to elevate the stacking tray 16. When the stacking tray 16 is elevated, the presser 242 is turned clockwise. When the mask 244 moves across the light path of the upper limit sensor 236, turning on the upper limit sensor 236, the control mechanism 44 judges the stacking tray 16 as reaching the upper limit position. The control mechanism 44 de-energizes the drive motor 224, and keeps the stacking tray 16 in the upper limit position. Now, the stacking tray 16 is located in the upper limit position as shown in FIG. 31A.

Figure 31B:
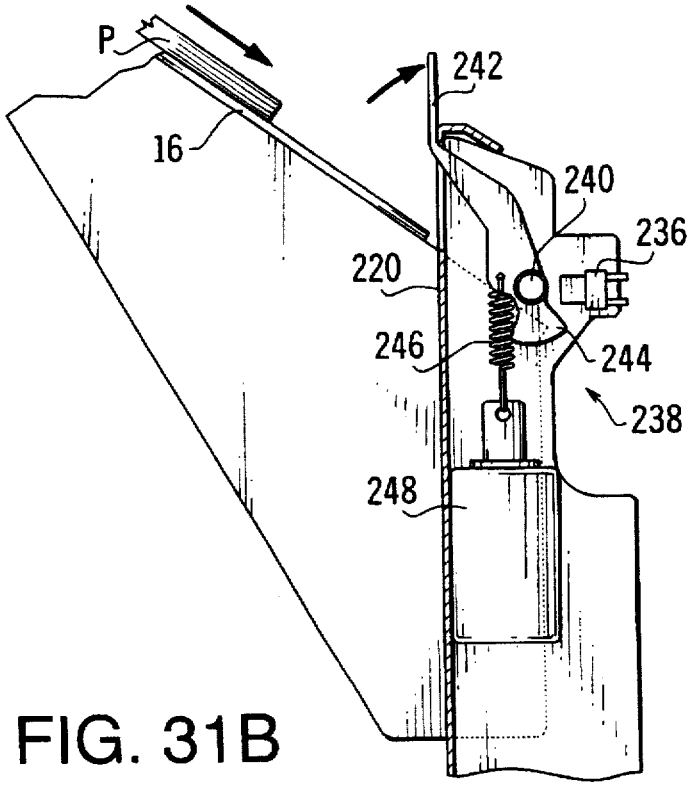
FIG. 31B is a side elevational view of the sheet pile presser mechanism with its solenoid energized.

When the stacking tray 16 is located in the upper limit position, the control mechanism 44 de-energizes the solenoid 248. As shown in FIG. 31B, the presser 242 is turned clockwise away from the stacking tray 16 under the bias of the torsion spring, readying the stacking tray 16 to receive a discharged pile P of sheets S.

Figure 31C:
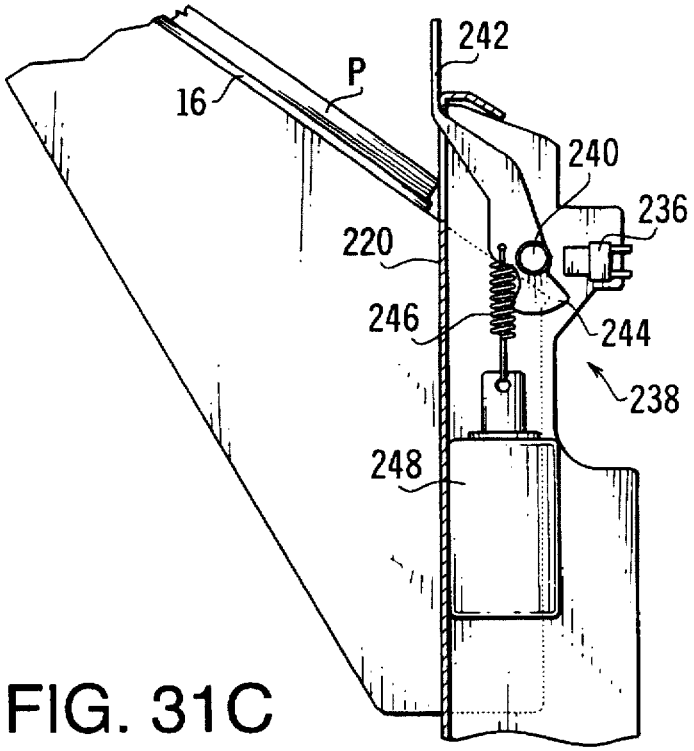
FIG. 31C is a side elevational view of the sheet pile presser mechanism with a pile of sheets placed on the stacking tray.
Figure 31D:
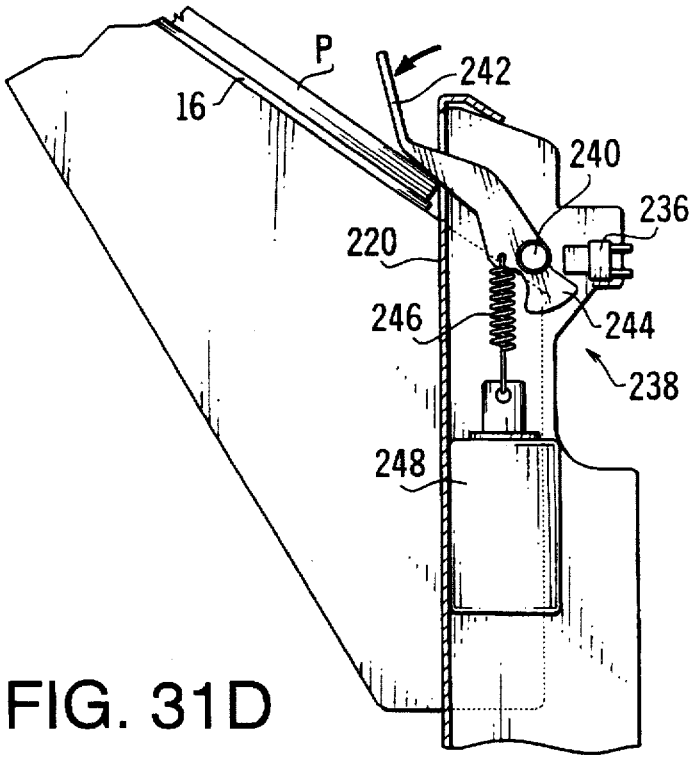
FIG. 31D is a side elevational view of the sheet pile presser mechanism with its sheet presser pressing an upper surface of the pile of sheets placed on the stacking tray.

Thereafter, a pile P of sheets S is discharged from the sorting tray 14" in the sheet removal position by the gripper mechanism 32 actuated by the gripper actuating mechanism 36, and stacked as a first pile P of sheets S on the stacking tray 16 as shown in FIG. 31C. When the stacking of the first pile P of sheets S on the stacking tray 16 is finished, a next pile P of sheets S starts being removed. When the removal of the next pile P of sheets S is initiated, the control mechanism 44 energizes the solenoid 248, turning the presser 242 counterclockwise until it presses the stacked pile P of Sheets S against the stacking tray 16. The stacked pile P of sheets S on the stacking tray 16 is now immovably held on the stacking tray 16 by the presser 242.

Simultaneously with the energization of the solenoid 248, the control mechanism 44 reads a detected output signal from the upper limit sensor 236. If the upper limit sensor 236 is turned off, then the control mechanism 44 energizes the drive motor 224 to lower the stacking tray 16. As the stacking tray 16 is lowered, the presser 242 is turned counterclockwise. When the mask 224 interrupts the light path of the upper limit sensor 236, turning on the upper limit sensor 236, the control mechanism 44 de-energizes the drive motor 224, keeping the stacking tray 16 in the stopped position, as shown in FIG. 31E.

Figure 31E:
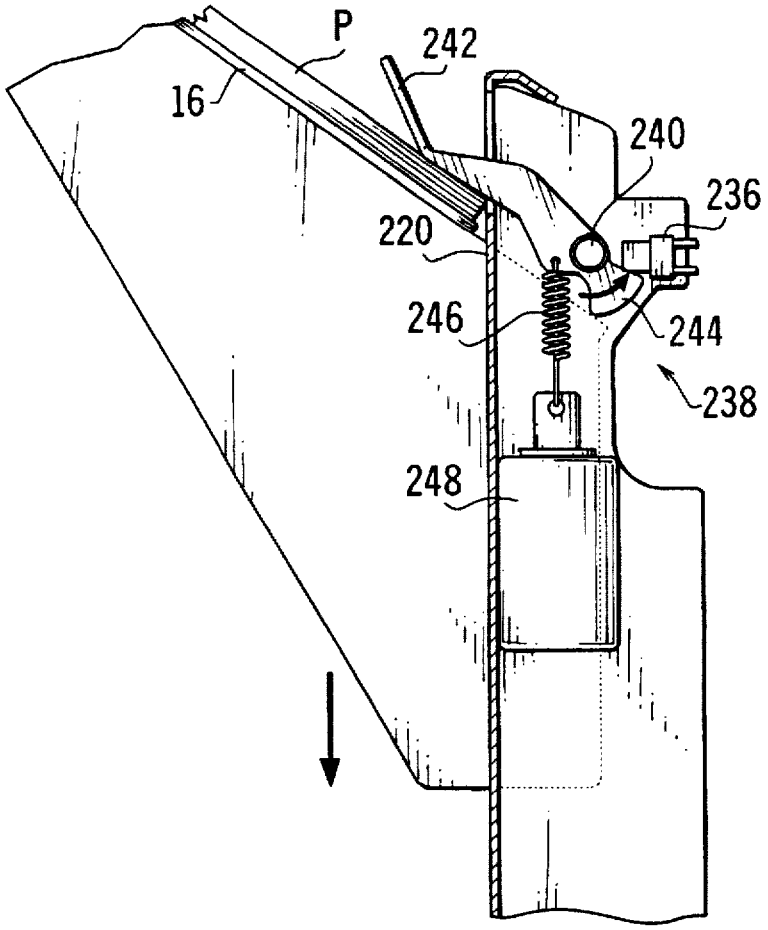

In the position shown in FIG. 31E, the upper surface of the pile P of sheets S on the stacking tray 16 is in the same vertical position as the upper surface of the stacking tray 16 which is in the upper limit position shown in FIG. 31A. Thereafter, when piles P of sheets S are successively stacked on the stacking tray 16, the above process is repeated to successively lower the stacking tray 16 depending on the number of stacked piles P of sheets S. Consequently, the upper surface of the uppermost pile P of sheets S on the stacking tray 16 is in the same vertical position as the upper surface of the stacking tray 16 which is in the upper limit position shown in FIG. 31A.

Inasmuch as the upper surface of the uppermost pile P of sheets S on the stacking tray 16 remains in the same vertical position at all times when a next pile P of sheets S is removed from the sorting tray 14 in the sheet removal position, the control mechanism 44 is required to determine the lifted position for the gripper mechanism 32 based on only the length of the sheets S in the sheet removing direction Y. Therefore, the control operation of the control mechanism 44 to lift the gripper mechanism 32 is simplified, and the trailing end of the pile P of sheets S gripped by the gripper mechanism 32 elevated to the lifted position remains in contact with the upper surface of the stacking tray 16 or the upper surface of the uppermost pile P of sheets S stacked on the stacking tray 16.

When a next pile P of sheets S is removed in frictional engagement with the upper surface of the pile P of sheets S already stacked on the stacking tray 16, the previously stacked pile P of sheets S is prevented from disturbed in attitude by the next pile P of sheets S being removed. Accordingly, piles P of sheets S can neatly and stably be stacked on the stacking tray 16.

(N) Stapling Mechanism 40

As shown in FIGS. 1, 8, and 20, the stapling mechanism 40 is disposed in a position where a pile P of sheets S pulled from the sorting tray 14" in the sheet removal position in the sheet removing direction Y starts being gradually oriented upwardly along the curved path to travel along the straight path up to the lifted position. The stapling mechanism 40 is of a known structure, and hence will not be described in detail. The stapling mechanism 40 has its stapling passage 250 extending along the feed path of the pile P of sheets S and defined in a side surface of a mechanism body which faces the feed path. The stapling mechanism 40 is arranged to drive one stable (not shown), at a time, into the pile P of sheets passing through the stapling passage 250, binding the pile P of sheets S.

The stapling mechanism 40 is movable by the stapling mechanism moving mechanism 42 between a stapling position in which the stapling passage 250 is positioned in the feed path for allowing the pile P of sheets S moving along the feed path to pass through the stapling passage 250, and a retracted position in which the stapling passage 250 is retracted from the feed path.

The stapling mechanism 40 is positioned in a lower portion of the straight path of the pile P of sheets S which will be moved obliquely upwardly. For stapling a pile P of sheets S at two positions thereon while the pile P of sheets S is being gripped and fed by the gripper mechanism 32, the stapling mechanism 40 drives a first staple into a downstream straight edge portion of the pile P with respect to the feed path thereof, and thereafter, after the pile P of sheets S has traveled a certain distance along the feed path, drives a second stable into an upstream straight edge portion of the pile P which lies in the same plane as the downstream straight edge portion that has already been stapled by the first staple. Therefore, the stapling mechanism 40 can staple the straight edge of the pile P of sheets S with two successive staples at respective positions spaced along the straight edge of the pile P of sheets S. Inasmuch as the pile P of sheets S is not required to move back along the feed path but is required to move in one direction up to the lifted position when it is stapled, the time required to discharge the pile P of sheets is not shortened by the stapling process, and the entire operating time of the sheet post-treating apparatus 10 is relatively short.

If two staples were driven into curved edge portions of a pile P of staples S, then an intermediate portion of the pile P of stables S between the stapled edge portions would unduly bulge when the stapled pile P of sheets S is subsequently placed on a flat surface, a condition which would not be preferable. Such a condition can be avoided by driving a first staple into an upstream edge portion of the pile P of sheets S with respect to the feed path thereof, they moving back the pile P of sheets S, driving a second staple into a downstream edge portion of the pile P of sheets S, and then moving the pile P of sheets S bound by the two staples up to the lifted position. However, this process necessarily increases the operating time of the sheet post-treating apparatus 10 because the pile P of sheets S has to be moved back once.

(O) Stapling Mechanism Moving Mechanism 42

The stapling mechanism moving mechanism 42 for moving the stapling mechanism 40 between the stapling position and the retracted position will be described below with reference to FIG. 20.

The stapling mechanism moving mechanism 42 comprises a reversible drive motor 256 mounted on a support base 254, a worm gear 258 coupled to the output shaft of the drive motor 256 for rotation about a horizontal axis, a worm wheel 260 held in mesh with the worm gear 258 and rotatably supported on the support base 254 for rotation about a vertical axis, a circular groove 262 defined in an upper surface of the worm wheel 260 eccentrically with respect to the axis of the worm wheel 260, a swing arm 268 supporting on one end a downwardly extending cam pin 264 fitted in the circular groove 262 and on the other end an attachment shaft 266 extending vertically through and fixed to the stapling mechanism 40, and an attachment stay 270 extending integrally from the support base 254 and having a distal end on which an upper end of the attachment shaft 266 is angularly movably supported.

The attachment shaft 266 has its lower end angularly movably supported on the support base 154. The support base 254 is supported on a horizontal support shaft 272 for angular movement thereabout. When in an operative position, the support base 254 is fixed in a horizontal position shown in FIG. 20 to the support shaft 272 by a lock mechanism (not shown). To supply staples to the stapling mechanism 40, the support base 254 is unlocked by the lock mechanism, and turned about the support shaft 272 into a position where staples can easily be loaded into the stapling mechanism 40. Therefore, the stapling mechanism 40 can easily be supplied with additional staples.

When the control mechanism 44 energizes the drive motor 256 to rotate in one direction, the worm wheel 260 is turned clockwise in FIG. 20, causing the cam pin 264 fitted in the eccentric circular groove 262 to swing the swing arm 268 clockwise about the attachment shaft 266. As a consequence, the stapling mechanism 40 secured to the attachment shaft 266 supported on the swing arm 268 is turned clockwise from the stapling position shown in FIG. 20 to the retracted position.

To turn the stapling mechanism 40 from the retracted position to the stapling position, the control mechanism 44 energizes the drive motor 256 to rotate in the opposite direction. The cam pin 264 moves back to its starting position in the circular groove 262, and the swing arm 268 also moves back to its starting position, until the stapling mechanism 40 is turned from the retracted position to the stapling position.

(P) Jogging Process and Stapling Process Controlled by Control Mechanism 44

As shown in FIG. 32, the control mechanism 44 for controlling the sheet post-treating apparatus 10 in its entirety is electrically connected to the various mechanisms 22, 24, 28, 30, 32, 34, 36, 38, 40, 42 and also to the display panel 274. The control mechanism 44 outputs various control signals to the mechanisms 22, 24, 28, 30, 32, 34, 36, 38, 40, 42 and also to the display panel 274, and receives various detected output signals from these mechanisms. The control mechanism 44 is also connected to the electrophotographic copying apparatus 1000 through a communication path for receiving various items of information, such as sheet size information, sheet count information, etc., therefrom which will be required for post-treating sheets S in the sheet post-treating apparatus 10.

The control operation of the control mechanism 44 for controlling the various mechanisms at the time no jogging process and no stapling process are effected has been described above. Control operation of the control mechanism 44 for controlling the various mechanisms at the time a jogging process and a stapling process are carried out will be described below with reference to FIGS. 33A through 33F.

Feeding of sheets S in the non-sorting process of the sheet post-treating apparatus 10, and distribution and stacking of sheets S on a plurality of stacking trays 14 in the sorting mode or the grouping mode in the sorting process are known in the art, and will not be described below.

P-1) Control Operation in Stapling Process

Figure 33A:
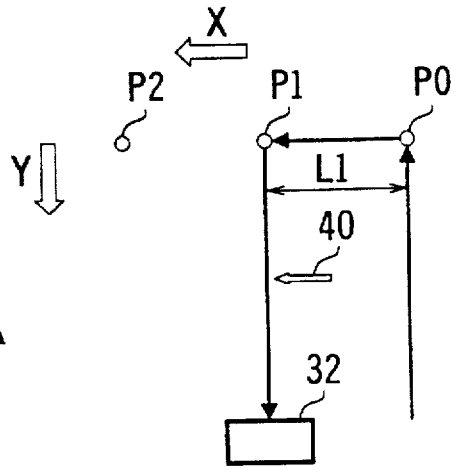
FIG. 33A is a skeleton diagram schematically showing the removal by the gripper mechanism of a pile of sheets from a sheet removal position (first jogging position)

As shown in FIG. 33A, when the control mechanism 44 is instructed to carry out a stapling process, the control mechanism 44 actuates the stapling mechanism moving mechanism 42 to move the stapling mechanism 40 from the retracted position to the stapling position. The control mechanism 44 also actuates the jogging mechanism 34 to move the gripper unit 138 to the home position P0, opens the upper and lower grippers 152, 154 away from each other, and moves the gripper mechanism 32 from the standby position to the gripping position. The control mechanism 44 further operates the swinging mechanism 156 of the gripper mechanism 32 to close the upper and lower grippers 152, 154 toward each other for thereby gripping the area (leading end) of a pile P of sheets S which lies over the first recess 68*a* of the sorting tray 14" in the sheet removal position.

Thereafter, the control mechanism 44 operates the jogging mechanism 34 to move the gripper unit 138 the first distance L1 in the sheet sorting direction X from the home position P0 to the sheet removal position P1. The control mechanism 44 then operates the gripper actuating mechanism 36 to move the gripper mechanism 32 in the sheet removing direction Y. The pile P of sheets S whose leading end is gripped by the gripper mechanism 32 is now removed in the sheet removing direction Y from the sorting tray 14" in the sheet removal position, and thereafter pulled in the upward direction Z along the curved path to the lifted position. While the pile P of sheets S is being thus pulled in the upward direction Z, one side edge of the pile P of sheets S passes through the stapling passage 250 of the stapling mechanism 40.

When the leading end of the pile P of sheets S has moved a first predetermined distance after it has left or entered the stapling passage 250, the control mechanism 44 stops the gripper actuating mechanism 36, and operates the stapling mechanism 40 to drive a staple into the side edge of the pile P of sheets S. The pile P of sheets S is now bound together by one staple. The first predetermined distance that the leading end of the pile P of sheets S has moved varies from sheet size to sheet size, and also differs for different stapling modes, i.e., a stapling mode for stapling a pile P of sheets S with one staple and a stapling mode for stapling a pile P of sheets S with two staples, even if the sheets are of the same size in those different stapling modes.

Thereafter, if a one-staple driving mode for stapling a pile P of sheets S with one staple is selected in the stapling process, then the control mechanism 44 operates the gripper actuating mechanism 36 to lift the gripper mechanism 32 to the position shown in FIG. 25 or 29, and to cause the gripper mechanism 32 to discharge a pile P of sheets S removed from the sorting tray 14" in the sheet removal position onto the stacking tray 16.

If a two-staple driving mode for stapling a pile P of sheets S with two staples is selected in the stapling process, then after the first stable has been driven and the leading end of the pile P of sheets S has moved a second predetermined distance depending on the size of the sheet S, the control mechanism 44 stops the gripper actuating mechanism 36, and operates the stapling mechanism 40 to drive a second staple into the side edge of the pile P of sheets S. The pile P of sheets S is now bound more firmly together by two staples than by one staple. When the driving of the second staple is finished, the control mechanism 44 returns the gripper mechanism 32 downwardly back to the position shown in FIG. 26. In this embodiment, the vertical position of the stapling mechanism 40 is selected such that the trailing end of the pile P of sheets S is positioned as shown in FIG. 25 when the second staple is driven into the pile P of sheets S.

When the stapling process is carried out, no jogging process is performed. Therefore, the stapling and jogging processes are not carried out simultaneously. Stated otherwise, stapled piles P of sheets S are stacked in alignment with each other on the stacking tray 16 at the same position thereon, and are not staggered with respect to each other on the stacking tray 16.

P-2) Control Operation in Jogging Process

When the control mechanism 44 is instructed to carry out a jogging process, the control mechanism 44 actuates the stapling mechanism moving mechanism 42 to move the stapling mechanism 40 from the stapling position to the retracted position. The control mechanism 44 also actuates the jogging mechanism 34 to move the gripper unit 138 to the home position P0, opens the upper and lower grippers 152, 154 away from each other, and moves the gripper mechanism 32 from the standby position to the gripping position as shown in FIG. 33A. The control mechanism 44 further operates the swinging mechanism 156 of the gripper mechanism 32 to close the upper and lower grippers 152, 154 toward each other for thereby gripping the area (leading end) of a pile P of sheets S which lies over the first recess 68*a* of the sorting tray 14" in the sheet removal position.

Thereafter, the control mechanism 44 operates the jogging mechanism 34 to move the gripper unit 138 the first distance L1 in a jogging direction, i.e., the sheet sorting direction X, from the home position P0 to the first jogging position, i.e., the sheet removal position, P1. The control mechanism 44 then operates the gripper actuating mechanism 36 to move the gripper mechanism 32 in the sheet removing direction Y. The pile P of sheets S whose leading end is gripped by the gripper mechanism 32 is now removed in the sheet removing direction Y from the sorting tray 14", which is an odd-numbered sorting tray, in the sheet removal position, and thereafter pulled in the upward direction Z along the curved path to the lifted position. Thereafter, the control mechanism 44 controls the gripper actuating mechanism 36 to lift the gripper mechanism 32 to the position shown in FIGS. 25 or 29, and to cause the gripper mechanism 32 to discharge the pile P of sheets S removed from the sorting tray 14" in the sheet removal position onto the stacking tray 16 at a position thereon which corresponds to the first jogging position P1.

Figure 33B:
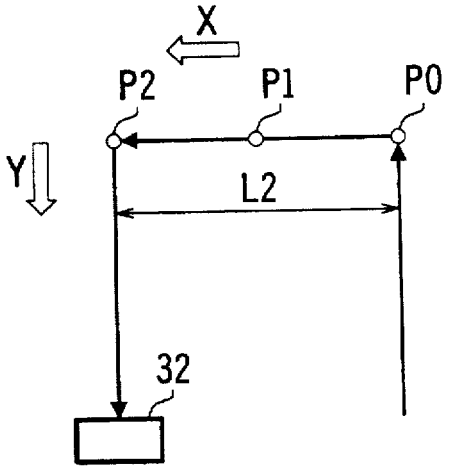
FIG. 33B is a skeleton diagram schematically showing the removal by the gripper mechanism of the pile of sheets from a jogging position (second jogging position)

Then, the control mechanism 44 operates the sorting tray actuating mechanism 24 to rotate the four lead screw rods 80A, 80B, 80C, 80D by one revolution to move (lift or lower) an even-numbered sorting tray 14, positioned directly below the sorting tray 14", into the sheet removal position. Thereafter, the control mechanism 44 actuates the jogging mechanism 34 to move the gripper unit 138 to the home position P0 as shown in FIG. 33B, and also moves the gripper mechanism 32 from the standby position to the gripping position S. The control mechanism 44 also operates the swinging mechanism 156 of the gripper mechanism 32 to close the upper and lower grippers 152, 154 toward each other for thereby gripping the area (leading end) of a pile P of sheets S which lies over the first recess 68*a* of the sorting tray 14" in the sheet removal position.

Thereafter, the control mechanism 44 operates the jogging mechanism 34 to move the gripper unit 138 the second distance L2 in the jogging direction, i.e., the sheet sorting direction X, from the home position P0 to the second jogging position P2. The control mechanism 44 then operates the gripper actuating mechanism 36 to move the gripper mechanism 32 in the sheet removing direction Y. The pile P of sheets S whose leading end is gripped by the gripper mechanism 32 is now removed in the sheet removing direction Y from the sorting tray 14" in the sheet removal position, and thereafter pulled in the upward direction Z along the curved path to the lifted position. Thereafter, the control mechanism 44 controls the gripper actuating mechanism 36 to lift the gripper mechanism 32 to the position shown in FIGS. 25 or 29, and to cause the gripper mechanism 32 to discharge the pile P of sheets S removed from the sorting tray 14" in the sheet removal position onto the stacking tray 16 at a position thereon which corresponds to the second jogging position P2.

Figure 33C:
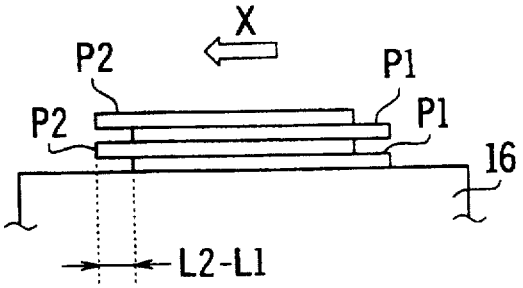
FIG. 33C is a view schematically showing a stack of piles of sheets placed on the stacking tray by a jogging process.
Figure 33D:
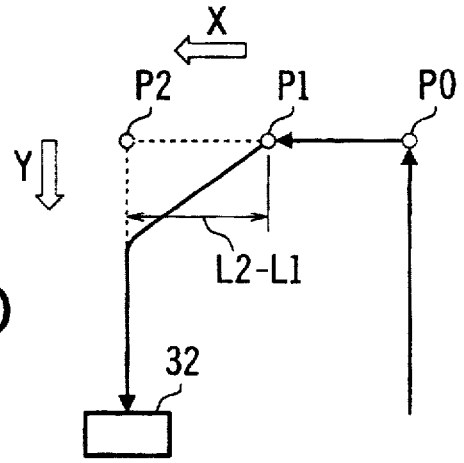
FIG. 33D is a skeleton diagram schematically showing a first modification for the removal by the gripper mechanism of the pile of sheets from the jogging position (second jogging position)

Each time a next sorting tray 14 is shifted to the sheet removal position and a pile P of sheets S is removed from this sorting tray 14, the control mechanism 44 causes the gripper mechanism 32 to discharge the pile P of sheets S from a position that alternates between the first jogging position P1 and the second jogging position P2. Therefore, as shown in FIG. 33C, piles P of sheets S are discharged onto the stacking tray 16 at alternate positions corresponding to the first and second jogging positions P1, P2, and stacked successively upwardly while being alternately staggered by a distance corresponding to (L2–L1) in the jogging direction, i.e., the sheet sorting direction X.

In the event that the stapling mechanism 40 runs out of any staples while in the stapling process, the jogging process will subsequently be automatically performed to stagger individual piles P of sheets S, which are not stapled, on the stacking tray 16, so that the operator can easily recognize the staggered piles P of sheets S on the stacking tray 16.

Modifications

The sheet post-processing apparatus 10 can be modified in a variety of ways.

In the illustrated embodiment, the sheet post-processing apparatus 10 is combined with the electrophotographic copying apparatus 1000. However, the sheet post-processing apparatus 10 may be used with any of various image forming apparatus for discharging sheets with images formed thereon, such as printers, facsimile machines, etc.

While the sheet sorting direction X and the sheet removing direction Y are illustrated as extending perpendicularly to each other in the illustrated embodiment, the principles of the present invention are applicable to a sheet post-treating apparatus in which the sheet sorting direction X and the sheet removing direction Y extend parallel to each other. The sheet sorting direction X and the sheet removing direction Y may cross each other at an angle other than 90°.

In the jogging process, piles P of sheets S are jogged in a direction parallel the sheet sorting direction X, i.e., perpendicular to the sheet removing direction Y according to the illustrated embodiment. However, piles P of sheets S may be jogged in a direction crossing or perpendicular to the sheet sorting direction X, or in a direction crossing the sheet removing direction Y at an angle other than 90°.

In the illustrated embodiment, the standby position, indicated by the two-dot-and-dash lines in FIG. 23, for the gripper mechanism 32 is at the same height as the retracted position, indicated by the solid lines in FIG. 27, for the gripper mechanism 32. However, the standby and retracted positions for the gripper mechanism 32 may be at different heights, respectively.

In the jogging process according to the illustrated embodiment, a pile P of sheets S which is removed from an odd-numbered sorting tray 14" in the sheet removal position is discharged at the first jogging position P1, and a pile P of sheets S which is removed from an even-numbered sorting tray 14" in the sheet removal position is discharged at the second jogging position P1. However, a pile P of sheets S which is removed from an even-numbered sorting tray 14" in the sheet removal position may be discharged at the first jogging position P1, and a pile P of sheets S which is removed from an odd-numbered sorting tray 14" in the sheet removal position may be discharged at the second jogging position P1.

In the illustrated embodiment, a pile P of sheets S removed from the sorting tray 14" in the sheet removal position fully leaves the sorting tray 14" and is discharged onto the stacking tray 16. However, a pile P of sheets whose leading end is griped by the gripper mechanism 32 may be drawn with its trailing end remaining on the sorting tray 14" in the sheet removal position, then stapled by the stapling mechanism 40, and then returned onto the sorting tray 14" again. According to such a modification, the stacking tray 16 is not employed, and the sorting trays 14 function as discharge trays.

In the illustrated embodiment, after gripping a pile P of sheets S, the gripper mechanism 32 is moved the distance L1 in the sheet sorting direction X in order to avoid physical interference with the lead screw rod 80A. However, if the lead screw rod 80A is positioned out of physical interference with a pile P of sheets as it is removed in the sheet removing direction Y, then the home position P0 and the sheet removal position, i.e., the first jogging position P1, may be defined as the same position.

In the illustrated embodiment, the gripper mechanism 32 which has griping a pile P of sheets S on the sorting tray 14" in the sheet removal position is moved from the home position P0 directly to the sheet removal position or first jogging position P1 in the sheet sorting direction X. However, when the gripper mechanism 32 is moved from the home position P0, it may be slightly drawn in the sheet sorting direction Y until it clears the first recess 68*a* defined in the support plate 68 of the sorting tray 14.

When the gripper mechanism 32 is slightly drawn in the sheet sorting direction Y upon movement from the home position P0, the upstream end of the pile P of sheets S with respect to the sheet sorting direction X is brought out of physical interference with the lead screw rod 80A, and the gripper mechanism 32 is also brought out of physical interference with the downstream end of the first recess 68a with respect to the sheet sorting direction X. However, the gripper mechanism 32 does not need to be slightly drawn if the leading end of the pile P of sheets S gripped by the gripper mechanism 32 is positioned forwardly of the first recess 68a in the direction toward the stacking tray 16, or if the size of the first recess 68a in the sheet sorting direction X is greater than the area in which the gripper mechanism 32 moves in gripping the pile P of sheets S.

In the illustrated embodiment, for removing a pile P of sheets S from the second jogging position P2 in the jogging process, the jogging mechanism 34 is first operated to move the gripper mechanism 32 from the home position P0 to the second jogging position P2 in the jogging direction or the sheet sorting direction X, and then the gripper actuating mechanism 36 is operated to move the gripper mechanism 32 in the sheet removing direction Y. However, according to a first modification shown in FIG. 33D, when the gripper mechanism 32 moved by the jogging mechanism 34 passes through the first jogging position P1 on its movement from the home position P0 in the jogging direction or the sheet sorting direction X, the gripper actuating mechanism 36 may also be operated to move the gripper mechanism 32 in the sheet removing direction Y. Therefore, while the gripper mechanism 32 is moving from the first jogging position P1 to the second jogging position P2 by the distance (L2–L1) in the sheet sorting direction X, the gripper mechanism 32 is also drawn in the sheet removing direction Y.

The above first modification is effective in shorting the period of time needed to remove a pile P of sheets S from the sorting tray 14" in the sheet removal position.

Figure 33E:
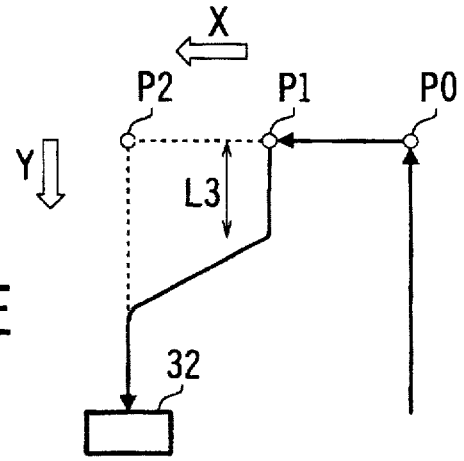
FIG. 33E is a skeleton diagram schematically showing a second modification for the removal by the gripper mechanism of the pile of sheets from the jogging position (second jogging position)

According to a second modification shown in FIG. 33E, for removing a pile P of sheets S from the second jogging position P2, when the gripper mechanism 32 moved by the jogging mechanism 34 passes through the first jogging position P1 on its movement from the home position P0 in the jogging direction or the sheet sorting direction X, the jogging mechanism 34 is inactivated, and the gripper actuating mechanism 36 is operated to move the gripper mechanism 32 in the sheet removing direction Y. When the gripper mechanism 32 has moved a third distance L3 in the sheet removing direction Y, the jogging mechanism 34 is actuated again to move the gripper mechanism 32 simultaneously in the jogging direction or the sheet sorting direction X and the sheet removing direction Y.

The third distance L3 may be set to a value that is large enough to cause the trailing end of the pile P of sheets S to be removed outwardly in the sheet removing direction Y from the sorting tray 14" in the sheet removal position. With the third distance L3 being thus selected, when the pile P of sheets S is being moved in the jogging direction on the sorting tray 14" in the sheet removal position, any torque applied to the gripped area of the pile P of sheets S by the gripper mechanism 32 is minimized, effectively reducing any changes in the attitude of the pile P of sheets S being jogged with respect to the gripper mechanism 32.

Figure 33F:
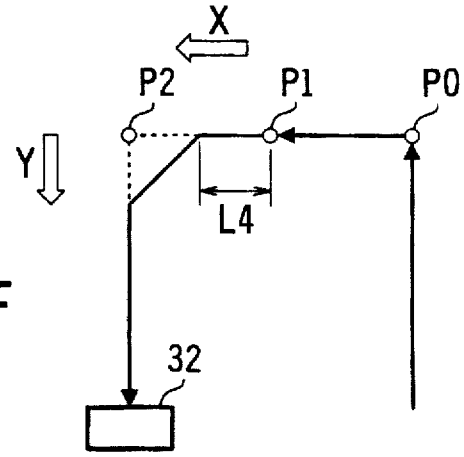
FIG. 33F is a skeleton diagram schematically showing a second modification for the removal by the gripper mechanism of the pile of sheets from the jogging position (second jogging position).

FIG. 33F shows a third modification which may be employed for removing a pile P of sheets S from the second jogging position P2. According to the third modification, when the gripper mechanism 32 moved by the jogging mechanism 34 has traveled a fourth distance L4 {L4<(L2–L1)} after having passed through the first jogging position P1 on its movement from the home position P0 in the jogging direction or the sheet sorting direction X, the gripper actuating mechanism 36 is operated to move the gripper mechanism 32 also in the sheet removing direction Y.

According to the third modification, the period of time required to remove a pile P of sheets from the sorting tray 14" in the sheet removal position may be shorter than the period of time required to remove a pile P of sheets from the sorting tray 14" in the illustrated embodiment.

Although certain preferred embodiments of the present invention have been shown and described in detail, it should be understood that various changes and modifications may be made therein without departing from the scope of the appended claims.

What is claimed is:

1. A method of post-treating sheets with images recorded thereon which are discharged from an image forming apparatus, said method comprising the steps of:

(a) stacking sheets onto a sorting tray which is positioned in a sheet receiving position and a posture of which is brought into a first posture;

(b) changing the posture of at least a sorting tray in a sheet removal position to a second posture which is set to be substantially horizontal and different from said first posture; and (c) pulling the pile of sheets stacked on said sorting tray in said sheet removal position therefrom.

2. The method according to claim 1, wherein all of the sorting trays are brought to said first posture in said step (a).

3. The method according to claim 2, wherein said first posture is set to be inclined to a horizontal surface by a predetermined acute angle.

4. The method according to claim 1, wherein all of the sorting trays are brought to said second posture in said step (b).

5. The method according to claim 1, further comprising, between said steps (b) and (c), a step of:

(d) displacing the pile of sheets stacked on said sorting tray in said sheet removal position in a direction intersecting to a sheet removing direction, in which the pile of sheets are taken out therefrom, by a predetermined distance.

6. The method according to claim 1, further comprising, between said steps (b) and (c), a step of:

(d) displacing the pile of sheets stacked on said sorting tray in said sheet removal position in a sheet introducing direction, in which the sheets are introduced onto said sorting tray in said sheet receiving position, by a predetermined distance.

7. The method according to claim 1, wherein said step (c) includes substeps of:

(c-1) approaching gripper means for gripping the pile of sheets, to the sorting tray in said sheet removal position in a predetermined moving direction;

(c-2) gripping the pile of sheets stacked on said sorting tray in said sheet removal position; and (c-3) separating said gripper means from said sorting tray in said sheet removal position to pull the gripped pile of sheets on said sorting tray in said sheet removal position therefrom.

8. The method according to claim 7, wherein said moving direction is set to intersect to a direction in which the sheets are introduced onto said sorting tray in said sheet receiving position.

9. The method according to claim 7, wherein said step (c) further includes, after said substep (c-3), a substep of:

(c-4) moving said gripper means in an upward direction.

10. The method according to claim 9, wherein said step (c) further includes, between said substeps (c-2) and (c-3), a substep of:

(c-5) displacing said gripper means which grips the pile of sheets stacked on said sorting tray in said sheet removal position in a direction intersecting to said moving direction by a predetermined distance.

11. The method according to claim 1, wherein said sorting tray in said sheet removal position is changed its posture by moving a distal end thereof in a vertical direction relative to a proximal end thereof, in said step (b).

12. The method according to claim 11, wherein said posture of the sorting tray in said sheet removal position is changed from said first posture to said second posture by moving down the distal end of said sorting tray so as to be substantially flush with the proximal end thereof with respect to the horizontal line.

13. A method of post-treating sheets, comprising the steps of:

(a) bringing a posture of at least a sorting tray which is positioned in a sheet receiving position into a first posture;

(b) stacking sheets with images recorded thereon, which are discharged from an image forming apparatus, onto said sorting tray in the sheet receiving position;

(c) changing the posture of at least a sorting tray which is positioned in a sheet removal position to a second posture which is set to be substantially horizontal and different from said first posture, after a completion of said step (b); and (d) pulling the pile of sheets stacked on said sorting tray in said sheet removal position therefrom.

14. The method according to claim 13, wherein all of the sorting trays are brought to said first posture in said step (a).

15. The method according to claim 14, wherein said first posture is set to be inclined to a horizontal surface by a predetermined acute angle.

16. The method according to claim 13, wherein all of the sorting trays are brought to said second posture in said step (c).

17. The method according to claim 13, further comprising, between said steps (c) and (d), a step of:

(e) displacing the pile of sheets stacked on said sorting tray in said sheet removal position in a direction intersecting to a sheet removing direction, in which the pile of sheets are taken out therefrom, by a predetermined distance.

18. The method according to claim 13, further comprising, between said steps (c) and (d), a step of:

(e) displacing the pile of sheets stacked on said sorting tray in said sheet removal position in a sheet introducing direction, in which the sheets are introduced onto said sorting tray in said sheet receiving position, by a predetermined distance.

19. The method according to claim 13, wherein said step (d) includes substeps of:

(d-1) approaching gripper means for gripping the pile of sheets, to the sorting tray in said sheet removal position in a predetermined moving direction;

(d-2) gripping the pile of sheets stacked on said sorting tray in said sheet removal position; and (d-3) separating said gripper means from said sorting tray in said sheet removal position to pull the gripped pile of sheets on said sorting tray in said sheet removal position therefrom.

20. The method according to claim 19, wherein said moving direction is set to intersect to a direction in which the sheets are introduced onto said sorting tray in said sheet receiving position.

21. The method according to claim 19, wherein said step (d) further includes, after said substep (d-3), a substep of:

(d-4) moving said gripper means in an upward direction.

22. The method according to claim 21, wherein said step (d) further includes, between said substeps (d-2) and (d-3), a substep of:

(d-5) displacing said gripper means which grips the pile of sheets stacked on said sorting tray in said sheet removal position in a direction intersecting to said moving direction by a predetermined distance.

23. The method according to claim 13, wherein said sorting tray in said sheet removal position is changed its posture by moving a distal end thereof in a vertical direction relative to a proximal end thereof, in said step (c).

24. The method according to claim 23, wherein said posture of the sorting tray in said sheet removal position is changed from said first posture to said second posture by moving down the distal end of said sorting tray so as to be substantially flush with the proximal end thereof with respect to the horizontal line.

25. An apparatus for post-treating sheets with images recorded thereon which are discharged from an image forming apparatus, comprising:

a plurality of sorting trays for stacking sheets successively thereon in a vertical direction, said sorting trays being arranged in said vertical direction and supported for movement in said vertical direction;

tray actuating means for moving said sorting trays successively to a sheet receiving position in the vertical direction;

posture changing means for changing a posture of the sorting tray;

gripper means for gripping a pile of sheets stacked on one of said sorting trays which is positioned in a sheet removal position; and gripper actuating means for moving said gripper means in both a sheet removing direction and an upward direction on a downstream side of the sorting trays with respect to said sheet removing direction to pull the pile of sheets gripped by said gripper means from said sorting trays in said sheet removal position, and wherein said posture changing means changes the posture of the sorting tray in said sheet receiving position to a first posture, while changes that in said sheet removal position to a second posture different from said first posture.

26. The apparatus according to claim 25, wherein said first posture is set to be inclined to a horizontal surface by a predetermined acute angle; and said second posture is set to be substantially horizontal.

27. The apparatus according to claim 26, wherein said tray actuating means actuates the first and second lead screw rod drive means simultaneously when the sorting trays are successively to the sheet receiving position.

28. The apparatus according to claim 27, wherein said posture changing means drives the first and second lead screw rod drive means independently when the posture of the sorting tray is changed.

29. The apparatus according to claim 28, wherein said posture changing means changes a rotational phase of each of the first and second lead screw rod drive means when the posture of the sorting tray is changed.

30. The apparatus according to claim 28, wherein said posture changing means drives the first and second lead screw rod drive means in such a fashion that a distal end on the downstream side of the sorting tray with respect to a sheet introducing direction in which the sheets are introduced onto said sorting tray in the sheet receiving position is moved relative to a proximal end on the upstream side of the sorting tray with respect to the sheet introducing direction when the posture of the sorting tray is changed.

31. The apparatus according to claim 30, wherein said posture changing means drives the first and second lead screw rod drive means relatively in such a fashion that the distal end of the sorting tray is moved to be the same height as the proximal end thereof when the posture of the sorting tray is changed from the first posture to the second posture.

32. The apparatus according to claim 30, wherein said posture changing means drives the first and second lead screw rod drive means relatively in such a fashion that the distal end of the sorting tray is moved up to be higher than the proximal end thereof when the posture of the sorting tray is changed from the second posture to the first posture.

33. The apparatus according to claim 25, wherein said tray actuating means includes:

four lead screw rods arranged to correspond to four corners of the sorting tray, respectively, and each having a lead screw groove formed on the outer periphery thereof so as to be engaged with an engaging member which is formed to corresponding one of four corners of the sorting tray;

first lead screw rod drive means for simultaneously rotating two lead screw rods on an upstream side of the four lead screw rods with respect to a sheet introducing direction in which the sheets are introduced onto said sorting tray in said sheet receiving position; and second lead screw rod drive means for simultaneously rotating two lead screw rods on a downstream side of the four lead screw rods with respect to said sheet introducing direction.

34. The apparatus according to claim 33, wherein said tray actuating means actuates the first and second lead screw rod drive means simultaneously when the sorting trays are successively to the sheet receiving position.

35. The apparatus according to claim 34, wherein said posture changing means drives the first and second lead screw rod drive means independently when the posture of the sorting tray is changed.

36. The apparatus according to claim 35, wherein said posture changing means changes a rotational phase of each of the first and second lead screw rod drive means when the posture of the sorting tray is changed.

37. The apparatus according to claim 35, wherein said posture changing means drives the first and second lead screw rod drive means in such a fashion that a distal end on the downstream side of the sorting tray with respect to said sheet introducing direction is moved relative to a proximal end on the upstream side of the sorting tray with respect to the sheet introducing direction when the posture of the sorting tray is changed.

38. The apparatus according to claim 37, wherein said posture changing means drives the first and second lead screw rod drive means relatively in such a fashion that the distal end of the sorting tray is moved to be the same height as the proximal end thereof when the posture of the sorting tray is changed from the first posture to the second posture.

39. The apparatus according to claim 37, wherein said posture changing means drives the first and second lead screw rod drive means relatively in such a fashion that the distal end of the sorting tray is moved up to be higher than the proximal end thereof when the posture of the sorting tray is changed from the second posture to the first posture.

40. An apparatus for post-treating sheets with images recorded thereon which are discharged from an image forming apparatus, comprising:

a plurality of sorting trays for stacking sheets successively thereon in a vertical direction, said sorting trays being arranged in said vertical direction and supported for movement in said vertical direction;

tray actuating means for moving said sorting trays successively to a sheet receiving position in the vertical direction;

posture changing means for changing a posture of the sorting tray;

gripper means for gripping a pile of sheets stacked on one of said sorting trays which is positioned in a sheet removal position; and gripper actuating means for moving said gripper means in both a sheet removing direction and an upward direction on a downstream side of the sorting trays with respect to said sheet removing direction to pull the pile of sheets gripped by said gripper means from said sorting trays in said sheet removal position, and wherein said posture changing means changes the posture of the sorting tray to a first posture when the sheets are introduced onto the sorting tray in said sheet receiving position, while changes the posture of the sorting tray to a second posture when the pile of sheets are taken out from said sorting tray in said sheet removal position.

41. The apparatus according to claim 40, wherein said first posture is set to be inclined to a horizontal surface by a predetermined acute angle; and said second posture is set to be substantially horizontal.

42. The apparatus according to claim 41, wherein said tray actuating means actuates the first and second lead screw rod drive means simultaneously when the sorting trays are successively to the sheet receiving position.

43. The apparatus according to claim 42, wherein said posture changing means drives the first and second lead screw rod drive means independently when the posture of the sorting tray is changed.

44. The apparatus according to claim 43, wherein said posture changing means changes a rotational phase of each of the first and second lead screw rod drive means when the posture of the sorting tray is changed.

45. The apparatus according to claim 43, wherein said posture changing means drives the first and second lead screw rod drive means in such a fashion that a distal end on the downstream side of the sorting tray with respect to a sheet introducing direction in which the sheets are introduced onto said sorting tray in the sheet receiving position is moved relative to a proximal end on the upstream side of the sorting tray with respect to the sheet introducing direction when the posture of the sorting tray is changed.

46. The apparatus according to claim 45, wherein said posture changing means drives the first and second lead screw rod drive means relatively in such a fashion that the distal end of the sorting tray is moved to be the same height as the proximal end thereof when the posture of the sorting tray is changed from the first posture to the second posture.

47. The apparatus according to claim 45, wherein said posture changing means drives the first and second lead screw rod drive means relatively in such a fashion that the distal end of the sorting tray is moved up to be higher than the proximal end thereof when the posture of the sorting tray is changed from the second posture to the first posture.

48. The apparatus according to claim 40, wherein said tray actuating means includes:

four lead screw rods arranged to correspond to four corners of the sorting tray, respectively, and each having a lead screw groove formed on the outer periphery thereof so as to be engaged with an engaging member which is formed to corresponding one of four corners of the sorting tray;

first lead screw rod drive means for simultaneously rotating two lead screw rods on an upstream side of the four lead screw rods with respect to a sheet introducing direction in which the sheets are introduced onto said sorting tray in said sheet receiving position; and second lead screw rod drive means for simultaneously rotating two lead screw rods on a downstream side of the four lead screw rods with respect to said sheet introducing direction.

49. The apparatus according to claim 48, wherein said tray actuating means actuates the first and second lead screw rod drive means simultaneously when the sorting trays are successively to the sheet receiving position.

50. The apparatus according to claim 49, wherein said posture changing means drives the first and second lead screw rod drive means independently when the posture of the sorting tray is changed.

51. The apparatus according to claim 50, wherein said posture changing means changes a rotational phase of each of the first and second lead screw rod drive means when the posture of the sorting tray is changed.

52. The apparatus according to claim 50, wherein said posture changing means drives the first and second lead screw rod drive means in such a fashion that a distal end on the downstream side of the sorting tray with respect to said sheet introducing direction is moved relative to a proximal end on the upstream side of the sorting tray with respect to the sheet introducing direction when the posture of the sorting tray is changed.

53. The apparatus according to claim 52, wherein said posture changing means drives the first and second lead screw rod drive means relatively in such a fashion that the distal end of the sorting tray is moved to be the same height as the proximal end thereof when the posture of the sorting tray is changed from the first posture to the second posture.

54. The apparatus according to claim 52, wherein said posture changing means drives the first and second lead screw rod drive means relatively in such a fashion that the distal end of the sorting tray is moved up to be higher than the proximal end thereof when the posture of the sorting tray is changed from the second posture to the first posture.

55. A method of post-treating sheets with images recorded thereon which are discharged from an image forming apparatus, comprising steps of:

(a) stacking sheets onto a sorting tray which is positioned in a sheet receiving position;

(b) moving the sorting tray in a sheet removal position so as to oppose to a sheet removal port;

(c) gripping a pile of sheets stacked on the sorting tray in said sheet removal position by gripper means; and (d) pulling said gripper means with being gripping the pile of sheets in a sheet removing direction.

56. The method according to claim 55, wherein said sheet removal port is set to extend to be substantially horizontal; and said sorting tray is moved to be substantially horizontal in a condition where it opposes to said sheet removal port.

57. The method according to claim 55, wherein said sheet removing direction is set to intersect to a direction in which the sheets are introduced onto the sorting tray in said sheet receiving position.

58. The method according to claim 57, wherein said sheet removal port is set to extend to be substantially horizontal; and said sorting tray is moved to be substantially horizontal in a condition where it opposes to said sheet removal port.

59. The method according to claim 55, further comprising, after said step (d), a step of:

(e) moving up said gripper means with being gripping the pile of sheets.

60. A method of post-treating sheets, comprising steps of;

(a) bringing a posture of a sorting tray into a first posture;

(b) moving the sorting tray to a sheet receiving position in which the sheets with images recorded thereon which are discharged from an image forming apparatus;

(c) stacking the sheets onto the sorting tray in said sheet receiving position;

(d) changing the posture of the sorting tray from the first posture to a second posture different from said first posture after a completion of said step (c);

(e) moving the sorting tray to a sheet removal position so as to oppose to a sheet removal port which is formed to correspond to said second posture;

(f) gripping a pile of sheets stacked on the sorting tray in said sheet removal position by gripper means; and (g) pulling said gripper means with being gripping the pile of sheets in a sheet removing direction.

61. The method according to claim 60, wherein said first posture is set to be inclined to a horizontal surface by a predetermined acute angle.

62. The method according to claim 60, wherein said second posture is set to be substantially horizontal.

63. The method according to claim 62, wherein said sheet removal port is set to extend to be substantially horizontal; and said sorting tray is moved to be substantially horizontal in a condition where it opposes to said sheet removal port.

64. The method according to claim 60, wherein said sheet removal direction is set to intersect to a direction in which the sheets are introduced onto said sorting tray in the sheet receiving position.

65. The method according to claim 64, wherein said second posture is set to be substantially horizontal.

66. The method according to claim 65, wherein said sheet removal port is set to extend to be substantially horizontal; and said sorting tray is moved to be substantially horizontal in a condition where it opposes to said sheet removal port.

67. The method according to claim 64, wherein said first posture is set to be inclined to a horizontal surface by a predetermined acute angle.

68. The method according to claim 67, wherein said second posture is set to be substantially horizontal.

69. The method according to claim 68, wherein said sheet removal port is set to extend to be substantially horizontal; and said sorting tray is moved to be substantially horizontal in a condition where it opposes to said sheet removal port.

70. The method according to claim 60, further comprising, after said step (g), a step of:

(h) moving up said gripper means with being gripping the pile of sheets.

71. An apparatus for post-treating sheets with images recorded thereon which are discharged from an image forming apparatus, comprising:

a plurality of sorting trays for stacking sheets successively thereon in a vertical direction, said sorting trays being arranged in said vertical direction and supported for movement in said vertical direction;

tray actuating means for vertically moving said sorting trays successively to a sheet receiving position to which the sheets are introduced and to a sheet removal position from which a pile of sheets is taken out in a sheet removing direction;

a closure plate arranged on the downstream side of the sorting trays with respect to said sheet removing direction;

a sheet removal port formed to said closure plate, corresponding to the sorting tray in the sheet removal position;

gripper means for gripping the pile of sheets stacked on the sorting tray in at least the sheet removal position through said sheet removal port;

gripper actuating means for moving said gripper means in said sheet removing direction; and posture changing means for changing a posture of the sorting tray, defining the posture of the sorting tray in at least said sheet removal position to a second posture when the pile of the sheets is removed in the sheet removing direction and changing the posture of the sorting tray in at least said sheet removal position from the second posture to a first posture different from said second posture when the sheets are successively stacked thereon;

wherein said sheet removal port is formed in such a manner that both lateral side portions of the pile of sheets with the minimum size stacked on the sorting tray in the sheet removal position abut against side edges of the sheet removal port when the sorting tray has the first posture.

72. The apparatus according to claim 71, wherein said sheet removing direction is set to intersect to a sheet introducing direction in which the sheets are introduced onto the sorting tray in said sheet receiving position.

73. The apparatus according to claim 71, wherein said gripper actuating means moves said gripper means upward, on the downstream side of the sorting tray with respect to said sheet removing direction.

74. The apparatus according to claim 71, wherein said sheet removal port is formed to have a size and positioned in such a manner that the pile of sheets is only taken out from the sorting tray in the sheet removal position therethrough.

75. The apparatus according to claim 71, further comprising;

posture changing means for changing a posture of the sorting tray between a first posture and a second posture different from the first posture.

76. The apparatus according to claim 75, wherein said first posture is set to be inclined to a horizontal surface by an acute angle, and said second posture is set to be substantially horizontal.

77. The apparatus according to claim 76, wherein said sheet removal port is formed in such a manner that both lateral side portions of the pile of sheets with the minimum size stacked on the sorting tray in the sheet removal position abut against side edges of the sheet removal port when the sorting tray has the first posture.

78. The apparatus according to claim 76, wherein said posture changing means changes the posture of the sorting tray to the first posture when the sorting tray is in the sheet receiving position, while to the second posture when the sorting tray is in the sheet removal position.

79. The apparatus according to claim 78, wherein said sheet removal port is set to extend substantially in the horizontal direction.

80. The apparatus according to claim 79, further comprising:

aligning means for aligning the pile of sheets, stacked on said sorting tray in the sheet receiving position, with respect to the sheet removing direction when the sheets are introduced onto the sorting tray in the sheet receiving position.

81. The apparatus according to claim 80, wherein said aligning means is separated from the pile of sheets stacked on the sorting tray in the sheet receiving position when the posture changing means changes the posture of the sorting tray.

82. The apparatus according to claim 80, wherein said aligning means includes:

an aligning rod movable in said sheet removing direction; and aligning rod actuating means for moving said aligning rod in said sheet removing direction to abut the pile of sheets against said closure plate, thereby aligning the pile of sheets with respect to the sheet removal direction.

* * * * *